US009924763B2

(12) United States Patent
Foxen

(10) Patent No.: US 9,924,763 B2
(45) Date of Patent: Mar. 27, 2018

(54) ARTICLE OF FOOTWEAR INCLUDING SOLE COMPONENT PROVIDING LATERAL ROLL CONTROL STRUCTURE

(71) Applicant: NIKE, Inc., Beaverton, OR (US)

(72) Inventor: Thomas Foxen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 88 days.

(21) Appl. No.: 14/827,833

(22) Filed: Aug. 17, 2015

(65) Prior Publication Data

US 2017/0049183 A1 Feb. 23, 2017

(51) Int. Cl.
*A43B 13/14* (2006.01)
*A43B 13/12* (2006.01)

(52) U.S. Cl.
CPC ..... *A43B 13/14* (2013.01); *A43B 13/12* (2013.01)

(58) Field of Classification Search
CPC ..... A43B 13/12; A43B 13/14; A43B 13/141; A43B 13/026
See application file for complete search history.

(56) References Cited

U.S. PATENT DOCUMENTS 1,310,358 A * 7/1919 Manderfield ..... A43B 5/18 36/7.5
2,095,398 A * 10/1937 Reeves ..... A43B 13/14 36/149
2,123,567 A * 7/1938 Gilbert ..... A43B 9/00 12/142 D
4,930,231 A * 6/1990 Liu ..... A43B 13/14 36/30 A
4,972,610 A * 11/1990 Tong ..... A43B 3/0068 36/11.5
5,224,810 A 7/1993 Pitkin
6,295,744 B1 10/2001 Ellis, III
7,062,865 B1 6/2006 Nordt, III
7,082,702 B2 * 8/2006 Cretinon ..... A43B 13/026 36/107
7,647,709 B2 1/2010 Reilly et al.
8,365,440 B2 2/2013 Rivas et al.
8,365,442 B2 2/2013 Baker et al.
2004/0123493 A1 * 7/2004 Russell ..... A43B 13/10 36/28
2004/0128861 A1 * 7/2004 Durand ..... A43B 3/26 36/97
2010/0236096 A1 9/2010 Pauk et al.
(Continued)

*Primary Examiner* — Jila M Mohandesi
(74) *Attorney, Agent, or Firm* — Banner & Witcoff, Ltd.

(57) ABSTRACT

An article of footwear includes a sole structure providing lateral roll control structure. The sole structure includes a sole component having a continuous slit located in a central region of the sole component and progressing in a longitudinal direction of the sole component. The slit forms a laterally extending portion(s) that extends from a medial side of the sole component to a lateral side of the sole structure, a distal end of the laterally extending portion being attached to an opposing surface of an adjacent component, and a medially extending portion(s) that extends from a lateral side of the sole component to a medial side of the sole structure, a distal end of the medially extending portion being attached to the opposing surface of the adjacent component, the laterally extending portion(s) and the medially extending portion(s) alternating in a longitudinal direction of the sole component.

19 Claims, 22 Drawing Sheets

(56) References Cited

U.S. PATENT DOCUMENTS

| | | | | |
|---|---|---|---|---|
| 2011/0067268 | A1* | 3/2011 | Lubart | A43B 13/125 36/92 |
| 2011/0252671 | A1* | 10/2011 | Maron | A43B 3/0057 36/30 R |
| 2012/0011744 | A1 | 1/2012 | Bell et al. | |
| 2012/0079747 | A1 | 4/2012 | Seo | |
| 2012/0174432 | A1* | 7/2012 | Peyton | A43B 13/125 36/28 |

* cited by examiner

ARTICLE OF FOOTWEAR INCLUDING SOLE COMPONENT PROVIDING LATERAL ROLL CONTROL STRUCTURE

FIELD OF THE INVENTION

The present embodiments generally relate to articles of footwear, and more particularly relate to sole structure for articles of footwear.

BACKGROUND

Articles of footwear typically include two elements, an upper and a sole structure. The upper may provide a covering for the foot that comfortably receives and securely positions the foot with respect to the sole structure. A sole structure may be secured to a lower portion of the upper and generally may be positioned between the foot and a ground surface or other surface. In addition to attenuating ground reaction forces (i.e., providing cushioning) during walking, running, and other ambulatory activities, a sole structure may facilitate control of foot motions (e.g., by resisting pronation), impart stability, facilitate control of twisting and/or bending motions, and provide traction, for example. Accordingly, a sole structure may cooperate with an upper to provide a comfortable structure that is suited for a wide variety of athletic or other activities.

SUMMARY

In one aspect, an article of footwear includes a sole structure comprising a sole component, the sole component having a first surface, an opposite second surface, and a continuous slit that is located in an interior region of the sole component, the continuous slit extending between the first surface and the second surface of the sole component and progressing in a longitudinal direction of the sole component, the continuous slit forming at least one laterally extending portion of the sole component that extends from a medial side of the sole component to a lateral side of the sole component, a distal end of the at least one laterally extending portion being configured to be attached to an opposing surface of an external component of the article of footwear that is located adjacent to the sole component, and at least one medially extending portion of the sole component that extends from a lateral side of the sole component to the medial side of the sole component, a distal end of the at least one medially extending portion of the sole component being configured to be attached to the opposing surface of the external component of the article of footwear, the at least one laterally extending portion and the at least one medially extending portion alternating in a longitudinal direction of the sole component.

In some embodiments, the continuous slit generally may have any configuration that forms a plurality alternating medially and laterally extending portions of the sole component that have a generally repeating geometrical shape, e.g., a Jacob's Ladder configuration. A repeating geometrical shape may be a regular or non-regular geometrical shape. For example, a slit configuration may include a generally serpentine slit configuration that forms alternating medially and laterally extending portions having respective generally parabolic shapes, a "zig-zag" shaped slit configuration that forms alternating medially and laterally extending portions having respective generally triangular shapes, a stepped slit configuration that forms alternating medially and laterally extending portions having respective generally square, rectangular, or trapezoidal shapes, or another repeating slit pattern that forms alternating medially and laterally extending portions having respective corresponding regular or non-regular geometric shapes. A pitch or period of the repeating medially and laterally extending portions may vary in different embodiments. In some embodiments, a pitch or period may be constant.

In some embodiments, a medially- or a laterally-extending portion may have a first geometric shape (regular or non-regular), and an adjacent laterally- or medially-extending portion may have a second geometric shape (regular or non-regular) that is complementary to the first geometric shape. In some embodiments, adjacent medially and laterally extending portions may be interfitting, i.e., geometric shapes of adjacent medially and laterally extending portions may be interfitting.

A sole component may include one or more slit(s) or slit portion(s). In some embodiments, a sole component may include plural slits or slit portions formed in respective regions of the sole component. In some embodiments, a first slit or slit portion may have a first configuration and a second slit or slit portion may have a second configuration. In some embodiments, the second configuration may be the same as the first configuration. In some embodiments, the second configuration may be different from the first configuration, e.g., have a different pitch (distance between repeating elements of the slit or slit portion), different angle (between repeating elements), different width (including a variable width profile), different central line or axis orientation, different central line or axis alignment (or off-set), or other difference in configuration or characteristic.

In some embodiments, a distal end of one of a medially- or a laterally-extending portions of the sole component may include a first attachment portion having a first configuration, and a distal end of the other one of the medially and laterally extending portions of the sole component may include a second attachment portion having a second configuration. In some embodiments, the second configuration may be the same as the first configuration. In some embodiments, the second configuration may be different than the first configuration. In some embodiments, an attachment portion of a medially- or laterally-extending portion may have a width in a longitudinal direction of the sole component that is greater than a width of the medially- or laterally-extending portion at a location adjacent to the attachment portion.

In some embodiments, a distal end of a medially- or laterally-extending portion of the sole component may have a tab arranged at an angle relative to a medial-lateral direction of the sole component. In some embodiments, a distal end of a laterally extending portion of the sole component may have a first tab that is arranged or oriented at a first angle relative to a medial-lateral direction of the sole component, and a distal end of a medially extending portion of the sole component may have a second tab that is arranged or oriented at a second angle relative to the medial-lateral direction of the sole component. In some embodiments, a size of the second angle may be the same as a size of the first angle. In some embodiments, a size of the second angle may be different from a size of the first angle. In some embodiments, the second angle may be arranged in a direction opposite to the first angle relative to the medial-lateral direction of the sole component. In some embodiments, the second angle may be arranged in a direction opposite the first angle relative to the longitudinal direction of the sole component.

In some embodiments, at least one of the first surface and the second surface of the sole component may include a surface layer formed of a material that is different from a material of the body of the sole component, or may have a surface treatment. In some embodiments a surface layer or treatment may modify a response characteristic of the medially and laterally extending portions of the sole component, e.g., to modify a rigidity or flex characteristic of the medially and laterally extending portions of the sole component.

In some embodiments, medially- or laterally-extending portions may have a curved configuration. In some embodiments, the opposing surface of the external component of the article of footwear (e.g., a second component of the sole structure or the upper of the article of footwear) may have a curved or arched surface configuration, such as a generally cylindrical or barrel shaped surface configuration. In some embodiments, the curved surface configuration of the opposing surface of the external component may be concave. In some embodiments, the curved surface configuration of the opposing surface of the external component may be convex.

In another aspect, an article of footwear includes a sole structure, the sole structure including a first sole component and a second sole component. The first sole component has a first surface associated with an opposing surface of the second sole component, a second surface opposite the first surface, and a continuous slit located in a central region of the first sole component, the continuous slit extending between the first surface and the second surface of the first sole component and progressing in a longitudinal direction of the first sole component, the continuous slit forming at least one laterally extending portion of the first sole component that extends from a medial side of the first sole component to a lateral side of the sole structure, a distal end of the at least one laterally extending portion being attached to the opposing surface of the second sole component at the lateral side of the sole structure, and at least one medially extending portion of the first sole component that extends from a lateral side of the first sole component to a medial side of the sole structure, a distal end of the at least one medially extending portion of the first sole component being attached to the opposing surface of the second sole component at the medial side of the sole structure, the at least one laterally extending portion and the at least one medially extending portion of the first sole component alternating in a longitudinal direction of the first sole component.

In another aspect, a method of making an article of footwear includes forming a sole component for a sole structure of the article of footwear, the sole component having a first surface and an opposite second surface, and forming a continuous slit in a central or interior region of the sole component, the continuous slit extending between the first surface and the second surface of the sole component and progressing in a longitudinal direction of the sole component, the process of forming a continuous slit including forming at least one laterally extending portion of the sole component that extends from a medial side of the sole component to a lateral side of the sole component, a distal end of the at least one laterally extending portion being configured for attachment to an opposing surface of an external component of the article of footwear, and forming at least one medially extending portion of the sole component that extends from a lateral side of the sole component to a medial side of the sole component, a distal end of the at least one medially extending portion being configured for attachment to the opposing surface of the external component of the article of footwear, the at least one laterally extending portion and the at least one medially extending portion of the sole component alternating in a longitudinal direction of the sole component.

Each of the above aspects, embodiments, and features may improve at least one performance characteristic of a sole structure of an article of footwear. In particular, these aspects, embodiments, and features, alone and/or in combination, variously may provide a desired lateral roll control characteristic in a sole structure and article of footwear that facilitates lateral support on a ground surface having a grade that is transverse to or oriented in a lateral direction of the article footwear. Further, these aspects, embodiments, and features variously may be combined with one another and/or with one or more other features to improve overall performance of a sole structure and article of footwear.

Other systems, methods, aspects, features, and advantages of embodiments will be, or will become, apparent to one of ordinary skill in the art upon examination of the following figures and detailed description of embodiments. It is intended that all such additional systems, methods, aspects, features, and advantages be included within this description and this summary, be within the scope of the embodiments, and be protected by the following claims.

BRIEF DESCRIPTION OF THE DRAWINGS

The current embodiments may be better understood with reference to the following drawings and description. Elements, components, and features of the embodiments in the figures are not necessarily drawn to scale, emphasis instead being placed upon illustrating principles of the embodiments disclosed. In the figures, like reference numerals designate like or corresponding parts or features throughout the different views, with the initial digit(s) of each reference numeral indicating a figure in which the reference numeral first appears.

DETAILED DESCRIPTION OF EMBODIMENTS

Embodiments of articles of footwear in this description include a sole structure that includes a sole component having a slit configuration that forms a plurality of alternating medially and laterally extending portions located in an interior region of the sole component and provides lateral roll control structure for the sole structure. In some embodiments, this may be referred to as a Jacob's Ladder configuration. The medially and laterally extending portions are configured to individually and collectively flex to enable at least a portion of the sole component to selectively separate from an adjacent component of the article of footwear at a medial or lateral peripheral edge of the article of footwear in a controlled manner. The lateral roll control structure thus may control a direction and/or range of rolling motion of the sole component relative to another component of the article of footwear (e.g., relative to another component of the sole structure or relative to the upper of the article of footwear) in a medial-lateral direction of the article of footwear. In this manner, the lateral roll control structure may enable the upper of the article of footwear to maintain a generally horizontal orientation or state while an exposed lower surface of the sole structure maintains an inclined orientation or state, e.g., while engaging a ground surface having a grade that is transverse to or at an angle of inclination in a medial or lateral direction of the article of footwear, such as on a beach or hillside. The lateral roll control structure thus may facilitate maintaining a stable, secure, comfortable, and generally horizontal orientation of the upper and foot in response to the article of footwear being disposed on a ground surface having a grade that is transverse to the article of footwear, and/or during movement of the article of footwear over an inclined ground surface, such as when standing, walking, or running on or along a beach or hillside.

Figure 1:
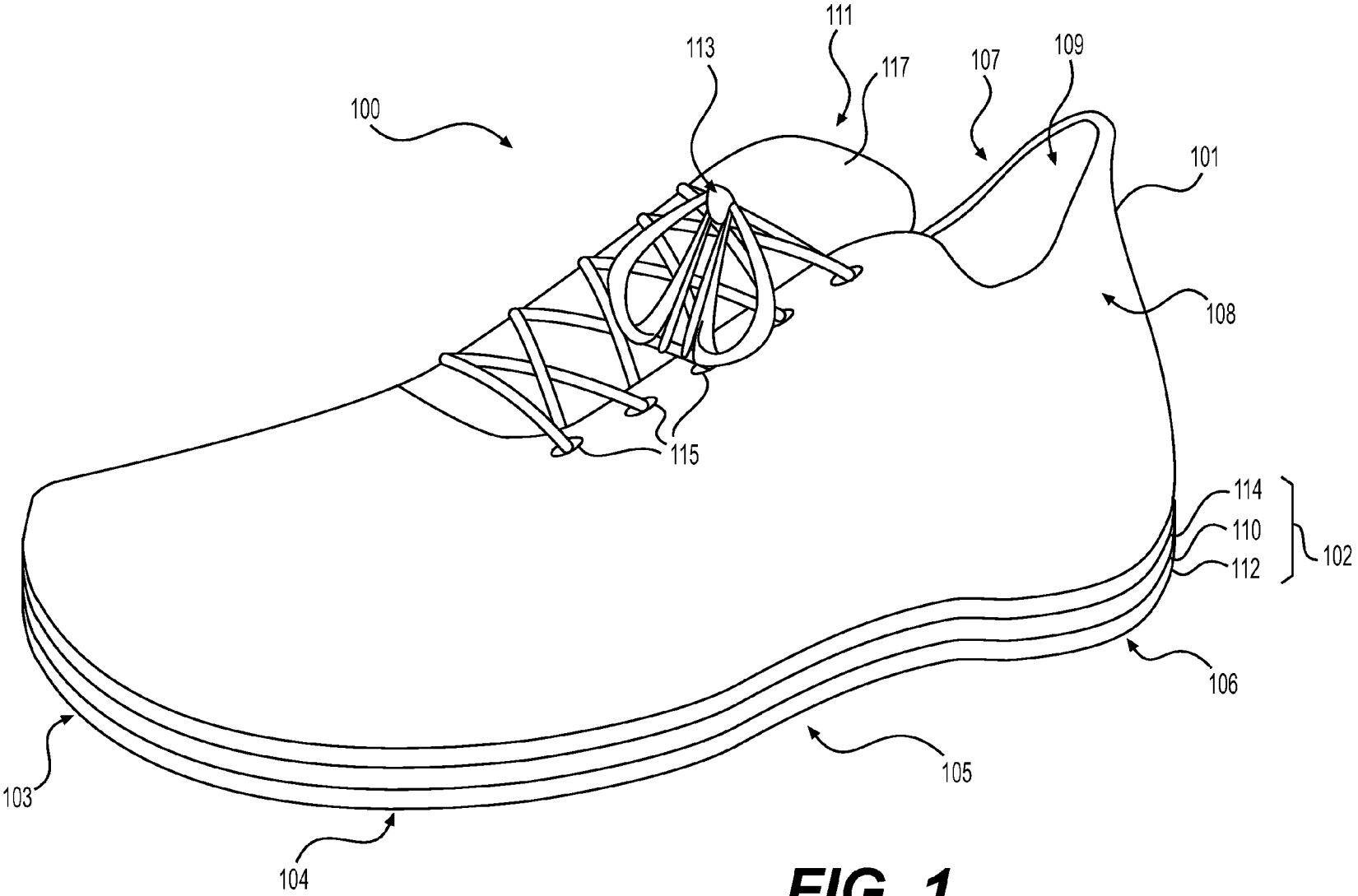
FIG. 1 is a schematic side perspective view of an embodiment of an article of footwear having a sole structure including a sole component providing lateral roll control structure.

FIG. 1 illustrates an embodiment of an article of footwear 100, generally including an upper 101 and a sole structure 102. In some embodiments, sole structure 102 may include a sole component providing lateral roll control structure for sole structure 102 and article of footwear 100.

The following discussion and accompanying figures disclose article of footwear 100 as having a general configuration suitable for standing, walking, or running on or along a ground surface having a grade that is transverse to or at an angle of inclination in a medial or lateral direction of the article of footwear, such as beach shoes, beach sandals, hiking shoes, or hiking sandals. Concepts and features associated with article of footwear 100 also may be applied to a variety of athletic footwear types, including running shoes, baseball shoes, basketball shoes, cross-training shoes, cycling shoes, football shoes, golf shoes, and tennis shoes, for example. Concepts and features associated with article of footwear 100 also may be applied to footwear types that are generally considered to be non-athletic, including dress shoes, loafers, sandals, and work boots, for example. One skilled in the relevant art will appreciate that features and concepts of the disclosed embodiments may apply to a wide variety of footwear styles, in addition to the specific styles discussed in this detailed description of embodiments and depicted in the accompanying figures.

Embodiments generally may be described with reference to various regions or sides of article of footwear 100. As shown in FIG. 1, article of footwear 100 generally may have a toe region 103, a forefoot region 104, a midfoot region 105, and a heel region 106. Toe region 103 may form a portion of forefoot region 104. Article of footwear 100 generally may have a medial side 107 and a lateral side 108. It will be understood that references to toe region 103, forefoot region 104, midfoot region 105, heel region 106, medial side 107, and lateral side 108 are only intended for purposes of description and are not intended to demarcate precise portions or regions of sole structure 102. It will be appreciated that toe region 103, forefoot region 104, midfoot region 105, heel region 106, medial side 107, and lateral side 108 also may be used to describe a component of article of footwear 100.

For consistency and convenience, directional adjectives are employed throughout this detailed description corresponding to the illustrated embodiments. The term "longitudinal" as used throughout this detailed description and in the claims refers to a direction extending a length of a component, such as a sole structure. In some cases, the longitudinal direction may extend from a forefoot portion to a heel portion of the component. The term "lateral" as used throughout this detailed description and in the claims refers to a direction extending a width of a component. In some cases, the lateral direction may extend between a medial side and a lateral side of the component, or along the width of the component. The terms longitudinal and lateral can be used with any component of an article of footwear, including a sole structure as well as individual components of the sole structure. The term "vertical" as used throughout this detailed description and in the claims refers to a direction generally perpendicular to a horizontal ground surface in a state where sole structure 102 of article of footwear 100 is disposed flat on the horizontal ground surface. The terms "front," "rear," "proximal," and "distal" generally have their common meaning and may refer to relative directions of article of footwear 100 or a component of article of footwear 100. Those skilled in the art will appreciate the meaning of these terms based on the context in which the term is used in this detailed description of embodiments and in the claims.

The following discussion and accompanying figures disclose article of footwear 100 as generally having an upper 101 and a sole structure 102. Upper 101 and sole structure 102 each variously may include one or more elements or components. Those skilled in the art will appreciate various combinations of configurations and constructions of upper 101 and sole structure 102 in view of this detailed description of embodiments.

Upper 101 may vary in different embodiments. Upper 101 generally may have any known or later developed configuration. As shown in FIG. 1, upper 101 may be depicted as having a configuration incorporating one or more material elements (e.g., knit, woven, or other textiles, foam, leather, synthetic leather, and other materials) that may be stitched or adhesively bonded together to form an interior void for securely and comfortably receiving a foot. The material elements may be selected and located with respect to upper 101 in order to selectively impart properties of durability, air permeability, wear resistance, flexibility, and comfort, for example. In some embodiments, an ankle opening 109 may be provided in heel region 106 to provide access to the interior void. In some embodiments, upper 101 may include a fastening or closing system 111 that may be utilized to modify the dimensions of the interior void, thereby securing the foot within the interior void and facilitating entry and removal of the foot from the interior void. For example, as shown in FIG. 1, in some embodiments fastening or closing system 111 may be a lacing system that includes lacing 113 that may be laced through apertures 115 in upper 101. In some embodiments, a tongue portion 117 of upper 101 may extend between the interior void and lacing 113. Because various aspects of the present disclosure primarily relate to sole structure 102, it will be appreciated that upper 101 may exhibit the general configuration discussed above or the general configuration of practically any other conventional, non-conventional, or later developed upper suitable for a desired application. Accordingly, the overall structure and configuration of upper 101 may vary significantly in different embodiments.

Sole structure 102 generally may be disposed below upper 101 and configured to engage a ground surface during active use of article of footwear 100. In this manner, sole structure 102 may operate to attenuate impact and other ground reaction forces and absorb energy, e.g., as sole structure 102 engages a ground surface.

Sole structure 102 may be associated with upper 101 in different ways in different embodiments. As shown in FIG. 1, in some embodiments sole structure 102 may be secured to a lower surface of upper 101, such as by stitching, adhesive bonding, or thermal bonding. Those skilled in the art will appreciate various ways of associating sole structure 102 with upper 101 based on this detailed description of embodiments.

A construction and configuration of sole structure 102 may vary in different embodiments. Sole structure 102 variously may include one or more components in different embodiments. For example, as shown in FIG. 1, in some embodiments sole structure 102 may include a first sole component 110, a second sole component 112, and a third sole component 114. In some embodiments, second sole component 112 may be an outer sole component. In some embodiments, third sole component 114 may be a midsole component. In some embodiments, first sole component 110, second sole component 112, and third sole component 114 may be layers of a multi-layer sole structure. For example, in some embodiments sole structure 102 generally may be a multi-layer structure that includes first sole component 110 disposed between second sole component 112 and third sole component 114. In some embodiments, second sole component 112 or third sole component 114 may be optional. That is, in some embodiments at least one of second sole component 112 and third sole component 114 may not be present. In some embodiments, sole structure 102 may include additional elements or components. For example, in some embodiments article of footwear 100 may include an inner sole component or element (not shown) disposed within upper 101 adjacent a foot disposed in article of footwear 100. Those skilled in the art will appreciate alternative sole structures and components suitable for a particular embodiment based on this detailed description of embodiments.

A configuration and construction of a peripheral side edge portion of sole structure 102 may vary in different embodiments. For example, in some embodiments one or more portion, element, or component of sole structure 102 may be exposed around a peripheral edge of sole structure 102. In some embodiments, a portion, element, or component of sole structure 102 may be covered at a peripheral edge by at least a portion of another element or component, such as by a material layer of upper 101 or by a portion of another element or component of sole structure 102. Those skilled in the art will appreciate various peripheral side edge configurations and constructions of sole structure 102 based on this detailed description of embodiments.

Figure 2:
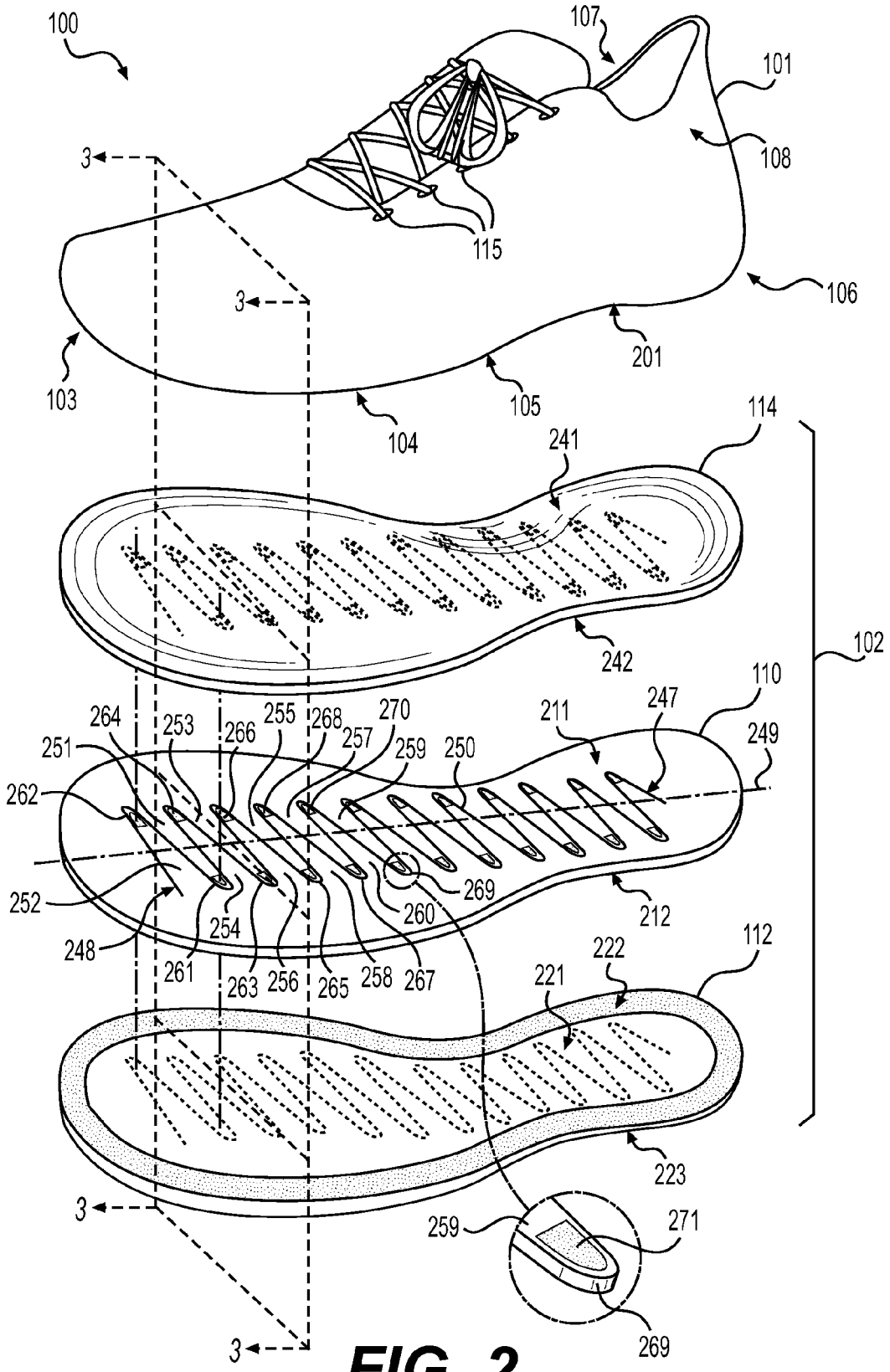
FIG. 2 is a schematic exploded side perspective view of an embodiment of the article of footwear and sole structure of FIG. 1, illustrating an embodiment of a sole component having a slit configuration providing lateral roll control structure.
Figure 3:
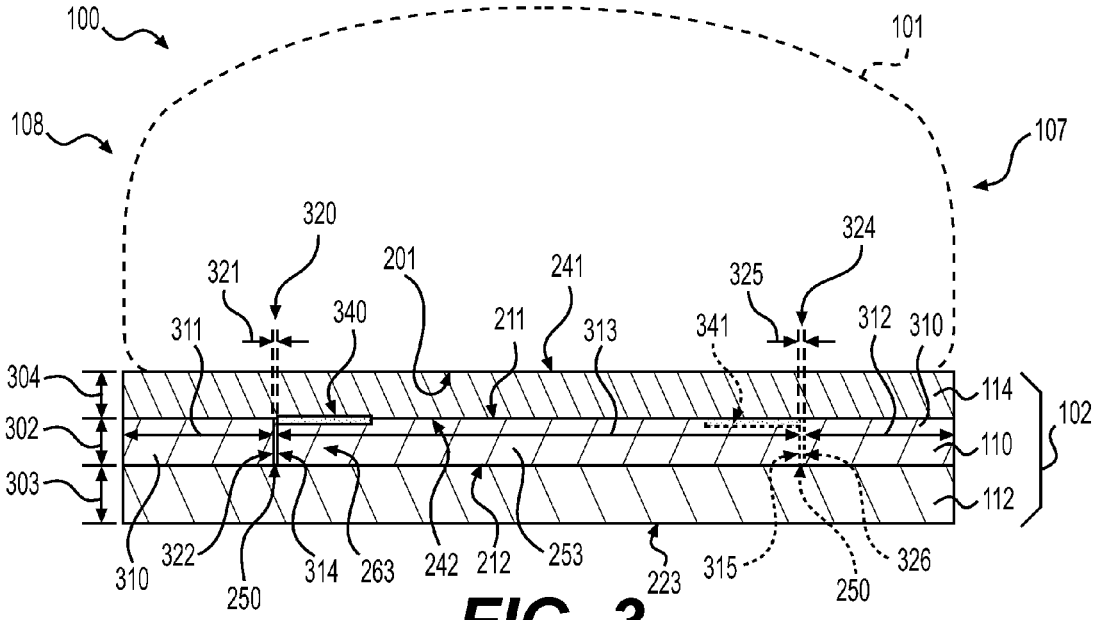
FIG. 3 is a schematic cross-sectional view of an embodiment of an assembled article of footwear and sole structure of FIG. 2, taken along section plane lines 3-3 of FIG. 2.
Figure 4:
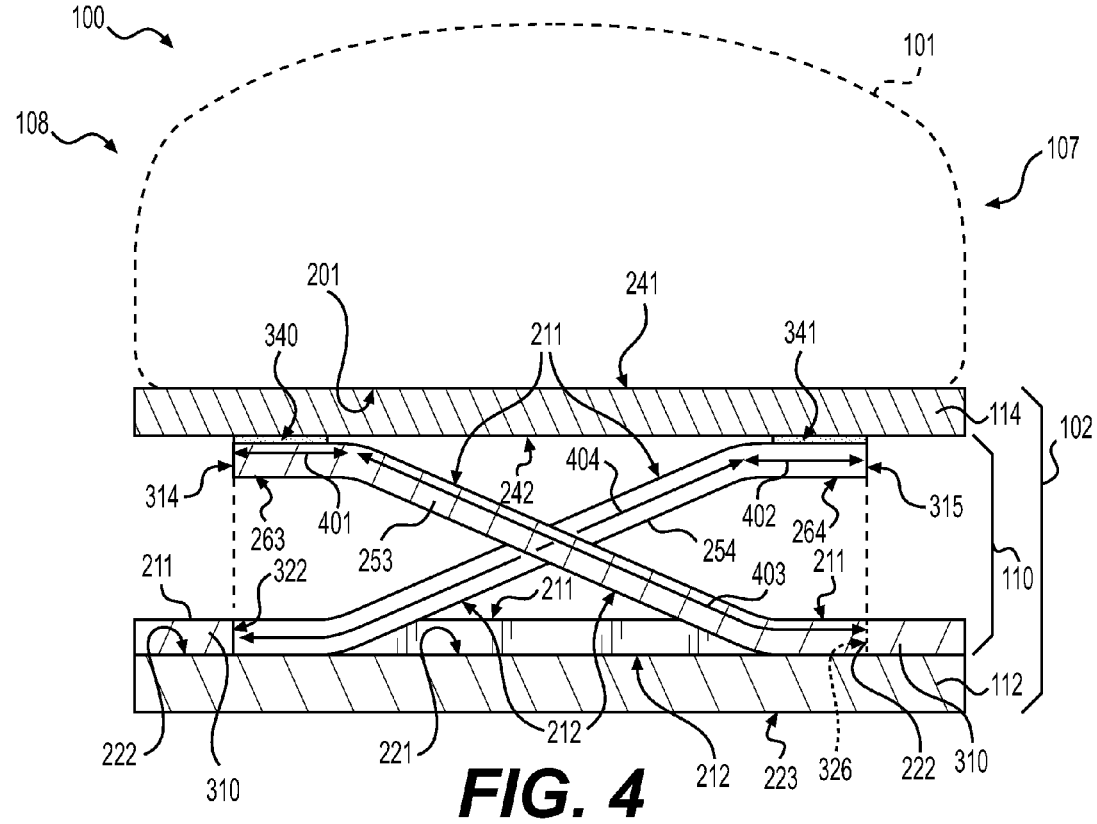
FIG. 4 is a schematic partially exploded cross-sectional view of the article of footwear and sole structure of FIG. 3, illustrating features of the lateral roll control structure of the sole structure.
Figure 5:
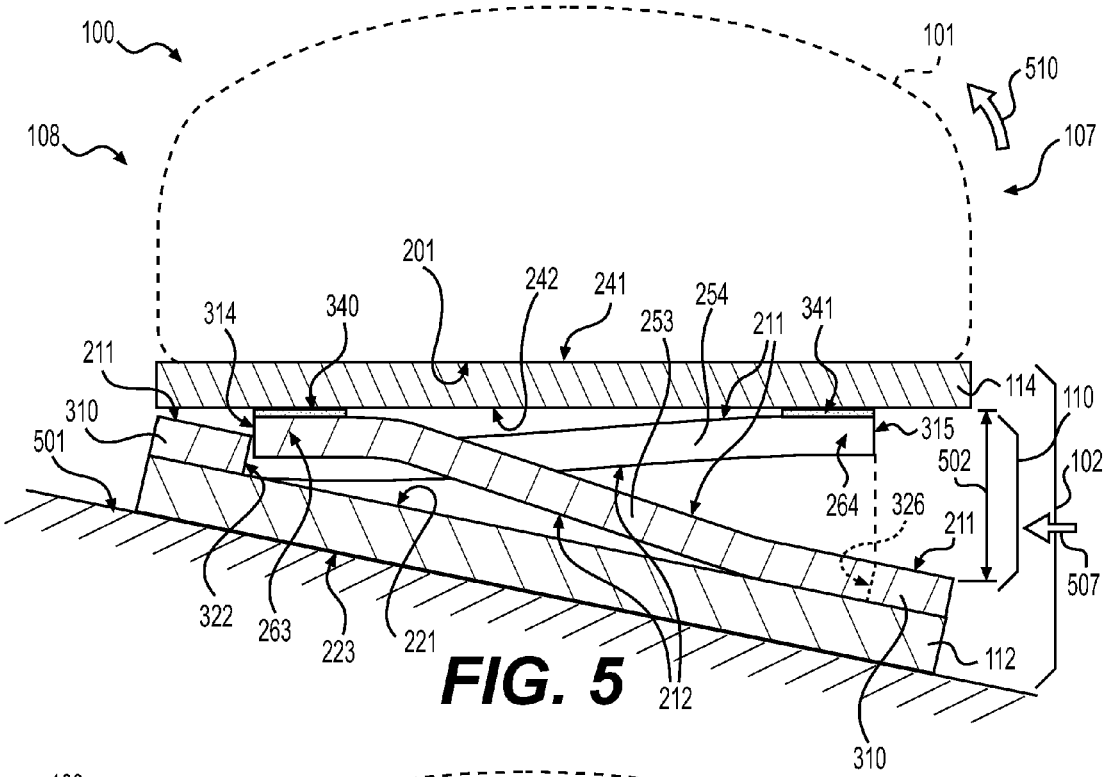
FIG. 5 is a schematic cross-sectional view of the article of footwear and sole structure of FIG. 3, illustrating lateral roll control structure of the sole structure rolling in a lateral direction.
Figure 6:
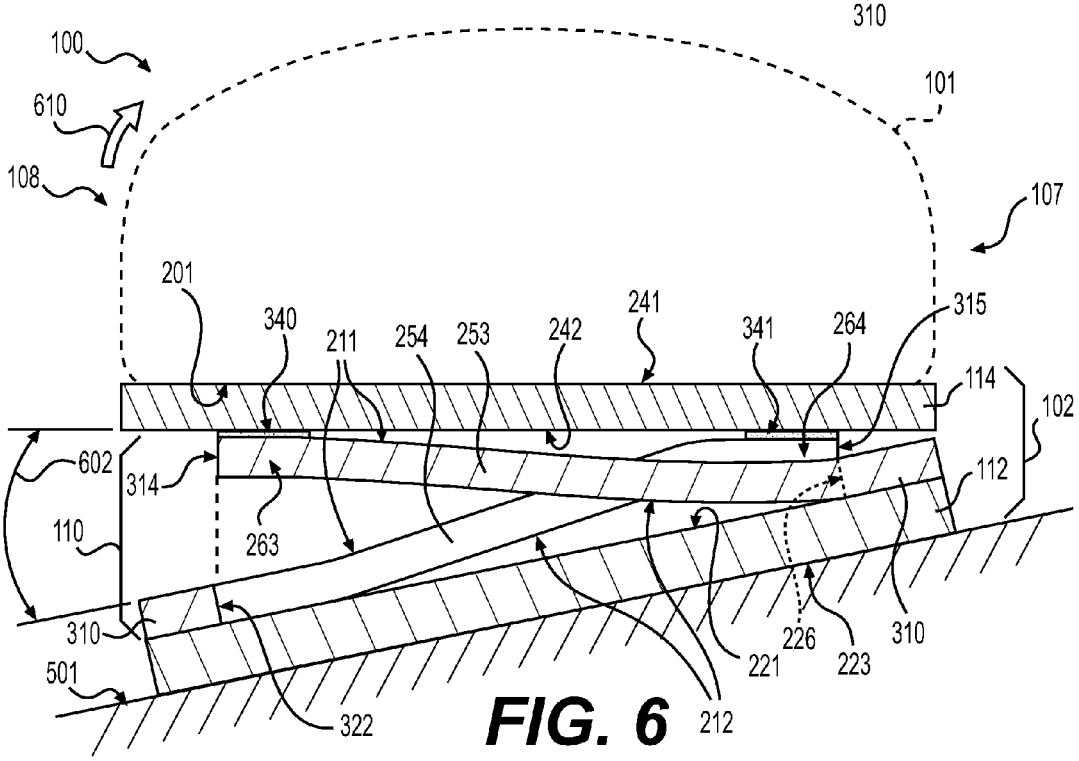
FIG. 6 is a schematic cross-sectional view of the article of footwear and sole structure of FIG. 3, illustrating lateral roll control structure of the sole structure rolling in a medial direction.
Figure 7:
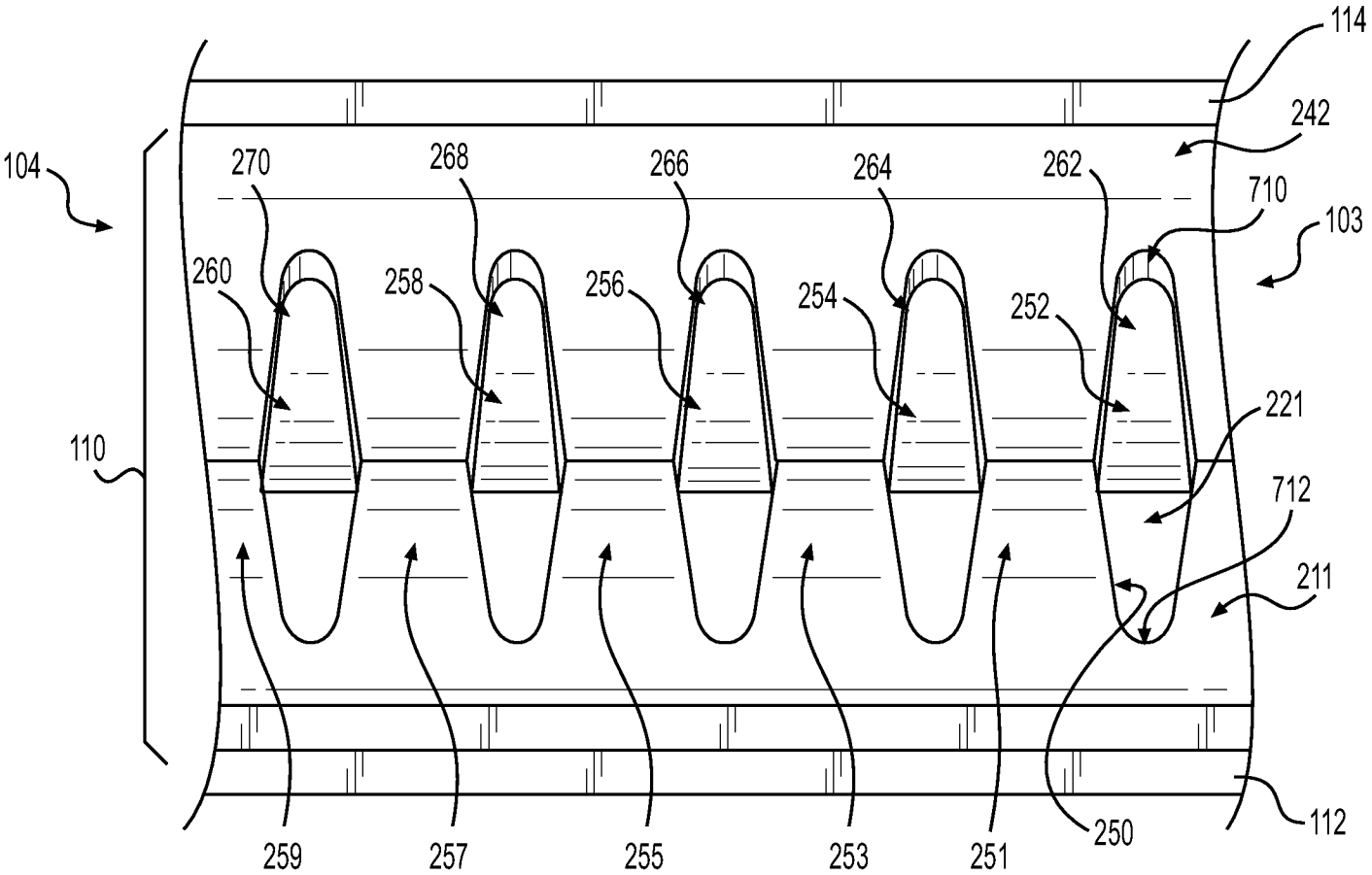
FIG. 7 is a schematic partial side perspective view of a sole structure of FIGS. 2 and 5, as viewed from the medial side of the sole structure, illustrating features of lateral roll control structure rolling in a lateral direction of the sole structure.
Figure 8:
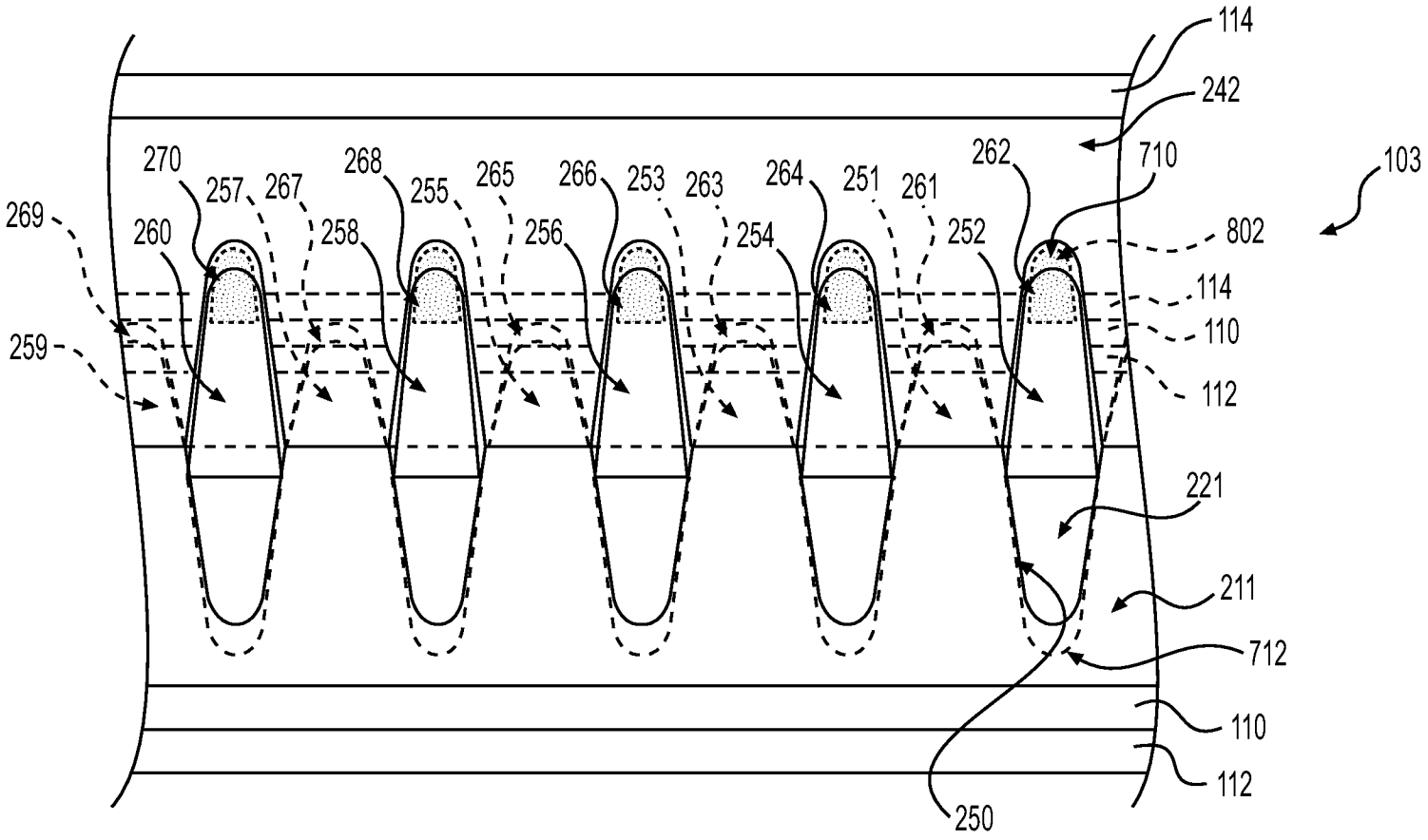
FIG. 8 is a schematic partial side perspective view of the sole structure of FIG. 7, illustrating visible and hidden features of the lateral roll control structure rolling in a lateral direction of the sole structure.

FIGS. 2 to 8 generally illustrate embodiments of an article of footwear that includes a sole structure having lateral roll control structure. In some embodiments, FIG. 2 may be a schematic exploded side perspective view of an embodiment of article of footwear 101 and sole component 102 of FIG. 1. FIGS. 3 and 4 are schematic non-exploded and partially exploded cross-sectional views, respectively, that illustrate embodiments of configuration, construction, and features of sole structure 102 of article of footwear 100. FIGS. 5 and 6 are schematic cross-sectional views of article of footwear 100 that illustrate operational features of lateral roll control structure of sole structure 102 rolling in a lateral direction and rolling in a medial direction, respectively, of sole structure 102 and article of footwear 100. FIG. 7 is a schematic partial side perspective view of sole structure 102 illustrating structure and operational features of lateral roll control structure of sole structure 102. And FIG. 8 is a schematic partial side perspective view of sole structure 102, illustrating structure and operational features of lateral roll control structure of sole structure 102, including certain hidden features (e.g., using stipple shading and phantom lines).

As shown in FIGS. 2 to 8, in some embodiments sole structure 102 generally may have a stacked or multi-layer construction that includes a first sole component 110, a second sole component 112, and a third sole component 114. For example, as shown in FIG. 2, in some embodiments third sole component 114 may be a midsole component configured to be associated with upper 101 of article of footwear 100, second sole component 112 may be an outer sole component having an exposed bottom or lower surface configured to engage a ground surface, and first sole component 110 may be disposed between second sole component 112 and third sole component 114.

Components of sole structure 102 may be associated with one another and with upper 101 in different ways to provide lateral roll control structure in different embodiments. For example, third sole component 114 may be secured to lower surface 201 of upper 101, such as by stitching or adhesive bonding. In some embodiments, all or substantially all of upper surface 241 of third sole component 114 may be secured to lower surface 201 of upper 101, such as by adhesive bonding. In some embodiments, only a portion (e.g., a peripheral portion) of upper surface 241 of third sole component 114 may be secured to lower surface 201 of upper 101, e.g., by stitching or adhesive bonding. As discussed further below, selected portions of first sole component 110 may be secured to lower surface 242 of third sole component 114, such as by adhesive bonding, to form lateral roll control structure. And a peripheral portion 222 of upper surface 221 of second component 112 may be secured to first sole component 110, such as by stitching or adhesive bonding. Those skilled in the art will appreciate alternative methods and configurations suitable for associating first sole component 110, second sole component 112, and third sole component 114 together with one another and with upper 101 to form lateral roll control structure based on this detailed description of embodiments.

A configuration of third sole component 114 may be different in different embodiments. As shown in FIG. 2, in some embodiments third sole component 114 may be a midsole component located adjacent to a foot when the foot is disposed in an interior of upper 101, and configured to attenuate impact and other ground surface forces during active use of article of footwear 100. As shown in FIGS. 2 to 8, third sole component 114 may have a generally planar configuration. In some embodiments, upper surface 241 of third sole component 114 may have a surface contour that generally conforms with one or more contours of the foot. For example, in some embodiments third sole component 114 may have a recessed surface contour in upper surface 241, such as a generally concave-shaped surface contour located in heel region 106 of upper surface 241 configured for securely and comfortably supporting the heel of the foot. In some embodiments, third sole component 114 may have a raised surface contour in upper surface 241, such as a wedge-shaped instep formed at medial side 107 of midfoot region 105 of upper surface 241 configured for comfortably supporting the arch of the foot. In some embodiments, third sole component 114 may have a surface contour that curls upward at a peripheral edge portion of upper surface 241, e.g., to generally mate with a corresponding curved peripheral side portion of lower surface 201 of upper 101. As shown in FIGS. 2 to 6, in some embodiments third sole component 114 may have a lower surface 242 that is substantially flat. In some embodiments, lower surface 242 of third sole component 114 may have a curved surface contour or configuration. For example, in some embodiments lower surface 242 of third sole component 114 may have a generally cylindrically- or barrel-shaped surface having an axis of curvature that generally extends along a longitudinal direction of third sole component 114 (see, e.g., embodiments shown in FIGS. 11 to 20, discussed below). In such case, in some embodiments lower surface 242 may have a curved surface contour that is convex. Alternatively, in some embodiments lower surface 242 may have a curved surface contour that is concave. It will be appreciated that, in some embodiments, a configuration having a curved surface contour may facilitate a rolling operation of lateral roll control structure of sole structure 102 (see, e.g., embodiments shown in FIGS. 11 to 20, discussed below). Those skilled in the art will be able to select a configuration of third sole component 114 suitable for a desired application based on this detailed description of embodiments.

Construction and manufacture of third sole component 114 may vary in different embodiments. Because sole structure 102 may operate to attenuate impact and other ground reaction forces and absorb energy, e.g., as sole structure 102 engages a ground surface during active use, in some embodiments third sole component 114 may be made of a foam material that has an open or closed cell foam material construction. In some embodiments, third sole component 114 may be formed of a polymer foam material, such as polyurethane or ethylvinylacetate. In some embodiments, third sole component 114 may be made by any manufacturing method suitable for making a foam material component. For example, in some embodiments third sole component 114 may be made by the injection molding of a polymer foam material. Those skilled in the art will appreciate alternative and additional materials and methods of making third sole component 114 suitable for a desired application based on this detailed description of embodiments.

A configuration of second sole component 112 may vary in different embodiments. As shown in FIGS. 2 to 6, in some embodiments second sole component 112 may be generally planar. In some embodiments, upper surface 221 of second sole component 112 may have a substantially flat configuration. In some embodiments, upper surface 221 of second sole component 112 may have a curved contour, such as a generally cylindrical- or barrel-shaped surface having an axis of curvature that generally extends along a longitudinal direction of second sole component 112 (see, e.g., embodiments shown in FIGS. 11 to 20, discussed below). In such case, in some embodiments upper surface 221 may have a curved surface contour that is concave. Alternatively, in some embodiments upper surface 221 may have a curved surface contour that is convex. It will be appreciated that, in some embodiments, upper surface 221 may have a curved surface contour that corresponds to a curved surface contour of another sole component of sole structure 102, e.g., a curved surface contour of lower surface 242 of third sole component 114. It will be appreciated that, in some embodiments, a configuration having a curved surface contour may facilitate a rolling operation of lateral roll control structure of sole structure 102 (see, e.g., embodiments shown in FIGS. 11 to 20, discussed below). As shown in FIGS. 2 to 6, in some embodiments lower surface 223 of second sole component 112 may have a generally flat configuration.

Construction and manufacture of second sole component 112 may vary in different embodiments. As shown in FIG. 2, in some embodiments second sole component 112 may form an outer sole component having a lower surface 223 that may be exposed to a ground surface during active use of article of footwear 100. On the one hand, because sole structure 102 may operate to attenuate impact and other ground reaction forces and absorb energy, e.g., as sole structure 102 engages a ground surface during active use, in some embodiments (e.g., where optional third sole component 114 is not present in sole structure 102), second sole component 112 may be made of a foam material that has an open or closed cell foam material construction, e.g., a polymer foam material, such as polyurethane or ethylvinylacetate. In such case, in some embodiments second sole component 112 may be made by any manufacturing method suitable for making a foam material component. For example, in some embodiments second sole component 112 may be made by the injection molding of a polymer foam material. On the other hand, because sole structure 102 may operate to engage a ground surface and impart traction to article of footwear 100, in some embodiments second sole component 112 may be made of a durable, wear-resistant material. For example, in some embodiments second sole component 112 may be made of a rubber material. In such case, second sole component 112 may be made by any manufacturing method suitable for making a rubber material component. For example, in some embodiments second sole component 112 may be made by hot press molding a rubber material. Those skilled in the art will appreciate alternative and additional materials and methods of making second sole component 112 suitable for a desired application based on this detailed description of embodiments.

In some embodiments, second sole component 112 may include at least one traction element configured to engage a ground surface and impart traction. For example, in some embodiments second sole component 112 may include a dimpled, ribbed, or ridged surface. In some embodiments, at least one traction element may be integrally formed as a single piece with second sole component 112, e.g., in a molding process. In some embodiments, second sole component 112 may include a plurality of fixed or removable traction elements, such as studs or cleats, e.g., arranged in a pattern on lower surface 223 of second sole component 112. Those skilled in the art will appreciate alternative and additional ground traction elements suitable for a desired application.

A configuration of first sole component 110 may vary in different embodiments. As shown in FIGS. 2 to 6, in some embodiments first sole component 110 may be generally planar. In some embodiments, upper surface 211 and/or lower surface 212 of first sole component 110 may have a generally flat configuration. In some embodiments, at least one of upper surface 211 and lower surface 212 may have a non-planar surface. For example, in some embodiments upper surface 211 may have a first curved surface contour and lower surface 212 may have a second curved surface contour. In some embodiments, a first curved surface contour of upper surface 211 and a second curved surface contour of lower surface 212 may be the same or substantially similar. For example, in some embodiments first sole component 110 may be disposed between a second sole component 112 with an upper surface 221 having a first curved surface contour (e.g., a generally cylindrically- or barrel-shaped surface contour) and a third sole component 114 with a lower surface 242 having a second curved surface contour that substantially corresponds to or mates with the first curved surface contour. In this manner, in some embodiments first sole component 110 may form a layer having a curved configuration. In such case, in some embodiments first sole component 110 may have a generally constant thickness over at least substantially an entirety of first sole component 110 (see, e.g., embodiments shown in FIGS. 11 to 20, discussed below). In some embodiments, a thickness of first sole component 110 may vary.

First sole component 110 generally includes a slit 250 that forms lateral roll control structure for sole structure 102 and article of footwear 100. A configuration of slit 250 and associated lateral roll control structure may vary in different embodiments.

The location and general configuration of slit 250 formed in first sole component 110, and associated lateral roll control structure of sole structure 102, may vary in different embodiments. As shown in FIG. 2, slit 250 generally may be formed in a central or interior region of first sole component 110. As shown in FIG. 2, slit 250 generally extends from upper surface 211 to lower surface 212 of first sole component 110 and progresses in a longitudinal direction of first sole component 110. Slit 250 may be located in one or more regions of first sole component 110. Slit 250 may be located in (or extend through at least a portion of) at least one of toe region 103, forefoot region 104, midfoot region 105, and heel region 106. For example, as shown in FIG. 2, in some embodiments slit 250 generally may be a continuous slit that is located in and extends through toe region 103, forefoot region 104, midfoot region 105, and heel region 106. As shown in FIG. 2, slit 250 may have a continuous generally repeating configuration that alternates about a central line 249. In some embodiments, central line 249 of slit 250 may be an axis or axis line. Generally, as shown in FIG. 2, slit 250 may alternately extend in a generally lateral direction (from medial side 107 to lateral side 108 of first sole component 110) and in a generally medial direction (from lateral side 108 to medial side 107 of first sole component 110) as it progresses in a longitudinal direction of first sole component 110. In this manner, slit 250 generally may form and define a plurality of alternating laterally extending portions and medially extending portions of first sole component 110. For example, as shown in FIG. 2, in some embodiments slit 250 may have a generally serpentine configuration that progresses or extends in a longitudinal direction of first sole component 110 and forms repeating generally parabolic-shaped portions on alternating medial side 107 and lateral side 108 of central line 249 and extending in medial and lateral directions of first sole component 110.

Slit 250 may start and/or terminate at different lateral locations of first sole component 110 in different embodiments. For example, slit 250 may start and/or terminate at different locations relative to central line 249 in different embodiments. As shown in FIG. 2, in some embodiments slit 250 may start and/or terminate at or proximate central line 249 (see, e.g., terminal end 247 in heel region 106). As generally shown in FIG. 2, in some embodiments slit 250 may start and/or terminate at or proximate either medial side 107 or lateral side 108 of first sole component 110 (see, e.g., terminal end 248 located at or proximate lateral side 108 in toe region 103/forefoot region 104). It will be appreciated that the location of a terminal end of slit 250 may effect a flex characteristic of the immediately adjacent (terminal) medially- or laterally-extending portion of first sole component 110. Those skilled in the art will be able to select a location of respective terminal ends of slit 250, e.g., relative to central line 249, relative to medial side 107, or relative to lateral side 108, suitable for providing a desired configuration and flex characteristic of the adjacent terminal medially extending portion or terminal laterally extending portion, and for achieving a desired lateral roll control characteristic, based on this detailed description of embodiments.

The configuration of the medially extending portions and laterally extending portions may vary in different embodiments. Generally, each laterally extending portion extends from medial side 107 of first sole component 110 to lateral side 108 of sole component 110, and each medially extending portion extends from lateral side 108 of first sole component 110 to medial side 107 of first sole component 110. For example, as shown in FIG. 2, in some embodiments slit 250 may form and define in forefoot region 104 at least a first laterally extending portion 251, a second laterally extending portion 253, a third laterally extending portion 255, a fourth laterally extending portion 257, a fifth laterally extending portion 259, a first medially extending portion 252, a second medially extending portion 254, a third medially extending portion 256, a fourth medially extending portion 258, and a fifth medially extending portion 260, that are arranged in alternating order in a longitudinal direction in forefoot region 104 of first sole component 110. FIG. 2 illustrates additional laterally extending portions and medially extending portions located in midfoot region 105 and heel region 106 that are not labelled. Since these additional medially extending portions and laterally extending portions are substantially similar in configuration to the labelled portions, portions of this detailed description will be limited to the labelled/identified portions located in forefoot region 104. It will be appreciated that each laterally extending portion is continuous (attached as a single piece) at a peripheral body portion of first sole component 110 at medial side 107 of first sole component 110, and each medially extending portion is continuous (attached as a single piece) at the peripheral body portion of first sole component 110 at lateral side 108 of first sole component 110. It also will be appreciated that each laterally extending portion has a distal end located at lateral side 108 of first sole component 110 that is discontinuous, that is, the distal end is not attached to the peripheral body portion of first sole component 110 at lateral side 108 of first sole component 110, and each medially extending portion has a distal end located at medial side 107 of first component 110 that is discontinuous, that is, the distal end is not attached to the peripheral body portion of first sole component 110 at medial side 107 of first sole component 110. As shown in FIG. 2, in some embodiments a first lateral attachment portion 261 is located at a distal end of first laterally extending portion 251, a second lateral attachment portion 263 is located at a distal end of second laterally extended portion 253, a third lateral attachment portion 265 is located at a distal end of third laterally extending portion 255, a fourth lateral attachment portion 267 is located at a distal end of fourth laterally extending portion 257, and a fifth lateral attachment portion 269 is located at a distal end of fifth laterally extending portion 259. Likewise, as shown in FIG. 2, in some embodiments a first medial attachment portion 262 is located at a distal end of first medially extending portion 252, a second medial attachment portion 264 is located at a distal end of second medially extended portion 254, a third medial attachment portion 266 is located at a distal end of third medially extending portion 256, a fourth medial attachment portion 268 is located at a distal end of fourth medially extending portion 258, and a fifth medial attachment portion 270 is located at a distal end of fifth medially extending portion 260.

The configuration of the distal ends of the plurality of laterally extending portions and medially extending portions may vary in different embodiments. Generally, each distal end of the plurality of laterally extending portions and medially extending portions has a respective attachment portion configured for attaching first sole component 110 to an opposing surface of an adjacent component of sole structure 102 (or to upper 101 in an embodiment not including optional third sole component 114). For example, as shown in FIG. 2, in some embodiments attachment portions of medially extending portions and laterally extending portions of first sole component 110 may be configured for attaching first sole component 110 to lower surface 242 of third sole component 114. An enlarged schematic partial view of fifth lateral attachment portion 269 located at the distal end of fifth laterally extending portion 259 is shown in FIG. 2. As shown in FIG. 2, in some embodiments a pad of adhesive material (illustrated by stipple shading in the enlarged partial view) 271 may be provided at fifth lateral attachment portion 269 on upper surface 211 of first sole component 110 and configured for attaching fifth lateral attachment portion 269 to lower surface 242 of third sole component 114. Pad of adhesive material 271 may have any configuration suitable for a configuration of fifth lateral attachment portion 269. For example, as shown in FIG. 2, in some embodiments pad of adhesive material 271 may have a configuration in plan view that is consistent with the configuration of the distal end of fifth laterally extending portion 259 (i.e., pad of adhesive material 271 may be generally triangular or parabolic shape in plan view). FIG. 2 illustrates in phantom lines on third sole component 114 an outline of a location of slit 250 and the associated plurality of laterally extending portions and medially extending portions (including respective lateral attachment portions and medial attachment portions and respective pads of adhesive material) of first sole component 110 in an assembled state of sole structure 102. Those skilled in the art will appreciate that an area of each attachment portion and/or area of each pad of adhesive material (e.g., pad of adhesive material 271) may be selected so that a total amount of adhesive material collectively provided at the attachment portions is sufficient to securely attach first sole component 110 to lower surface 242 of third sole component 114 during use of article of footwear 100. FIG. 2 also illustrates, in phantom lines on second sole component 112, an outline of a location of slit 250 and the plurality of laterally extending portions and medially extending portions of first sole component 110 in an assembled state of sole structure 102. As shown in FIG. 2, in some embodiments only a peripheral portion 222 of upper surface 221 of second sole component 112 (show in stipple shading) may be attached to a corresponding peripheral portion of lower surface 212 of first sole component 110, so that the plurality of laterally extending portions and medially extending portions of first sole component 110 are not attached to second sole component 112. It will be appreciated that, by attaching only selected portions of first sole component 110 to second sole component 112 and third sole component 114, slit 250 and the associated plurality of laterally extending portions and medially extending portions may provide lateral roll control structure for sole structure 102 and article of footwear 100.

Construction and manufacture of first sole component 110 may vary in different embodiments. On the one hand, because sole structure 102 may operate to attenuate impact and other ground reaction forces and absorb energy, e.g., as sole structure 102 contacts a ground surface during active use, in some embodiments first sole component 110 may be made of a foam material that has an open or closed cell foam material construction, e.g., a polymer foam material, such as polyurethane or ethylvinylacetate. In such case, in some embodiments first sole component 110 may be made by any manufacturing method suitable for making a foam material component. For example, in some embodiments first sole component 110 may be made by the injection molding of a polymer foam material. On the other hand, because sole structure 102 may operate to engage a ground surface and impart traction to article of footwear 100, in some embodiments (e.g., in embodiments were optional second sole component 112 is not present in sole structure 102), first sole component 110 may be made of a durable, wear-resistant material. For example, in some embodiments first sole component 110 may be made of a rubber material. In such case, first sole component 110 may be made by any manufacturing method suitable for making a rubber material component. For example, in some embodiments first sole component 110 may be made by hot press molding a rubber material. Those skilled in the art will appreciate alternative and additional materials and methods of making first sole component 110 suitable for a desired application based on this detailed description of embodiments.

Dimensional features of first sole component 110 may vary in different embodiments. Dimensional features of first sole component 110 may vary depending on a number of factors including, but not limited to, respective materials of first sole component 110, second sole component 112, and third sole component 114, respective configurations of first sole component 110, second sole component 112, and third sole component 114, and a desired lateral roll control characteristic of first sole component 110 (e.g., a rigidity or flexibility characteristic of the plurality of medially extending portions and laterally extending portions). It will be appreciated that, as shown in FIG. 2, in some embodiments a general configuration of each laterally extending portion and associated attachment portion may be substantially the same as each medially extending portion and associated attachment portion, but arranged or oriented in an opposite direction. Accordingly, only a description of dimensional features relating to second laterally extending portion 253 with second lateral attachment portion 263 and second medially extending portion 254 with second medial attachment portion 264 will be provided in portions of this detailed description of embodiments. Those skilled in the art will appreciate various alternative and additional dimensional features for medially extending portions and laterally extending portions of sole structure 102 based on this detailed description of embodiments.

FIGS. 3 and 4 schematically illustrate dimensional features of sole structure 102. FIGS. 3 and 4 are schematic cross-sectional views of an embodiment of an assembled article of footwear 100 taken along section plane lines 3-3 in FIG. 2, where FIG. 3 schematically illustrates sole structure 102 in a typical assembled state and FIG. 4 schematically illustrates sole structure 102 in a partially exploded state for purposes of illustrating certain features of sole structure 102. As shown in FIG. 3, in some embodiments first sole component 110 may have a thickness 302, second sole component 112 may have a thickness 303, and third sole component 114 may have a thickness 304.

Thickness 304 of third sole component 114 may vary in different embodiments. Thickness 304 of third sole component 114 may vary based on a number of factors including, but not limited to, the material and intended use of third sole component 114. For example, in some embodiments third sole component 114 may be a midsole component formed of a foam material configured to provide cushioning for sole structure 102. Accordingly, the thickness of third sole component 114 may vary based on an anticipated weight of the user, a desired amount of cushioning, and a cushioning characteristic of the material of third sole component 114.

Thickness 303 of second sole component 112 may vary in different embodiments. Thickness 303 of second sole component 112 may vary based on different factors including, but not limited to, the material and intended use of second sole component 112. For example, in some embodiments second sole component 112 may be an outer sole component formed of a foam material configured to provide cushioning for sole structure 102. Accordingly, thickness 303 of second sole component 112 may be selected based on an anticipated weight of the user, a desired amount of cushioning, and a cushioning characteristic of the material of second sole component 112. On the other hand, in some embodiments second sole component 112 may be an outer sole component formed of a wear-resistant rubber material. Accordingly, thickness 303 of second sole component may be selected to provide a desired wear characteristic for sole structure 102. In some embodiments, second sole component 112 may have a composite structure, e.g. a layered structure that provides multiple characteristics (e.g., an upper layer formed of foam material and a lower layer formed of a wear-resistant rubber material).

The configuration and construction of first sole component 110 may vary in different embodiments. A general configuration of first sole component 110, including thickness and overall length and width dimensions, may vary in different embodiments. A configuration of lateral roll control structure of first sole component 110, including slit 250 and associated medially extending portions and laterally extending portions of first sole component 110, may vary in different embodiments.

Thickness 302 of first sole component 110 may vary in different embodiments. Thickness 302 of first sole component 110 may vary based on a number of factors including, but not limited to, the material and intended use of first sole component 110. Generally, first sole component 110 may be formed of any material that provides a desired lateral roll control characteristic to sole structure 102. For example, a lateral roll control characteristic may include a desired rigidity or flex characteristic of medially extending portions and laterally extending portions of first sole component 110. A lateral roll control characteristic may include a desired modulus of elasticity characteristic (e.g., a compression or stretching characteristic) in a lateral direction of first sole component 110. In some embodiments (e.g., where third sole component 114 is a midsole component formed of foam material and second sole component 112 is an outsole formed of foam material and/or a wear-resistant rubber material), first sole component 110 may be formed of a plastic or other material that has a desired rigidity or flex characteristic that facilitates a desired lateral roll control characteristic of sole structure 102. In some embodiments, first sole component 110 may be formed of a material that has a desired modulus of elasticity characteristic (compression or stretching characteristic) in a lateral direction of first sole component 110.

Other dimensional features of first sole component 110 may vary in different embodiments. As shown in FIG. 3, in some embodiments a peripheral base portion 310 of first sole component 110 at section plane lines 3-3 may have a width 311 at lateral side 108 and a width 312 at medial side 107, and second laterally extending portion 253 may have a width 313, i.e., a lateral distance generally measured between a distal end face 314 of second laterally extending portion 253 and a distal end face 315 (shown by phantom line in FIG. 3; see also FIG. 4) of second medially extending portion by 254. It will be appreciated that, in some embodiments second medially extending portion 254 may have a lateral width substantially equal to width 313 (see FIG. 4). As shown in FIG. 3, in some embodiments slit 250 may form a gap 320 having a width 321 measured between distal end face 314 of second laterally extending portion 253 and end face 322 of peripheral base portion 310 on lateral side 108. Similarly, slit 250 may form a gap 324 having a width 325 measured between distal end face 315 of second medially extending portion 254 (see also FIG. 4) and an end face 326 (shown in phantom lines; see also FIG. 4) of peripheral base portion 310 at medial side 107. As shown in FIGS. 3 and 4, in some embodiments slit 250 at either gap 320 and/or gap 324 may have a nominal width or tolerance fit configuration. As shown in FIG. 3, in some embodiments width 311 and width 312 at section plane lines 3-3 may be substantially the same. For example, in some embodiments slit 250 may have a width (gap) that is substantially constant throughout its entire length, e.g., corresponding to a width of a cutting tool used to cut or form slit 250 in first sole component 110. In some embodiments, slit 250 may have a width that varies at different locations along its length. For example, width 311 and width 312 at section plane lines 3-3 may be different. As shown in FIG. 4, second lateral attachment portion 263 of second laterally extending portion 253, attached to lower surface 242 of third sole component 114, e.g., by a pad of adhesive material 340 (shown with stipple shading), has a width 401. Similarly, second medial attachment portion 264 of second medially extending portion 254 (hidden in FIG. 3; see also FIG. 4), attached to lower surface 242 of third sole component 114, e.g., by a pad of adhesive material 341 (shown with stipple shading), has a width 402. As shown in FIG. 4, in some embodiments an unattached portion of second laterally extending portion 253 may have a width 403 in the medial-lateral direction of first sole component 110. Similarly, as shown in FIG. 4, in some embodiments an unattached portion of second medially extending portion 254 may have a width 404. As shown in FIG. 4, in some embodiments width 404 may be substantially equal to width 403. It also will be appreciated that, because an overall width of sole structure 102 may vary along a longitudinal direction of sole structure 102, in some embodiments a width of peripheral base portion 310 at medial side 107 and a corresponding width of peripheral base portion 310 at lateral side 108 of first sole component 110 may vary at different points along a longitudinal direction of sole structure 102. Alternatively, it will be appreciated that, in some embodiments (e.g., where a peripheral dimension of peripheral base portion 310 is substantially constant around a peripheral portion of sole component 110), a width of unattached portions of medially extending portions and laterally extending portions of first sole component 110 may vary at different points along a longitudinal direction of first sole component 110. Those skilled in the art will be able to select a desired width of peripheral base portion 310 at medial side 107 (see, e.g., width 312 in FIG. 3), a desired width of peripheral base portion 310 at lateral side 108 (see, e.g., width 311 in FIG. 3), and respective widths of unattached portions of medially extending portions and laterally extending portions of first sole component 110 at each location along a longitudinal direction of first sole component 110 suitable for providing a desired lateral roll control characteristic in a desired application in view of this detailed description of embodiments.

Operational Features of Lateral Roll Control Structure

Lateral roll control structure of sole structure 102, including slit 250 and associated medially extending portions and laterally extending portions of first sole component 110, may provide controlled separation of medial and lateral portions of sole components of sole structure 102, thus providing a relative rolling movement of upper 101 of article of footwear 100 in a medial direction and in a lateral direction of article of footwear 100, e.g., in response to ground reaction forces applied to article of footwear 100 during active use. FIG. 5 is a schematic cross-sectional view of an embodiment of sole structure 102 and article of footwear 100 of FIG. 3, illustrating lateral roll control structure of sole structure 102 rolling in a lateral direction of sole structure 102 (indicated by arrow 510). FIG. 6 is a schematic cross-sectional view of sole structure 102 and article of footwear 100 of FIG. 3, illustrating lateral roll control structure of sole structure 102 rolling in a medial direction of sole structure 102 (indicated by arrow 610). FIG. 7 is a schematic partial side perspective view of sole structure 102 of FIGS. 2 and 5, as viewed in a direction of arrow 507 in FIG. 5, from medial side 107 of sole structure 102, illustrating features of lateral roll control structure rolling in a lateral direction of sole structure 102. And FIG. 8 is a schematic partial side perspective view of sole structure 102 of FIG. 7, illustrating certain visible and hidden features of the lateral roll control structure rolling in a lateral direction of sole structure 102.

A relative configuration of components of sole structure 102 may vary in operation of sole structure 102 and article of footwear 100 to accommodate a transverse grade of a ground surface. For example, a relative configuration of components of sole structure 102 may vary in response to ground reaction forces applied in a state where article of footwear 100 is engaged with a ground surface having a grade that is transverse to a longitudinal direction of article of footwear 100, i.e., at an angle in a lateral direction of article of footwear 100, such as while standing on a beach or hillside, or while walking or running on a beach or hillside. FIGS. 3 to 8 illustrate lateral roll control structure of sole component 102 and article of footwear 100 in various states relative to a ground surface having a transverse grade.

FIG. 3 schematically illustrates in cross-section a state in which article of footwear 100 may be engaged with a ground surface having a generally flat, horizontal grade. In this case, upper 101, third sole component 114, first sole component 110, and second sole component 112 are all disposed in a generally horizontal configuration and lateral roll control structure of first sole component 110 and sole structure 102 is not active. That is, in this state the medially and laterally extending portions of first sole component 110 are not flexed.

FIG. 5 schematically illustrates in cross-section a state in which article of footwear 100 is engaged with a ground surface 501 having a grade that is transverse to a longitudinal direction of article of footwear 100, i.e., sloping downward in a direction of medial side 107. In this state, upper 101 and third sole component 114 may be disposed in a generally horizontal orientation, second sole component 112 may be disposed at an angle generally corresponding to a grade of ground surface 501 that slopes downward in a direction of medial side 107, and first sole component 110, including slit 250 and associated medially extending portions and laterally extending portions, may selectively flex to securely and stably affix second sole component 112 to third sole component 114 in this configuration. For example, as shown in FIG. 5, second laterally extending portion 253 extends from peripheral base portion 310 at medial side 107, which is attached to a peripheral portion of second sole component 112, and second lateral attachment portion 263 of second laterally extending portion 253 is attached to third sole component 114 at lateral side 108 of sole structure 102 by pad of adhesive material 340. Similarly, as shown in FIG. 5, second medially extending portion 254 extends from peripheral base portion 310 at lateral side 108, which is attached to a peripheral portion of second sole component 112, and second medial attachment portion 264 of second medially extending portion 254 is attached to third sole component 114 at medial side 107 of sole structure 102 by pad of adhesive material 341. As shown in FIG. 5, in this state second medially extending portion 254 and second laterally extending portion 253 may selectively flex to allow third sole component 114 to separate from first sole component 110 and second sole component 112 by an amount represented as distance 502 at medial side 107, while maintaining third sole component 114 substantially in contact with first sole component 110 (and second sole component 112) at lateral side 108.

FIG. 6 schematically illustrates in cross-section a state in which article of footwear 100 is engaged with ground surface 501 having a grade that is transverse to article of footwear 100 in the opposite direction, i.e., sloping downward in a direction of lateral side 108. In this state, upper 101 and third sole component 114 may be disposed in a generally horizontal orientation, second sole component 112 may be disposed at an angle generally corresponding to a grade of ground surface 501 that slopes downward in a direction of lateral side 108, and first sole component 110, including slit 250 and associated medially extending portions and laterally extending portions, may selectively flex to securely and stably affix second sole component 112 to third sole component 114 in this configuration. As shown in FIG. 6, in this state second laterally extending portion 253 and second medially extending portion 254 may flex to allow third sole component 114 to separate from first sole component 110 and second sole component 112 by an amount represented as angle 602 at lateral side 108, while maintaining third sole component 114 substantially in contact with first sole component 110 (and second sole component 112) at medial side 107.

It will be appreciated that each of FIGS. 3, 5, and 6 may represent article of footwear 100 in different states in different embodiments. For example, FIGS. 3, 5, and 6 may represent article of footwear 100 in a static state (e.g., while standing in a stationary position) or in a dynamic state (e.g., during a walking or running stride). It will be appreciated that, as shown in FIGS. 5 and 6, an amount of separation allowed or enabled by lateral roll control structure of sole structure 102 may be represented either by a distance (see, e.g., distance 502 in FIG. 5) or by and angle (see, e.g. angle 602 in FIG. 6). It will be appreciated that, in some embodiments, either distance 502 or angle 602 may represent a maximum separation enabled or allowed by the lateral roll control structure of sole component 102 in a rolling operation of the lateral roll control structure. On the other hand, in some embodiments, either distance 502 or angle 602 may represent only a partial amount of a maximum separation enabled or allowed by the lateral roll control structure of sole component 102 in a rolling operation of the lateral roll control structure. In each case, it will be appreciated that, in a flexed state (e.g., as shown in FIGS. 5 and 6), second medially extending portion 254 and/or second laterally extending portion 254 may be biased to return to a non-flexed state (e.g., as shown in FIG. 3) by a spring bias force that is generated in second medially extending portion 254 and/or second laterally extending portion 253, respectively. It also will be appreciated that an amount of the spring bias force may be determined by an amount of flex that is generated in second medially extended portion 254 and/or second laterally extending portion 253, e.g., by ground reaction forces associated with article of footwear 100 and sole structure 102 being disposed on a ground surface 501 having a transverse grade.

A torsional or twist stability of lateral roll control structure of first sole component 110 and sole structure 102, e.g., in a horizontal plane of sole structure 102, may vary in different embodiments. Generally, a configuration of slit 250 may provide a plurality of associated medially extending portions and laterally extending portions that progress in a longitudinal direction of sole structure 102, in alternating medial-lateral directions, and stabilize sole structure 102 along the longitudinal direction of sole structure 102. For example, as shown in FIGS. 2, 7, and 8, slit 250 may form first laterally extending portion 251, first medially extending portion 252, second laterally extending portion 253, second medially extending portion 254, third laterally extending portion 255, third medially extending portion 256, fourth laterally extending portion 257, fourth medially extending portion 258, fifth laterally extending portion 259, and fifth medially extending portion 260 in forefoot region 104 of first sole component 110. As shown in FIGS. 2, 7, and 8, respective attachment portions of the medially extending portions and laterally extending portions may be attached to lower surface 242 of third sole component 114 (hidden medially extending portions and respective attachment portions are schematically illustrated by dashed lines in FIG. 8). For example, as shown in FIG. 8, in some embodiments first medially extending portion 252 may be attached to lower surface 242 of third sole component 114 by a pad of adhesive material 710 at lateral side 108 (shown by dashed lines). It will be appreciated that, as shown in FIGS. 2, 7, and 8, a plurality of medially extending portions and laterally extending portions of first sole component 110 respectively affixed to medial side 107 and lateral side 108 of third sole component 114 may provide a secure, stable association of first sole component 110 and third sole component 114. It further will be appreciated that, in a state in which lateral roll control structure is in an open configuration (that is, where opposing portions of adjacent sole components are selectively separated on either medial side 107 or lateral side 108 to accommodate a transverse grade of ground surface 501), elements of the lateral roll control structure on the opposing lateral side 108 or medial side 107 may engage one another to help provide a stable relative longitudinal orientation and torsional flex characteristic of sole structure 102 and article of footwear 100. For example, when sole structure 102 is in a state shown in FIG. 5, distal end 314 of second lateral attachment portion 263 of second laterally extending portion 253 may be disposed in a corresponding recess of first sole component 110 defined by surface 322 of base portion 310 of first sole component 110 (see also, e.g., mating distal end 710 of first medially extending portion 252 and corresponding recess 712 at lateral side 108). This mating or interfitting of medially and laterally extending portions in corresponding, respective medially- and laterally-located recesses of base portion 310 may facilitate maintaining a rotational or torsional stability of sole structure 102 in a generally horizontal plane of sole structure 102.

An amount of separation or rolling motion of upper 101 of article of footwear 100 in a medial or lateral direction of sole structure 102 may vary. Generally, as shown in FIGS. 5 and 6, portions of sole components of sole structure 102 may separate in response to sole structure 102 and article of footwear 100 being engaged with a ground surface having a grade that is transverse to sole structure 102. For example, as shown in FIG. 5, lateral roll control structure of first sole component 110 may enable a medial side portion of first sole component 110 and third sole component 114 to separate from a corresponding medial side portion of second sole component 112 in response to sole structure 102 and article of footwear 100 being engaged with a ground surface 501 having a transverse grade that slopes downward in a direction of medial side 107. Similarly, as shown in FIG. 6, lateral roll control structure of first sole component 110 may enable a lateral side portion of first sole component 110 and third sole component 114 to separate from a corresponding lateral side portion of second sole component 112 in response to sole structure 102 and article of footwear 100 being engaged with a ground surface 501 having a transverse grade that slopes downward in a direction of lateral side 108. It will be appreciated that, in each case, this separation may allow lower surface 223 of second sole component 112 to remain in contact with ground surface 501 across a substantial portion or an entirety of the surface area of lower surface 223 while upper 101 remains in a generally horizontal orientation. In some cases, this may provide maximum traction with ground surface 501. It further will be appreciated that this separation may occur in a static state (e.g., while standing in a stationary position) or in a dynamic state, such as a rolling motion of article of footwear 100 as experienced during a typical walking or running stride on a beach or hillside. It further will be appreciated that, because the lateral roll control structure of first sole component 110 may vary an amount of separation (e.g., as represented by distance 502 between lower surface 242 of third sole component 114 and an upper surface 211 of first sole component 110 at medial side 107, or as represented by angle 602 of third sole component 114 and upper 101 relative to second sole component 112) to correspond with a transverse grade of ground surface 501, the lateral roll control structure of first sole component 110 may stably and securely support a foot disposed in upper 101 in a generally horizontal orientation over a ground surface having a transverse grade that changes.

A range of motion of lateral roll control structure of sole structure 102 may vary in different embodiments. As shown in FIGS. 5 and 6, lateral roll structure of first sole component 110 of sole structure 102 may enable or allow components of sole structure 102 to separate, e.g., by an amount or distance (see, e.g., distance 502 at medial side 107 in FIG. 5) or by an angle (see, e.g., angle 602 at lateral side 108 of FIG. 6) in response to ground reaction forces acting on sole structure 102. The amount of separation or angle of separation at each of medial side 107 and/or lateral side 108 may vary depending on various factors, including but not limited to, a width of sole structure 102, a configuration of the lateral roll structure of first sole component 110 (e.g., a configuration of medially extending portions and laterally extending portions of first sole component 110), a material and/or construction of first sole component 110, and a grade of ground surface 501.

It will be appreciated that varying a configuration of medially extending portions and laterally extending portions of first sole component 110, including at least a lateral or longitudinal dimension, may vary a rigidity or flex characteristic of medially extending portions and laterally extending portions of first sole component 110. Generally, as a width of medially extending portions and laterally extending portions in a lateral direction of first sole component 110 increases (see, e.g., width 313 of second laterally extending portion 253 in FIG. 3, or width 403 of the unattached portion of second laterally extending portion 253 and width 404 of second medially extending portion 254 in FIG. 4), an overall rigidity or flex characteristic of the lateral roll control structure may decrease. For example, generally, as a width of medially extending portions and laterally extending portions in a lateral direction of first sole component 110 increases, a reaction spring bias force that tends to return medially extending portions and/or laterally extending portions to a non-flexed state (a state without separation between sole components of sole structure 102) may decrease. On the other hand, generally, as a width of medially extending portions and laterally extending portions (as measured in a longitudinal direction of first sole component 110) increases, a rigidity or flex characteristic of the lateral roll control structure may increase. That is, as a width of medially extending portions and laterally extending portions (as measured in a longitudinal direction of first sole component 110) increases, a reaction spring bias force that tends to return medially extending portions and/or laterally extending portions to a non-flexed state (a state without separation between sole components of sole structure 102) may increase.

It will be appreciated that varying a construction of medially extending portions and laterally extending portions of first sole component 110, including at least a thickness or material of first sole component 110, may vary a rigidity or flex characteristic of medially extending portions and laterally extending portions of first sole component 110. Generally, as a thickness of medially extending portions and laterally extending portions of first sole component 110 increases (see, e.g., thickness 302 of first sole component 110 in FIG. 3), a rigidity or flex characteristic may increase. That is, as a thickness of medially extending portions and laterally extending portions of first sole component 110 increases, a reaction spring bias force that tends to return medially extending portions and/or laterally extending portions to a non-flexed state (a state without separation between sole components of sole structure 102) may increase. Similarly, as a rigidity or stiffness of a material of medially extending portions and laterally extending portions of first sole component 110 increases (e.g., a rigidity of a metal or plastic may be greater than a rigidity of a foam material, such as a polymer foam material), a rigidity or flex characteristic of the lateral roll control structure of first sole component 110 may increase. That is, as a rigidity of a material of medially extending portions and laterally extending portions of first sole component 110 increases, a reaction spring bias force that tends to return medially extending portions and laterally extending portions to a non-flexed state (a state without separation between sole components of sole structure 102) may increase.

It will be appreciated that a varying grade of the ground surface may vary a range of motion of medially extending portions and laterally extending portions of first sole component 110. Generally, as a grade of ground surface 501 increases, ground reaction forces that tend to separate components of sole structure 102 may increase. It also will be appreciated that, in some cases a reaction spring bias force of the lateral roll control structure of first sole component 110 that tends to return the lateral roll control structure of first sole component 110 to a non-flexed state (FIG. 3) may become greater than a ground reaction force that tends to separate (or further separate) sole components of sole structure 102. In this case, it will be appreciated that lateral roll control structure of sole component 110 may maintain sole structure 102 in a non-flexed state (FIG. 3) or in a state of separation that maintains these two opposing forces in equilibrium. For example, in the latter case, either upper 101 may not be able to separate (or roll) fully to a generally horizontal configuration, or lower surface 223 of second sole component 112 may not be able to maintain contact with ground surface 501 over substantially an entirety of lower surface 223, or both. Nevertheless, the range of motion (separation) that is enabled by the flexing of the medially extending portions and/or laterally extending portions may provide an orientation of upper 101 and lower surface 223 of second sole component 112 that comfortably, securely, and safely supports a foot on the transverse grade of ground surface 501. For example, an angle 602 may be greater than zero degrees but less than the transverse grade or angle of inclination of ground surface 501, so that the foot is supported at an orientation that is close to, or at least closer to, a horizontal orientation.

Surface Layer or Treatment Modification Features

Figure 9:
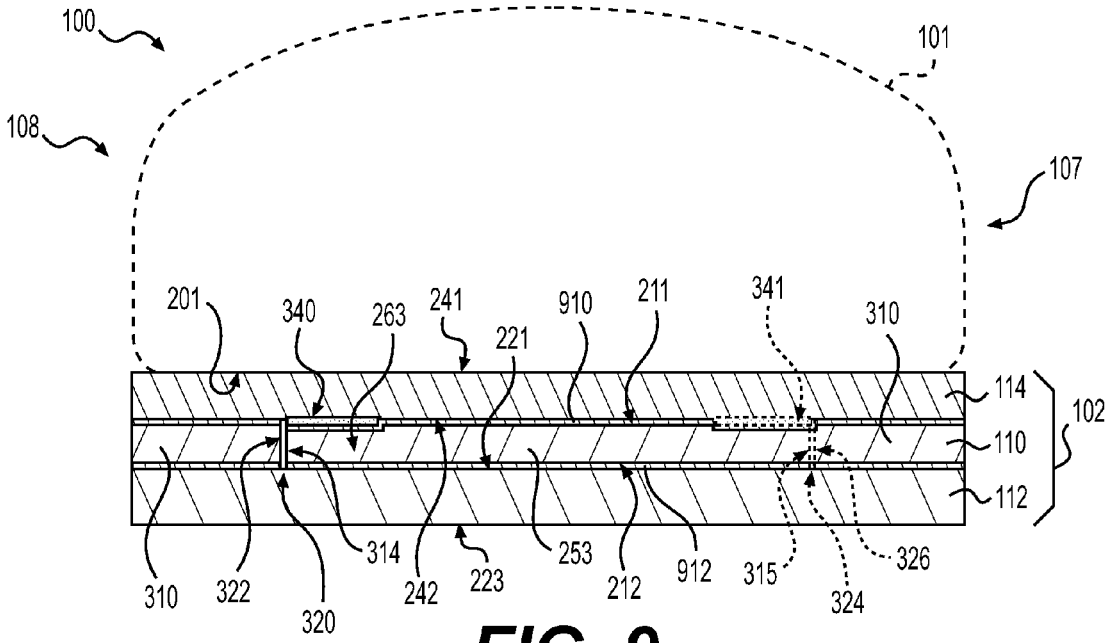
FIG. 9 is a schematic cross-sectional view of another embodiment of the article of footwear and sole structure of FIG. 2, taken along section plane lines 3-3 of FIG. 2.
Figure 10:
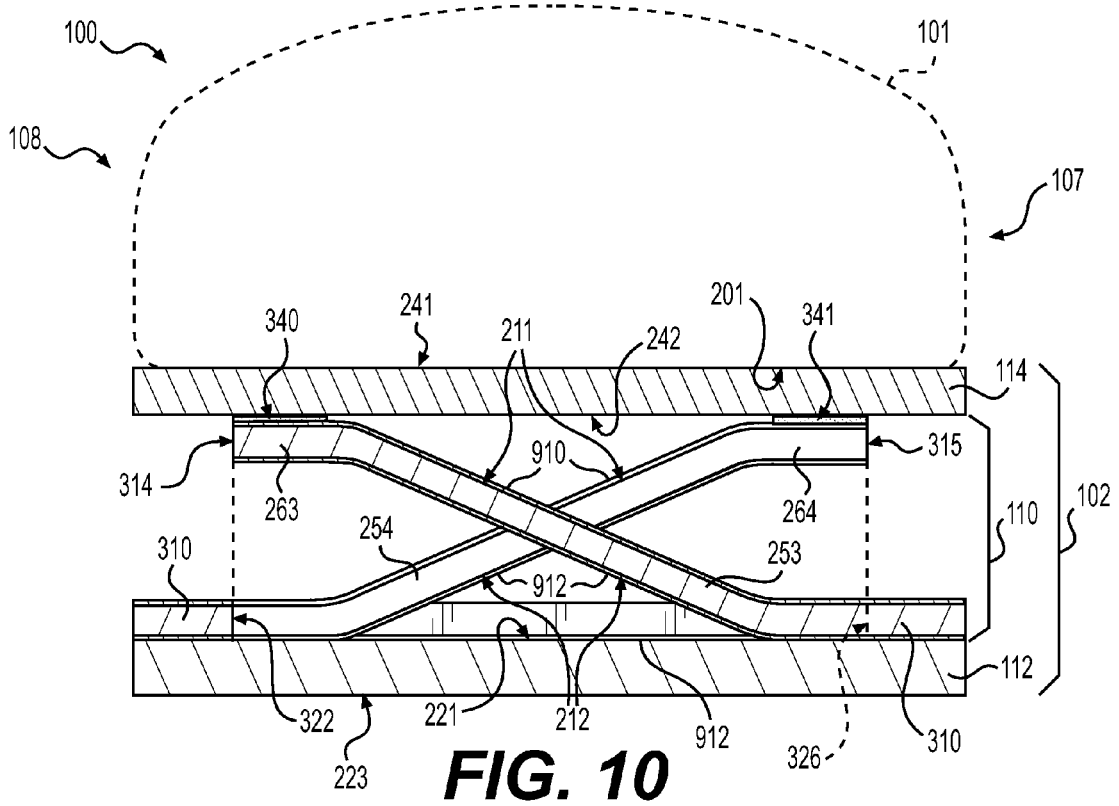
FIG. 10 is a schematic partially exploded cross-sectional view of an article of footwear and sole structure of FIGS. 2 and 9, taken along section plane lines 3-3 of FIG. 2, illustrating features of lateral roll control structure of the sole structure.

A construction of first sole component 110 may be modified to provide a desired lateral roll control characteristic. In some embodiments, first sole component 110 may have a body formed of a first material and a surface layer formed of a second material that is different than the first material and that provides a desired lateral roll control characteristic. Alternatively, a surface of first sole component 110 may have a surface treatment that provides first sole component 110 with a desired lateral roll control characteristic. FIG. 9 is a schematic cross-sectional view of another embodiment of article of footwear 100 and sole structure 102 of FIG. 2, taken along section plane lines 3-3 of FIG. 2, and FIG. 10 is a schematic partially exploded cross-sectional view of article of footwear 100 and sole structure 102 of FIGS. 2 and 9. As schematically illustrated in FIGS. 9 and 10, in some embodiments first sole component 110 may be provided with a surface layer (or surface treatment) 910 formed on upper surface 211 and/or a surface layer (or surface treatment) 912 formed on lower surface 212 of first sole component 110. In some embodiments, either surface layer 910 or surface layer 912 may be absent. It will be appreciated that surface layer 910 and/or surface layer 912 may be formed of a material providing first sole component 110 with a desired modified lateral roll control characteristic. For example, in some embodiments a body of first sole component 110 may be formed of a first material, such as a polymer foam material that is configured to provide cushioning and that has a first rigidity or flex characteristic, and surface layer 910 and/or surface layer 912 may be formed of (or may form) a second material that has a second rigidity or flex characteristic that modifies a lateral roll control characteristic of first sole component 110. For example, in some embodiments, surface layer 910 and/or surface layer 912 may be formed of (or may form) a material that has a greater rigidity or flex characteristic that increases a bias reaction force in a flexed lateral roll control structure. In some embodiments, surface layer 910 and/or surface layer 912 may be a rubber, plastic, metal, or other material that is affixed to the body of first sole component 110, e.g., by adhesion bonding. In some embodiments, surface layer 910 and/or surface layer 912 may be formed of (or may form) a second material selected to provide medially extending portions and laterally extending portions of first sole component 110 with a desired modulus of elasticity characteristic (e.g., compression and/or stretching characteristic) in a medial-lateral direction of sole component 110. It will be appreciated that, in some embodiments, an increased modulus of elasticity characteristic (compression and/or stretching characteristic) may improve a lateral stability or torsional rigidity of the lateral roll control structure and sole structure 102. In some embodiments (e.g., in embodiments in which optional second sole component 112 is not present in sole structure 102), a material of surface layer 912 may be selected to provide a wear-resistant characteristic to lower surface 212 of first sole component 110.

Embodiments of sole structure 102 and article of footwear 100 illustrated in FIGS. 9 and 10 otherwise may be substantially similar to embodiments of FIGS. 2 to 8 in configuration, construction, and operation. Those skilled in the art will be able to select a surface layer or surface treatment on upper surface 211 and/or lower surface 212 of first sole component 110 suitable for providing a desired lateral roll control characteristic and other characteristics for sole structure 102 and article of footwear 100 based on this detailed description of preferred embodiments.

Curved Surface Contour Features

Figure 11:
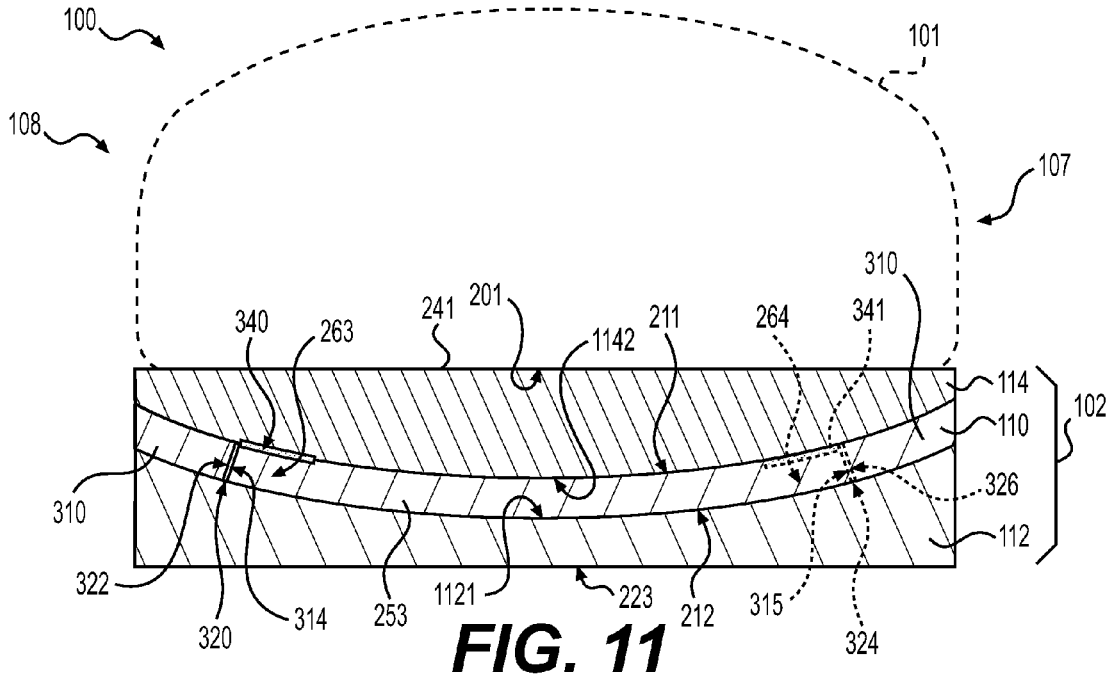
FIG. 11 is a schematic cross-sectional view of another embodiment of an article of footwear and sole structure of FIG. 2, taken along section plane lines 3-3 of FIG. 2, illustrating elements of lateral roll control structure of a sole structure having a curved configuration.
Figure 12:
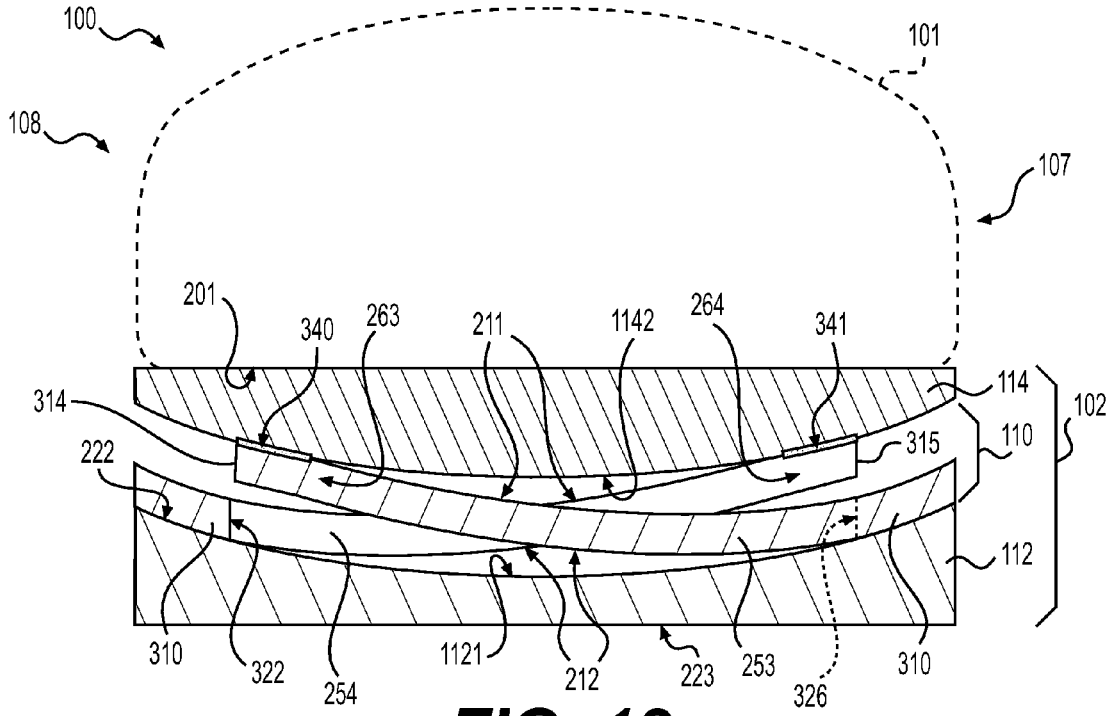
FIG. 12 is a schematic partially exploded cross-sectional view of an article of footwear and sole structure of FIGS. 2 and 11, taken along section plane lines of 3-3 of FIG. 2, illustrating features of lateral roll control structure of the sole structure.

A surface contour of one or more components of sole structure 102 may be modified to provide lateral roll control structure having a desired lateral roll control characteristic. In some embodiments, at least one of second sole component 112 and third sole component 114 may have a surface with a curved or arched surface contour; and an opposing surface of first sole component 110 may conform to have a corresponding or mating surface contour at an interface with the curved surface contour of second sole component 112 and/or third sole component 114. For example, in some embodiments third sole component 114 may have a lower surface having a first curved surface contour and/or second sole component 112 may have an upper surface having a corresponding or mating second curved surface contour. FIG. 11 is a schematic cross-sectional view of an embodiment of article of footwear 100 and sole structure 102 of FIG. 2, taken along section plane lines 3-3 of FIG. 2, illustrating elements of lateral roll control structure of sole structure 102 having a curved surface contour configuration. And FIG. 12 is a schematic partially exploded cross-sectional view of article of footwear 100 and sole structure 102 of FIG. 11. As shown in FIGS. 11 and 12, in some embodiments third sole component 114 may be provided with a lower surface 1142 that has a convex curved surface contour, and second sole component 112 may be provided with an upper surface 1121 that has a concave curved surface contour. In some embodiments, lower surface 1142 and upper surface 1121 may be corresponding or mating surface contours. As shown in FIGS. 11 and 12, in some embodiments the convex curved surface contour of lower surface 1142 of third sole component 114 may be a generally cylindrical- or barrel-shaped surface contour having an axis that extends in a generally longitudinal direction of sole structure 102. In some embodiments, as shown in FIGS. 11 and 12, upper surface 1121 of second sole component 112 may have a corresponding or mating concave curved surface contour. In some embodiments, upper surface 1121 of second sole component 112 may have a concave curved surface contour that is different than the curved surface contour of third sole component 114, e.g., more shallow than the curved surface contour of third sole component 114. In some embodiments, upper surface 1121 of second sole component 112 may have a substantially flat upper surface contour (see, e.g., upper surface 221 of second sole component 112 in FIGS. 2 to 10). It will be appreciated that, in each of these embodiments having a curved surface contour configuration on lower surface 1142 of third sole component 114, at least medially extending portions and laterally extending portions of first sole component 110, disposed adjacent third sole component 114 between second sole component 112 and third sole component 114, may conform to the curved surface contour configuration of lower surface 1142 of third sole component 114. In some embodiments, e.g., where first sole component 110 is formed of a material having a relatively high flexibility characteristic, first sole component 110 may conform to the curved surface contour substantially by physical deformation. In some embodiments, e.g., where first sole component 110 is formed of a material having a relatively high rigidity characteristic, first sole component 110 may have a curved surface contour that conforms to the curved surface contour substantially by manufacture or preforming. Those skilled in the art will be able to select a configuration and construction of first sole component 110, second sole component 112, and third sole component 114 suitable for a desired sole structure having a curved surface contour configuration providing a desired lateral roll control characteristic based on this detailed description of embodiments.

Figure 13:
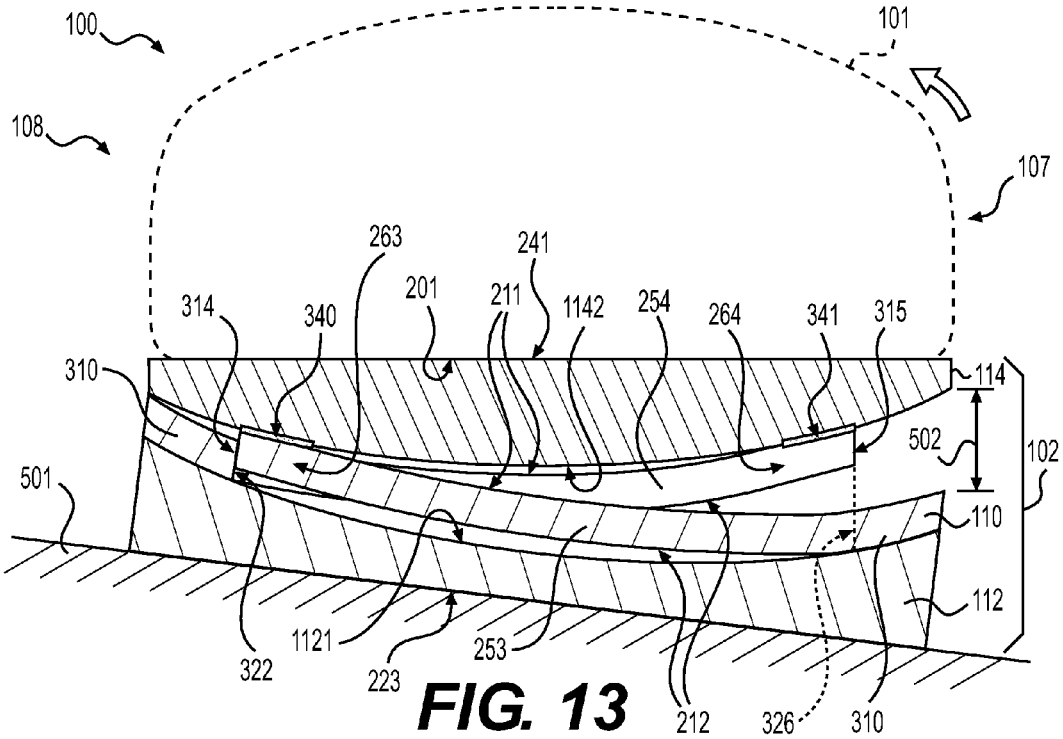
FIG. 13 is a schematic cross-sectional view of the article of footwear and sole structure of FIG. 12, illustrating lateral roll control structure of the sole structure rolling in a lateral direction.
Figure 14:
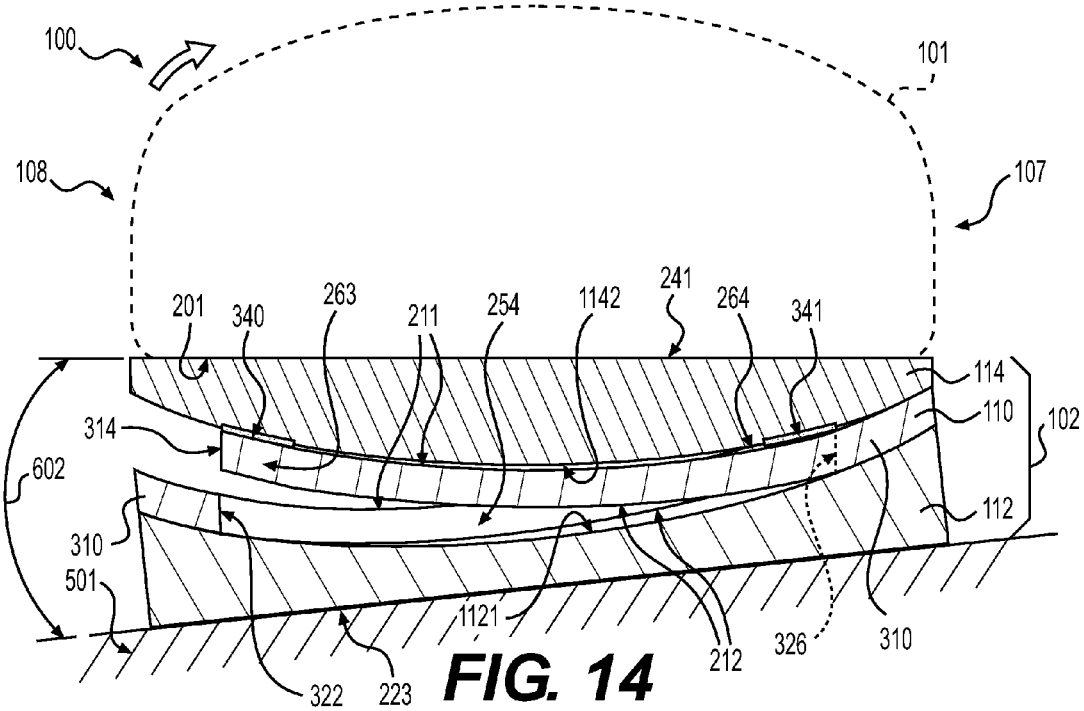
FIG. 14 is a schematic cross-sectional view of the article of footwear and sole structure of FIG. 12, illustrating lateral roll control structure of the sole structure rolling in a medial direction.

Operational features of a sole structure including lateral roll control structure that has a curved surface contour configuration may vary in different embodiments. Generally, operational features of a sole structure including lateral roll control structure that has a curved surface contour configuration may be substantially similar to operational features of a sole structure including a planar surface contour configuration (see, e.g., description of operational features of FIGS. 2 to 8 above). FIG. 13 is a schematic cross-sectional view of article of footwear 100 and sole structure 102 of FIG. 11, illustrating lateral roll control structure of sole structure 102 rolling in a lateral direction, and FIG. 14 is a schematic cross-sectional view of article of footwear 100 and sole structure 102 of FIG. 11, illustrating lateral roll control structure of sole structure 102 rolling in a medial direction. As shown in FIGS. 13 and 14, features and operation of components of sole structure 102 may be substantially similar to features and operation of components of sole structure 102 in FIGS. 5 and 6. It will be appreciated that, in some embodiments, the curved surface contour configuration of lateral roll control structure of sole structure 102 in FIGS. 13 and 14 may facilitate a smooth rolling movement between a flexed state of lateral roll control structure of sole structure 102 (e.g., as shown in FIG. 13 or FIG. 14) and a non-flexed state of lateral roll control structure of sole structure 102 (e.g., as shown in FIG. 11).

Closed Sole Structure Features

Articles of footwear including a sole structure having lateral roll control structure may have an open configuration or a closed configuration at peripheral edges of the sole structure in different embodiments. FIGS. 3 to 14 schematically illustrate embodiments of article of footwear 100 including sole structure 102 having an open configuration at peripheral edges of sole structure 102, that is, an open lateral roll control structure configuration. In a state where article of footwear 100 and sole structure 102 are engaged with a ground surface having a transverse grade, components of sole structure 102 may separate to expose portions of slit 250 and associated medially extending portions and laterally extending portions of first sole component 110 forming the lateral roll control structure of sole structure 102. FIGS. 15 to 20 schematically illustrate embodiments of article of footwear 100 including sole structure 102 having a closed configuration at peripheral edges of sole structure 102, that is, a closed lateral roll control structure configuration. In a state where article of footwear 100 and sole structure 102 are engaged with a ground surface having a transverse grade and components of sole structure 102 are separated at a peripheral edge of sole structure 102, slit 250 and associated medially extending portions and laterally extending portions of the lateral roll control structure of sole structure 102 remain covered, i.e., not exposed to the external environment. In some embodiments, sole structure 102 may include web structure that covers any gap formed by separation of components of sole structure 102 at medial side 107 and/or lateral side 108. It will be appreciated that such a configuration may provide a closed lateral roll control structure of sole structure 102 that may prevent entry of foreign matter, such as sand, dirt, water, or other foreign matter, into the lateral roll control structure of sole structure 102.

Figure 15:
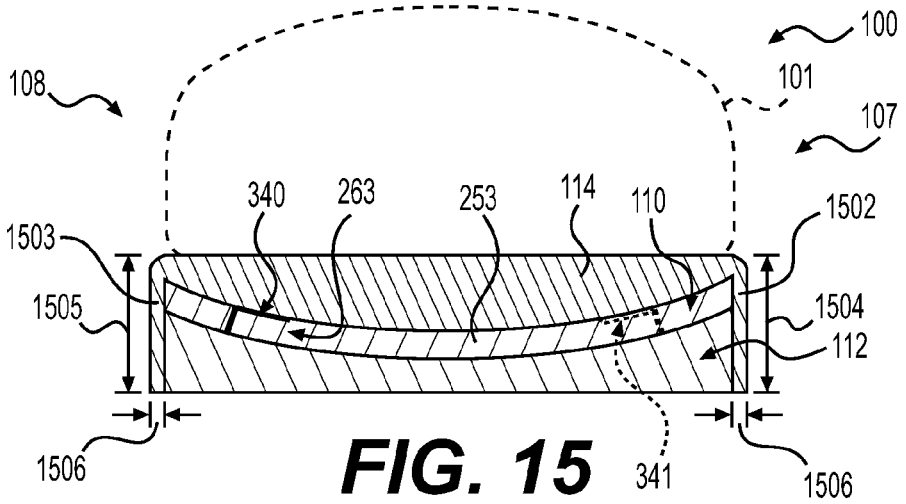
FIG. 15 is a schematic cross-sectional view of another embodiment of an article of footwear and sole structure of FIGS. 1 and 2, taken along section plane lines 3-3 of FIG. 2, illustrating lateral roll control structure of the sole structure and a peripheral cover for the lateral roll control structure.
Figure 16:
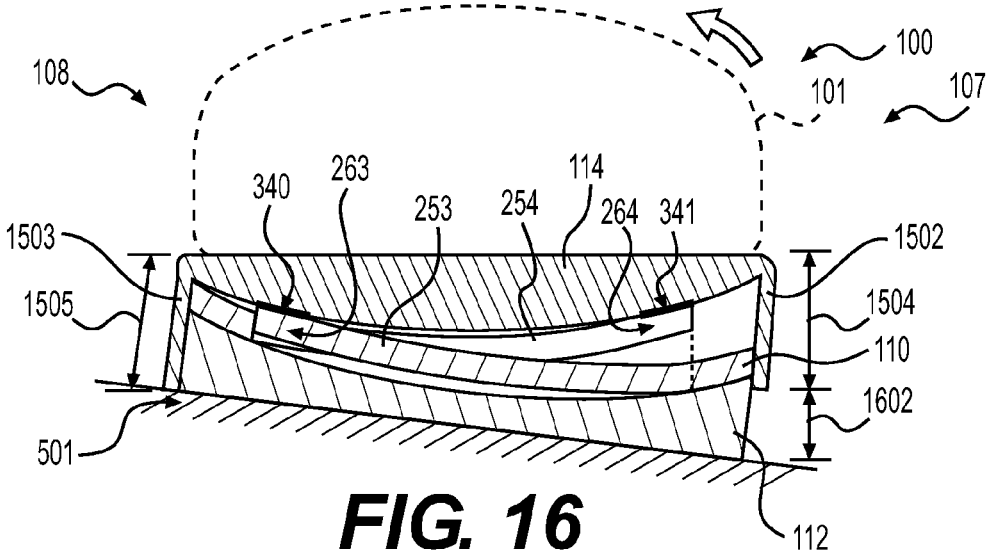
FIG. 16 is a schematic cross-sectional view of the article of footwear and sole structure of FIG. 15, illustrating lateral roll control structure of the sole structure rolling in a lateral direction of the sole structure.
Figure 17:
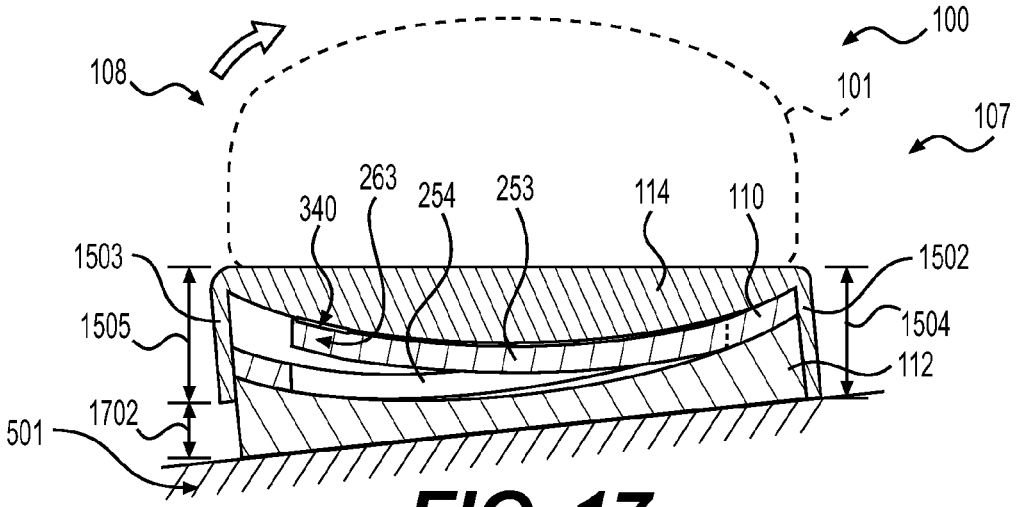
FIG. 17 is a schematic cross-sectional view of the article of footwear and sole structure of FIG. 15, illustrating lateral roll control structure of the sole structure rolling in a medial direction of the sole structure.

A configuration of web structure for covering a gap formed by separation of components of sole structure 102 at medial side 107 and/or lateral side 108 may vary in different embodiments. In some embodiments, sole structure 102 may include a web structure configured to cover a peripheral side edge portion of sole structure 102 by sliding physical contact. FIG. 15 is a schematic cross-sectional view of an embodiment of article of footwear 100 and sole structure 102 of FIGS. 2 and 11, taken along section plane lines 3-3 of FIG. 2, illustrating lateral roll control structure of sole structure 102 having a web structure that provides cover for the lateral roll control structure of sole structure 102 by sliding physical contact. FIG. 16 is a schematic cross-sectional view of article of footwear 100 and sole structure 102 of FIG. 15, illustrating lateral roll control structure of sole structure 102 rolling in a lateral direction of sole structure 102. And FIG. 17 is a schematic cross-sectional view of article of footwear 100 and sole structure 102 of FIG. 15, illustrating lateral roll control structure of sole structure 102 rolling in a medial direction of sole structure 102. As shown in FIGS. 15 to 17, in some embodiments sole structure 102 may include a web structure attached to at least a portion of third sole component 114. For example, as shown in FIGS. 15 to 17, in some embodiments sole structure 102 may include a web portion 1502 at medial side 107 and a web portion 1503 at lateral side 108 of third sole component 114. As shown in FIGS. 15 to 17, in some embodiments web portion 1502 generally may have a width 1506 and a length 1504 extending vertically downward along a peripheral edge of sole structure 102. As shown in FIG. 16, in a state in which sole structure 102 is engaged with a ground surface 501 having a transverse grade in a lateral direction of sole structure 102 and sloping in a direction of medial side 107, a free lower distal end of web portion 1502 may slide up and down a peripheral edge of second sole component 112 at medial side 107 for a distance 1602 and still maintain a closed configuration of lateral roll control structure of sole structure 102. Similarly, as shown in FIGS. 15 to 17, in some embodiments web portion 1503 generally may have a width 1506 and a length 1505 extending vertically downward along a peripheral edge of sole structure 102. As shown in FIG. 17, in a state in which sole structure 102 is engaged with a ground surface 501 having a transverse grade in a lateral direction of sole structure 102 and sloping in a direction of lateral side 108, a free lower distal end of web portion 1503 may slide up and down a peripheral edge of second sole component 112 at lateral side 108 and still maintain a closed configuration of lateral roll control structure of sole structure 102. It will be appreciated that, in some embodiments, sliding physical contact may be maintained between web portion 1502 and peripheral portions of first sole component 110 and second sole component 112 at lateral side 108 by configuring web portion 1502 with a spring bias in a direction of peripheral edge portions of sole structure 102 at medial side 107. Similarly, sliding physical contact may be maintained between web portion 1503 and peripheral edge portions of first sole component 110 and second sole component 112 at lateral side 108 by configuring web portion 1503 with a spring bias in a direction of peripheral edge portions of sole structure 102 at lateral side 108. In some embodiments web portion 1502 and web portion 1503 may be formed of a semi-rigid material, such as a rubber material, configured with a spring bias or flex characteristic in a direction of the peripheral edge portions of sole structure 102. As shown in FIGS. 15-17, in some embodiments web portion 1502 and web portion 1503 may be made as a single unitary piece with third sole component 114, e.g., by a molding process.

A vertical length of web portion 1502 and web portion 1503 may vary in different embodiments. Generally, a length of web portion 1502 and web portion 1503 may be sufficiently long to cover a separation gap between first sole component 110 and third sole component 114 in a state where article of footwear 100 and sole structure 102 are engaged with a ground surface 501 having a grade that is transverse to a lateral direction of sole structure 102 (see FIGS. 16 and 17) and lateral roll control structure of sole structure 102 is flexed to a maximum of its allowed range of motion. Those skilled in the art will be able to select a length 1504 of web portion 1502 and a length 1505 of web portion 1503 suitable for covering a maximum separation gap between components of sole structure 102 and maintaining the lateral roll control structure of sole structure 102 in a closed configuration for a desired application based on this detailed description of embodiments. It will be appreciated that, in some embodiments, web portion 1502 and web portion 1503 may be portions of a single web structure that covers an entire peripheral edge of sole structure 102.

Figure 18:
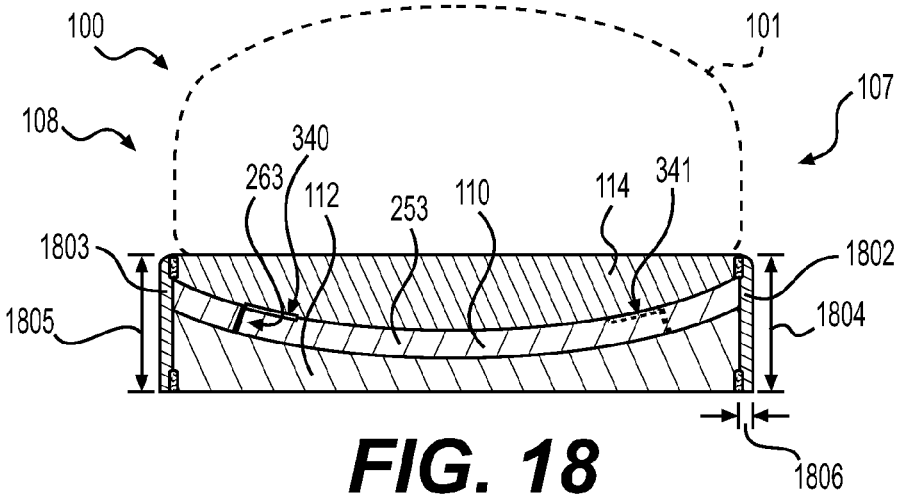
FIG. 18 is a schematic cross-sectional view of another embodiment of an article of footwear and sole structure of FIGS. 1 and 2, taken along section plane lines 3-3 of FIG. 2, illustrating lateral roll control structure of the sole structure and a peripheral cover for the lateral roll control structure.
Figure 19:
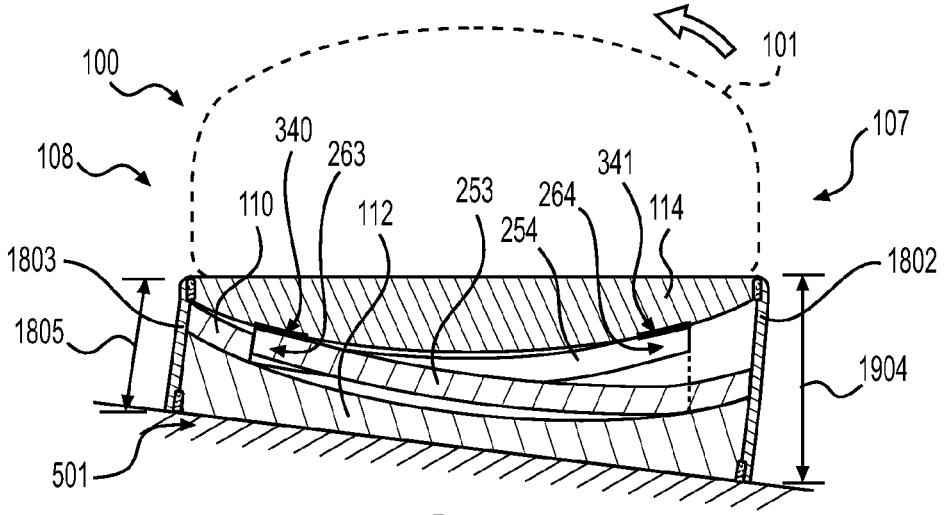
FIG. 19 is a schematic cross-sectional view of the article of footwear and sole structure of FIG. 18, illustrating lateral roll control structure of the sole structure rolling in a lateral direction of the sole structure.
Figure 20:
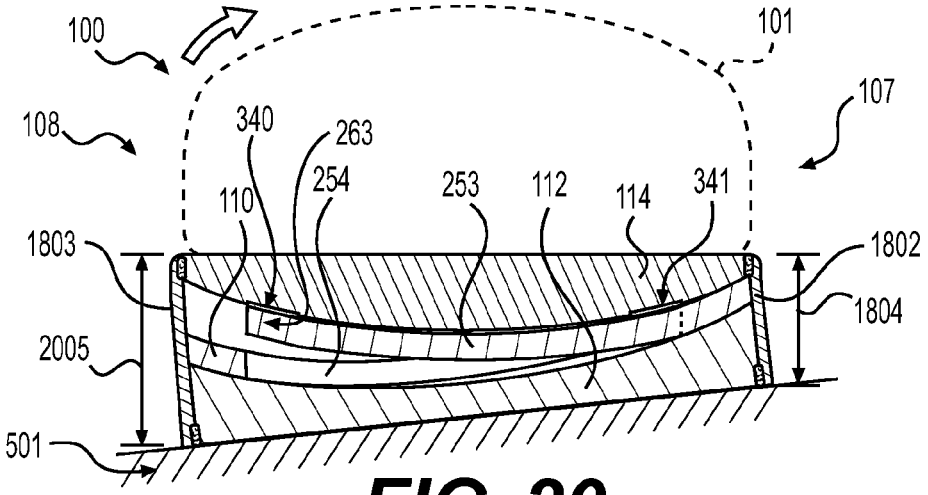
FIG. 20 is a schematic cross-sectional view of the article of footwear and sole structure of FIG. 18, illustrating lateral roll control structure of the sole structure rolling in a medial direction of the sole structure.

In some embodiments, sole structure 102 may include a web structure configured to cover a peripheral edge portion of sole structure 102 by stretching. FIG. 18 is a schematic cross-sectional view of an embodiment of article of footwear 100 and sole structure 102 of FIGS. 2 and 11, taken along section plane lines 3-3 of FIG. 2, illustrating lateral roll control structure of sole structure 102 that has a web structure providing cover for the lateral roll control structure of sole structure 102 by stretching. FIG. 19 is a schematic cross-sectional view of article of footwear 100 and sole structure 102 of FIG. 18, illustrating lateral roll control structure of sole structure 102 rolling in a lateral direction of sole structure 102. And FIG. 20 is a schematic cross-sectional view of article of footwear 100 and sole structure 102 of FIG. 18, illustrating lateral roll control structure of sole structure 102 rolling in a medial direction of sole structure 102. As shown in FIGS. 18 to 20, in some embodiments the web structure may include a web portion 1802 located at medial side 107 and a web portion 1803 located at lateral side 108. As shown in FIG. 18, an upper portion of web portion 1802 may be attached to a peripheral edge of third sole component 114 (e.g., by a seam line of adhesive material), a lower portion of web portion 1802 may be attached to a peripheral edge of second sole component 112 (e.g., by another seam line of adhesive material), and web portion 1802 may extend vertically for a length 1804 along a peripheral edge of sole structure 102 at medial side 107 in a state where lateral roll control structure of sole structure 102 is not flexed. Similarly, as shown in FIG. 18, an upper portion of web portion 1803 may be attached to a peripheral edge of third sole component 114 (e.g., by a seam line of adhesive material), a lower portion of web portion 1803 may be attached to a peripheral edge of second sole component 112 (e.g., by another seam line of adhesive material), and web portion 1803 may extend vertically for a length 1805 along a peripheral edge of sole structure 102 at lateral side 108 in a state where lateral roll control structure of sole structure 102 is not flexed. It will be appreciated that, in some embodiments, web portion 1802 and web portion 1803 may be formed of a single, unitary, one-piece material, e.g., a single continuous band of stretchable material that may extend around at least a portion of a peripheral edge of sole structure 102. For example, in some embodiments web portion 1802 and web portion 1803 may form medial and lateral portions of a single elastic web or band that covers a peripheral edge of sole structure 102 around toe region 103 and forefoot region 104. In some embodiments, web portion 1802 and web portion 1803 may form medial and lateral portions of a single elastic web or band that covers a peripheral edge of sole structure 102 around heel region 106 and mid-foot region 105. In some embodiments, web portion 1802 and web portion 1803 may form medial and lateral portions of a single elastic web or band that covers a peripheral edge of sole structure 102 around toe region 103, forefoot region 104, mid-foot region 105, and heel region 106.

Web portions 1802 and 1803 may stretch during active use of article of footwear 100 to maintain a closed configuration of the lateral roll control structure of sole structure 102. As shown in FIG. 19, in a state in which sole structure 102 is engaged with a ground surface 501 having a grade transverse in a lateral direction of sole structure 102 and sloping in a direction of medial side 107, web portion 1802 may stretch along a peripheral edge of second sole component 112 to a length 1904 at medial side 107 to maintain a closed configuration of the lateral roll control structure of sole structure 102. Similarly, as shown in FIG. 20, in a state in which sole structure 102 is engaged with a ground surface 501 having a grade transverse in a lateral direction of sole structure 102 and sloping in a direction of lateral side 108, web portion 1803 may stretch along a peripheral edge of second sole component 112 to a length 2005 at lateral side 108 to maintain a closed configuration of the lateral roll control structure of sole structure 102.

A length 1804 of web portion 1802 and a length 1805 of web portion 1803 may vary in different embodiments. As shown in FIG. 18, in some embodiments a length 1804 of web portion 1802 and a length 1805 of web portion 1803 may be selected to cover an entire peripheral edge portion of sole structure 102 in a non-flexed state of lateral roll control structure of sole structure 102. It will be appreciated that this configuration may be advantageous in certain embodiments in that a ratio of length 1804 in the non-flexed state to a length 1904 in a flexed state ((see, e.g., FIG. 19) (and similarly a ratio of length 1805 to a length 2005 in a flexed state; see, e.g., FIG. 20)) may be maximized, to minimize stress on web portion 1802 (and/or web portion 1803) in a flexed state. On the other hand, in some embodiments a length 1804 of web portion 1802 and a length 1805 of web portion 1803 may be selected generally to cover only a separation gap in a flexed state of FIG. 19 and/or FIG. 20, respectively. It will be appreciated that this configuration may be advantageous in certain embodiments in that it may minimize an amount of material of web portion 1802 and web portion 1803. It also will be appreciated that, in some embodiments, a maximum stretch length of web portion 1802 (e.g., length 1904 in FIG. 19) and a maximum stretch length of web portion 1803 (e.g., length 2005 in FIG. 20) may facilitate limiting a desired range of motion of lateral roll control structure of sole structure 102 (e.g., a maximum distance or angle of separation between sole components of sole structure 102; see, e.g., FIGS. 5 and 6). It will be appreciated that in some embodiments a single web portion may be configured to cover an entire peripheral edge of sole structure 102. Those skilled in the art will be able to select a configuration and construction, including materials and dimensional features for web structure suitable for covering a desired peripheral edge or portion of a peripheral edge of sole structure 102 based on this detailed description of embodiments.

Operational features of lateral roll control structure of sole structure 102 of embodiments illustrated in FIGS. 15 to 17 and embodiments illustrated in FIGS. 18 to 20 may vary in different embodiments. Generally, operational feature of lateral roll control structure of sole structures 102 of embodiments in FIGS. 15 to 20 may be substantially similar to operational features of embodiments of lateral roll control structure of sole structures 102 of FIGS. 5,6, 13, and 14.

Additional Sole Structure Configurations

A configuration of lateral roll control structure of sole structure 102 in an assembled sole structure or article of footwear may vary in different embodiments. In embodiments illustrated in FIGS. 1 to 20, article of footwear 100 includes sole structure 102 including first sole component 110 that has lateral roll control structure generally including slit 250 and associated medially extending portions and laterally extending portions, where first sole component 110 is attached to upper 101 or third sole component 114 by attaching an upper surface of distal ends of the medially extending portions and laterally extending portions to lower surface 242 of third sole component 114 or, in the absence of third sole component 114, directly to lower surface 201 of upper 101. In other embodiments, however, the lateral roll control structure may be formed by attaching first sole component 110 to an upper surface of a sole component disposed below first sole component 110. For example, in some embodiments a lower surface of distal ends of the medially extending portions and laterally extending portions may be attached to an upper surface of second sole component 112 disposed below first sole component 110.

Figure 21:
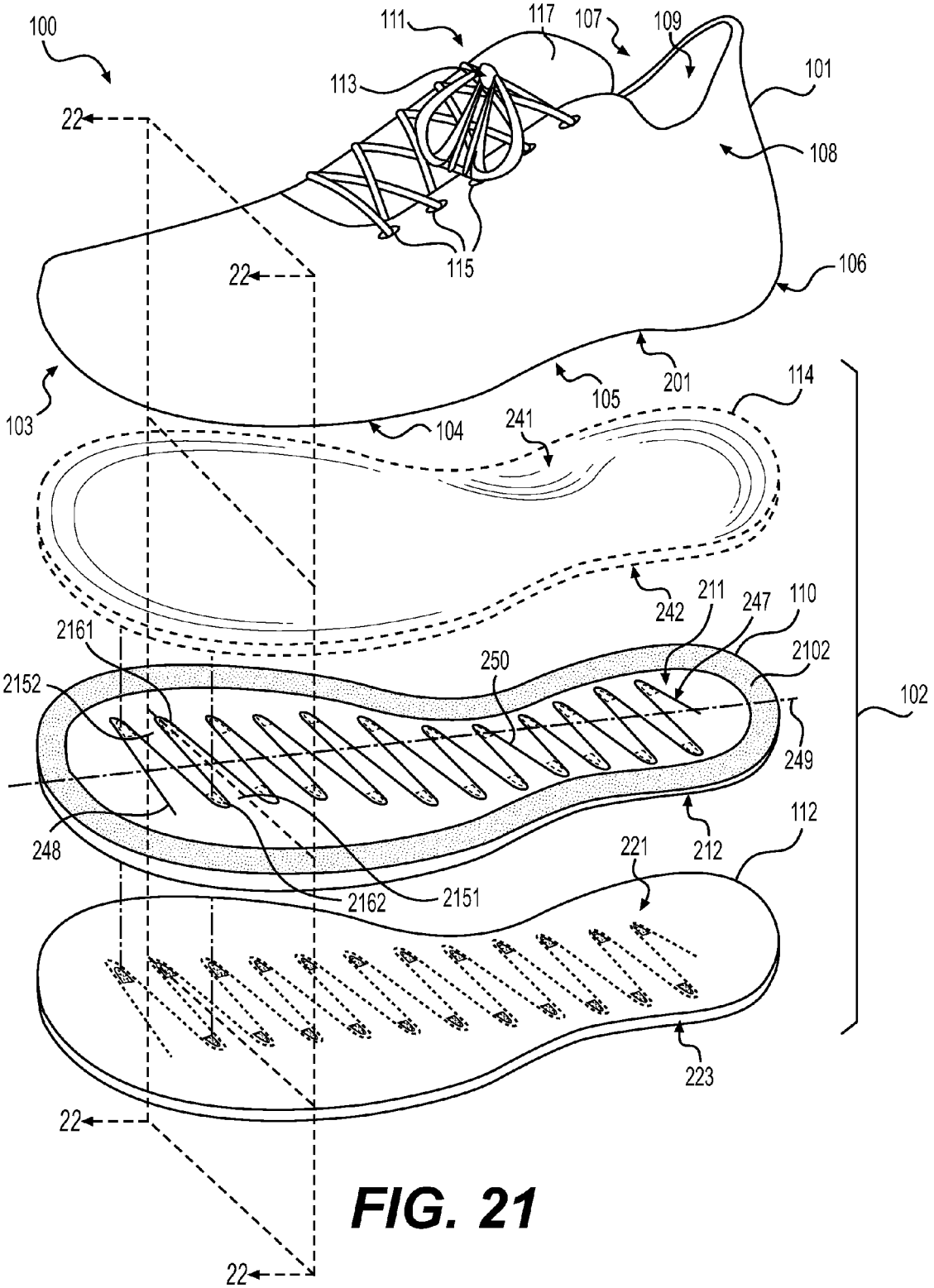
FIG. 21 is a schematic exploded side perspective view of another embodiment of the article of footwear of FIG. 1, illustrating an embodiment of a sole structure including a sole component having a slit configuration providing lateral roll control structure.

FIG. 21 is a schematic exploded side perspective view of another embodiment of an article of footwear 100 of FIG. 1, illustrating an embodiment of a sole structure 102 including a first sole component 110 that has a slit configuration defining a plurality of medially and laterally extending portions forming lateral roll control structure. Generally, the configuration and construction of article of footwear 100 and sole structure 102 illustrated in FIG. 21 may be substantially similar to the configuration and construction of article of footwear 100 and sole structure 102 illustrated in FIG. 2. Accordingly, detailed description of article of footwear 100, upper 101, and sole structure 102 as illustrated in FIG. 21 that is the same as illustrated in FIG. 2 will not be repeated in this section. A configuration of article of footwear 100 and sole structure 102 as illustrated in FIG. 21 may differ from a configuration of article of footwear 100 and sole structure 102 as illustrated in FIG. 2 in that, in FIG. 21 first sole component 110 may be attached to upper surface 221 of second sole component 112 by attaching a lower surface of distal ends of the medially extending portions and laterally extending portions of first sole structure 110 to upper surface 221 of second sole component 112. In this manner, first sole component 110 may provide lateral roll control structure including slit 250 and associated medially extending portions and laterally extending portions of first sole component 110 attached to second sole component 112.

The configuration and construction of sole structure 102 and article of footwear 100 in FIG. 21 may vary in different embodiments. FIGS. 22 to 25 generally illustrate an assembled configuration and construction of an embodiment of sole structure 102 and article of footwear 100 of FIG. 21. FIG. 26 generally illustrates an assembled configuration and construction of another embodiment of sole structure 102 and article of footwear 100 of FIG. 21, without optional third sole component 114. And FIGS. 27 to 30 generally illustrate an assembled configuration and construction of yet another embodiment of sole structure 102 and article of footwear 100 of FIG. 21, with a curved lateral roll control structure. It will be appreciated that, in each of these embodiments, the configuration, construction, and operational features of the lateral roll control structure may be substantially similar to embodiments disclosed above in FIGS. 1 to 20.

Figure 22:
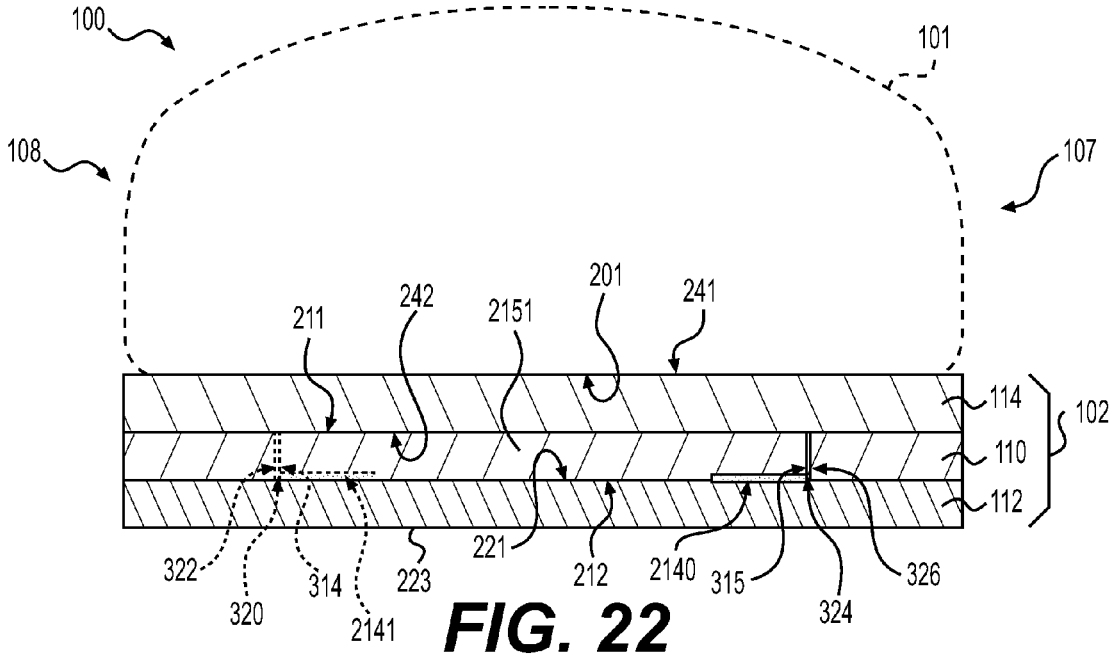
FIG. 22 is a schematic cross-sectional view of an embodiment of an assembled article of footwear and sole structure of FIG. 21, taken along section plane lines 22-22 of FIG. 21.
Figure 23:
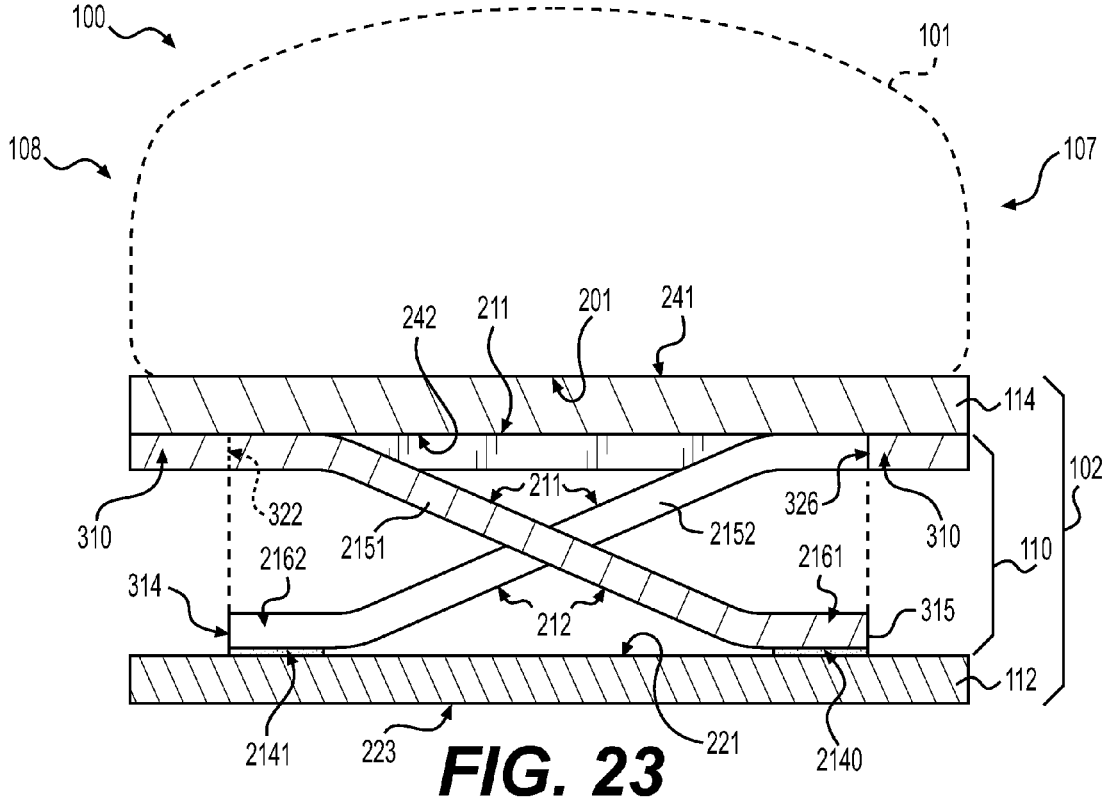
FIG. 23 is a schematic partially exploded cross-sectional view of the article of footwear and sole structure of FIG. 22, illustrating elements of lateral roll control structure of the sole component.
Figure 24:
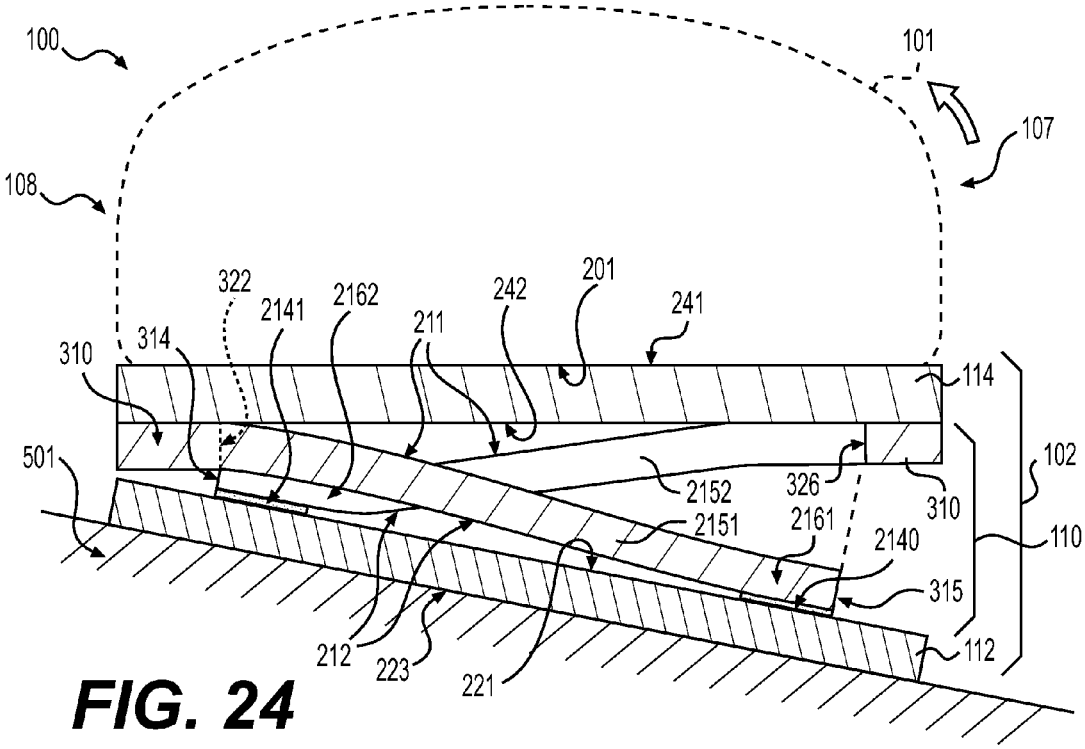
FIG. 24 is a schematic cross-sectional view of the article of footwear and sole structure of FIG. 22, illustrating lateral roll control structure of the sole structure rolling in a lateral direction of the sole structure.
Figure 25:
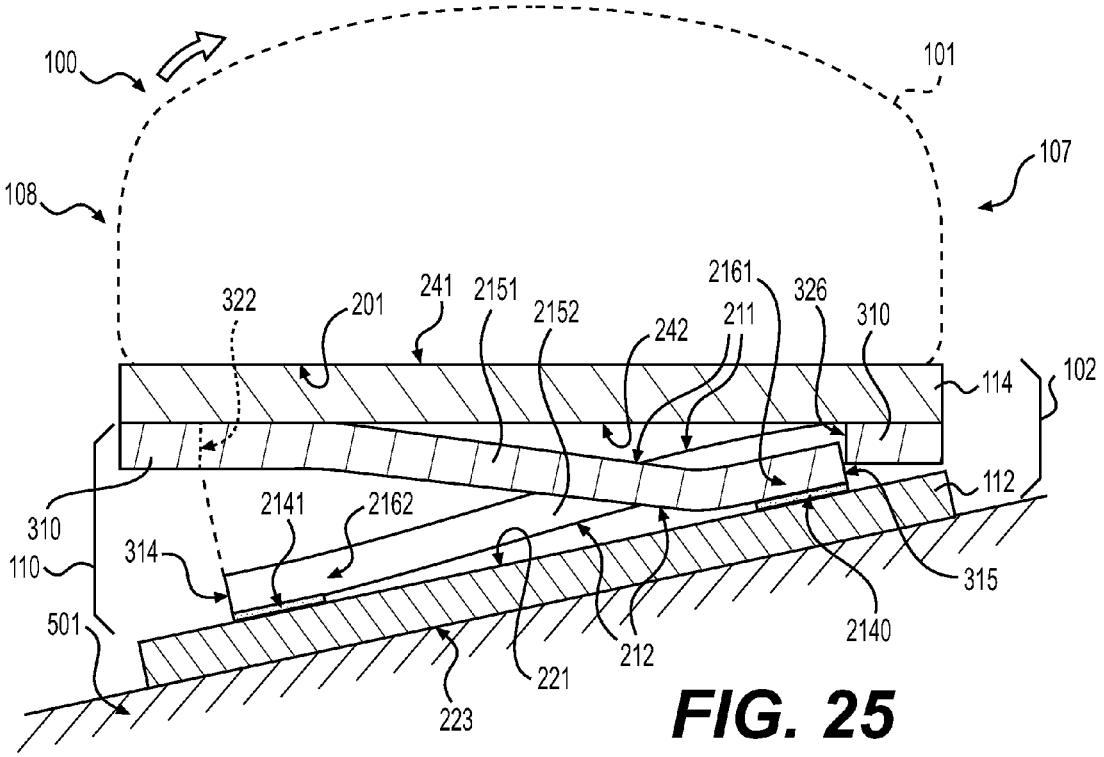
FIG. 25 is a schematic cross-sectional view of the article of footwear and sole structure of FIG. 22, illustrating lateral roll control structure of the sole structure rolling in a medial direction of the sole structure.
Figure 26:
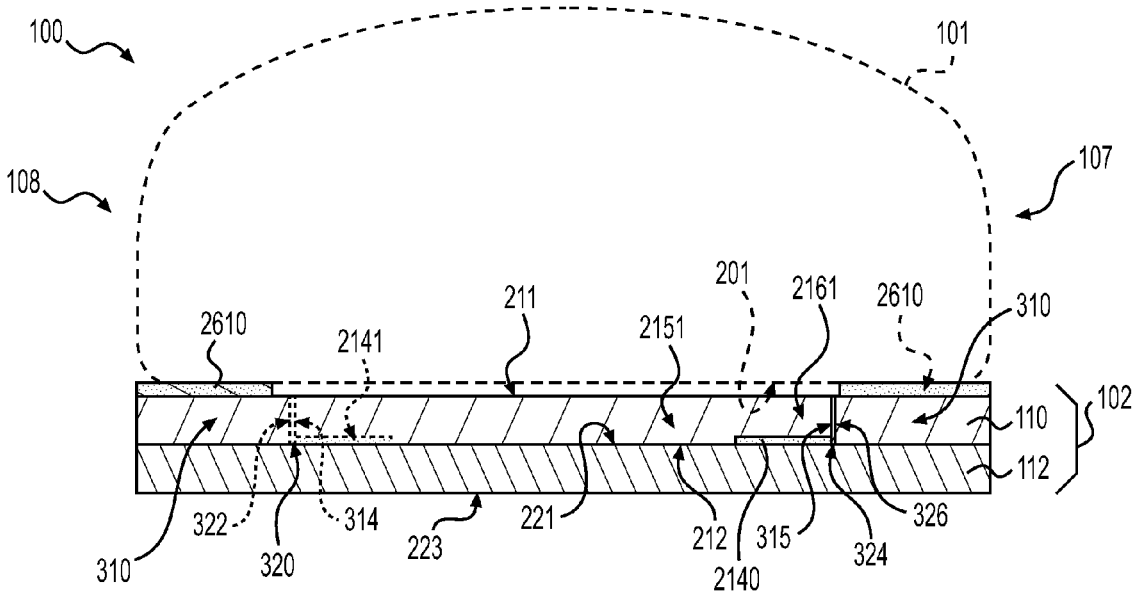
FIG. 26 is a schematic cross-sectional view of another embodiment of an article of footwear of FIGS. 1 and 21, taken along section plane lines 22-22 of FIG. 21, illustrating a sole structure including a sole component having a slit configuration providing lateral roll control structure attached directly to an upper of the article of footwear.

FIGS. 22 to 25 illustrate in schematic cross-sectional view an embodiment of article of footwear 100 and sole structure 102 of FIG. 21, taken along section plane lines 22-22 of FIG. 21, illustrating elements of lateral roll control structure of sole structure 102, including slit 250 and associated medially extending portions and laterally extending portions of first sole component 110. FIG. 23 is a schematic partially exploded cross-sectional view of article of footwear 100 and sole structure 102 of FIG. 22, illustrating certain hidden features of lateral roll control structure of sole structure 102 of FIG. 22. FIG. 24 is a schematic cross-sectional view of article of footwear 100 and sole structure 102 of FIG. 22, illustrating lateral roll control structure of sole structure 102 rolling in a lateral direction of sole structure 102. And FIG. 25 is a schematic cross-sectional view of article of footwear 100 and sole structure 102 of FIG. 22, illustrating lateral roll control structure of sole structure 102 rolling in a medial direction of the sole structure. It will be appreciated that the configuration, construction, and operational features of components and elements in article of footwear 100 in FIGS. 22 to 25 may be substantially similar to embodiments of article of footwear disclosed above in FIGS. 2 to 8.

The configuration and construction of article of footwear 100 in FIGS. 21 to 25 may vary in different embodiments. In some embodiments, upper surface 241 of third sole component 114 may be associated with lower surface 201 of upper 101, e.g., by stitching or adhesive bonding. As shown in FIGS. 21 to 25, in some embodiments first sole component 110 may be associated with third sole component 114 by affixing a peripheral portion 2102 of first sole component 110 to a corresponding peripheral portion of lower surface 242 of third sole component 114. First sole component 110 may be associated with second sole component 112 by attaching selected portions of first sole component 110 to second sole component 112, i.e., by attaching distal ends of medially and laterally extending portions of first sole component 110 to second sole component 112. As shown in FIG. 21, by dashed lines corresponding to slit 250 and associated medially and laterally extending portions of first sole component 110 projected onto top surface 221 of second sole component 112, attachment portions located at distal ends of the medially and laterally extending portions of first sole component 110 may be attached to upper surface 221 of second sole component 112. For example, as shown in FIGS. 21 to 25, attachment portion 2161 located at a distal end of laterally extending portion 2151 of first sole component 110 may be attached to upper surface 221 of second sole component 112 at medial side 107, e.g., by adhesive 2140, and attachment portion 2162 located at a distal end of laterally extending portion 2152 of first sole component 110 may be attached to upper surface 221 of second sole component 112 at lateral side 108. It will be appreciated that, in this manner, medially and laterally extending portions of first sole component 110 may form lateral roll control structure associating (attaching) first sole component 110 and second sole component 112.

As indicated in FIG. 21 by dashed lines, in some embodiments third sole component 114 may be optional. That is, in some embodiments third sole component 114 may be absent. In such case, in some embodiments first sole component 110 may be attached directly to lower surface 201 of upper 101. FIG. 26 is a schematic cross-sectional view of an embodiment of sole structure 102 and article of footwear of FIG. 21, taken along section plane lines 22-22 of FIG. 21, illustrating an embodiment of a sole structure including a first sole component 110 that has a slit configuration providing lateral roll control structure, where first sole component 110 is attached directly to upper 101 of article of footwear 100. As shown in FIG. 26, in some embodiments base portion 310 of first sole component 110 may be directly attached to lower surface 201 of upper 101, e.g., at peripheral portion 2102 of upper surface 211 of first sole component 110, such as by stitching or adhesive bonding (shown by stipple shading at 2610). It will be appreciated that, in this configuration, the medially extending portions and laterally extending portions of first sole component 110 are not affixed to lower surface 201 of upper 101 and provide a degree of freedom to the lateral roll control structure for sole structure 102. This configuration may be advantageous in some applications in that it may eliminate an element of sole structure 102 (i.e., third sole component 114), it may reduce an overall weight of article of footwear 100, and/or it may modify a level of comfort, e.g., by reducing a rigidity of sole structure 102 and article of footwear 100.

Figure 27:
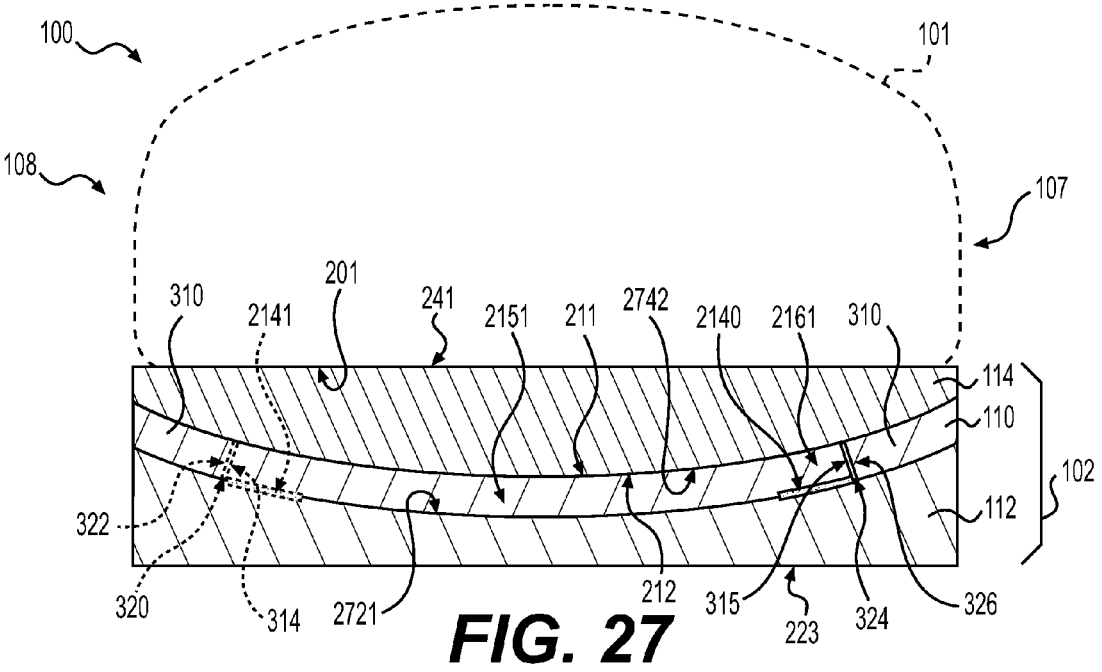
FIG. 27 is a schematic cross-sectional view of another embodiment of an article of footwear and sole structure of FIGS. 1 and 21, taken along section plane lines 22-22 of FIG. 21, illustrating an embodiment of lateral roll control structure of the sole structure having a curved configuration.
Figure 28:
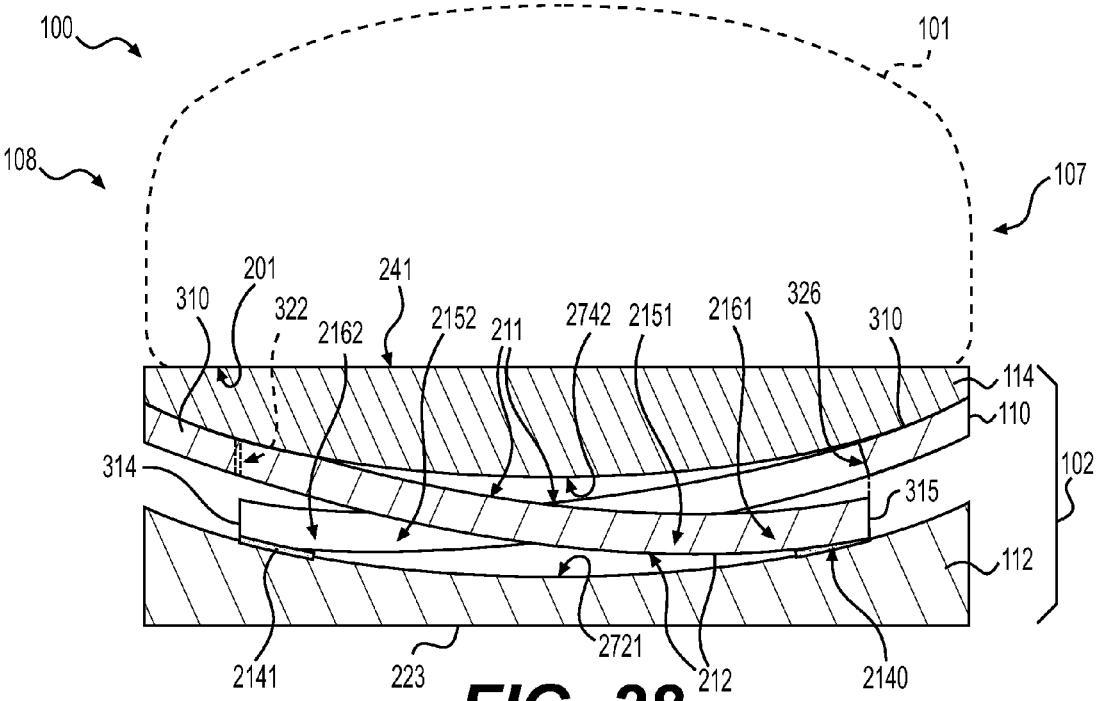
FIG. 28 is a schematic partially exploded cross-sectional view of the article of footwear and sole structure of FIG. 27, taken along section plane lines of 22-22 of FIG. 21, illustrating elements of the lateral roll control structure.
Figure 29:
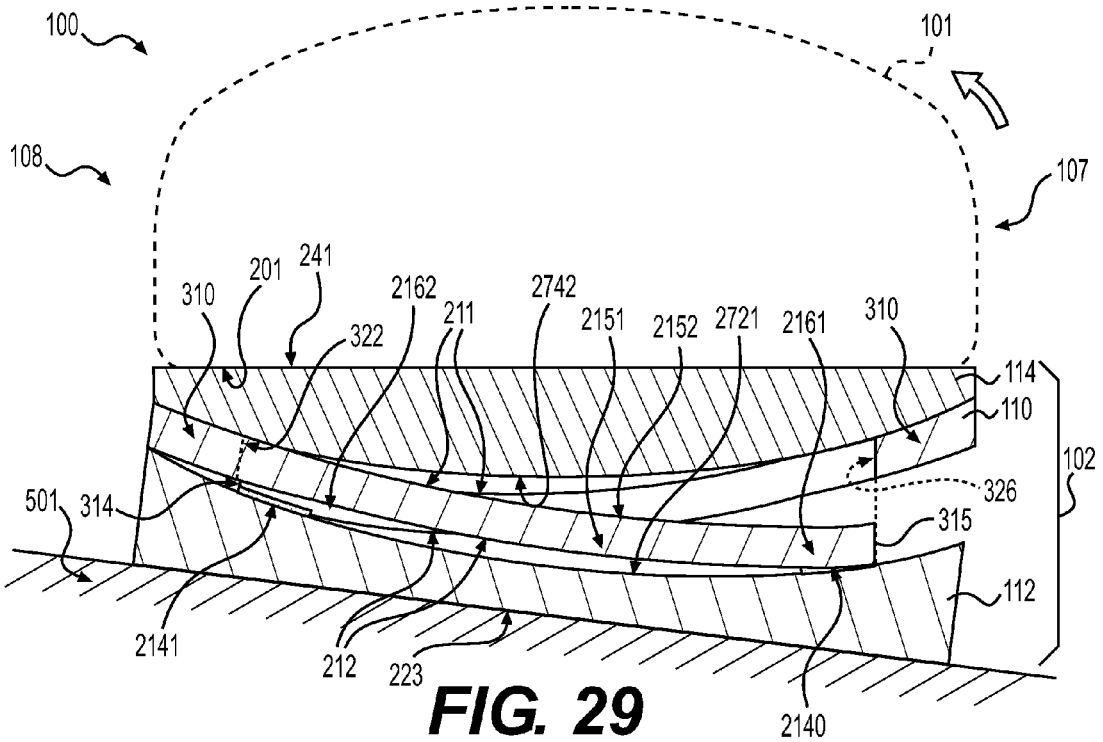
FIG. 29 is a schematic cross-sectional view of the article of footwear and sole structure of FIG. 27, illustrating lateral roll control structure of the sole structure rolling in a lateral direction of the sole structure.
Figure 30:
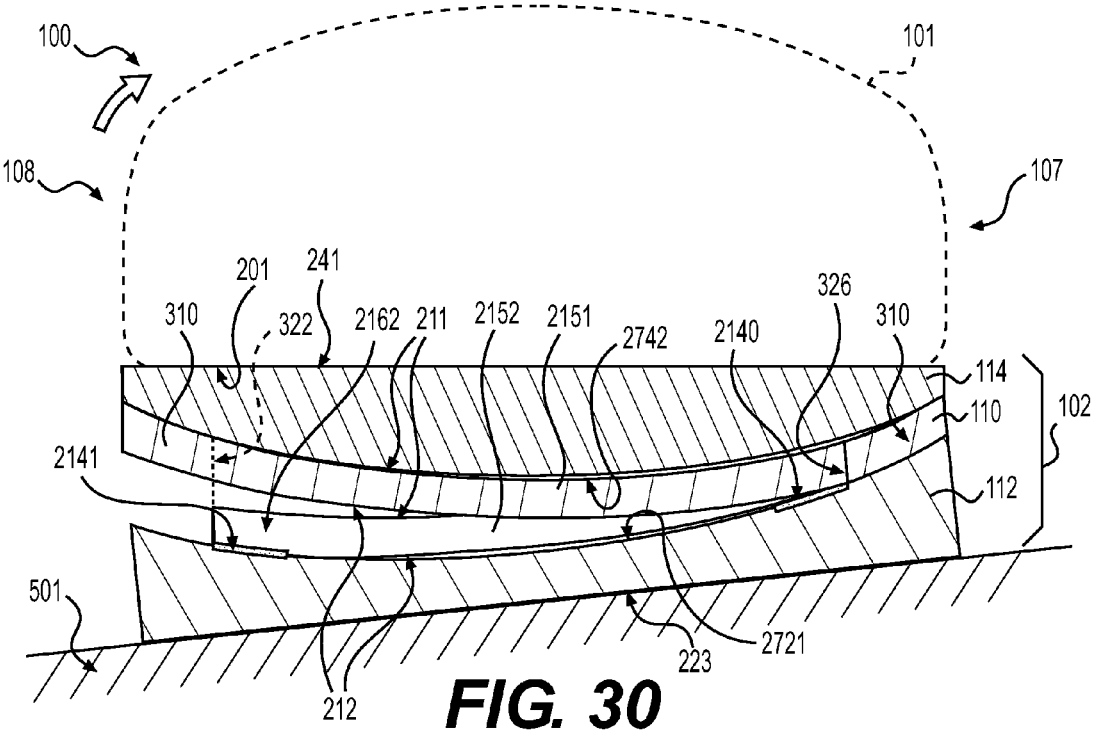
FIG. 30 is a schematic cross-sectional view of the article of footwear and sole structure of FIG. 27, illustrating lateral roll control structure of the sole structure rolling in a medial direction of the sole structure.

FIGS. 27 to 30 illustrate in schematic cross-sectional view another embodiment of an assembled article of footwear 100 and sole structure 102 of FIG. 21, taken along section plane lines 22-22 of FIG. 21, illustrating elements of a lateral roll control structure of sole structure 102 that has a curved configuration. FIG. 28 is a schematic partially exploded cross-sectional view of article of footwear 100 and sole structure 102 of FIG. 27, illustrating certain hidden features of the lateral roll control structure of sole structure 102 of FIG. 27. FIG. 29 is a schematic cross-sectional view of article of footwear 100 and sole structure 102 of FIG. 27, illustrating the lateral roll control structure of sole structure 102 rolling in a lateral direction of sole structure 102. And FIG. 30 is a schematic cross-sectional view of article of footwear 100 and sole structure 102 of FIG. 27, illustrating the lateral roll control structure of sole structure 102 rolling in a medial direction of sole structure 102. It will be appreciated that the configuration, construction, and operational features of the embodiment illustrated in FIGS. 27 to 30 may be substantially similar to the embodiments disclosed above in FIGS. 11 to 14.

The configuration and construction of article of footwear 100 in FIGS. 27 to 30 may vary in different embodiments. In some embodiments, upper surface 241 of third sole component 114 may be associated with lower surface 201 of upper 101, e.g., by stitching or adhesive bonding. As shown in FIGS. 27 to 30, in some embodiments a lower surface 2742 of third sole component 114 may have a curved surface contour, e.g., a cylindrical- or barrel-shaped surface contour having an axis that extends along a generally longitudinal direction of sole structure 102. Similarly, in some embodiments an upper surface 2721 of second sole component 112 may have a curved surface contour, e.g., corresponding to a surface contour of lower surface 2742 of third sole component 114. In some embodiments, first sole component 110 may be disposed between second sole component 112 and third sole component 114. In the construction of FIGS. 27 to 30, first sole component 110 and associated lateral roll control structure thus may have a curved configuration. As shown above in embodiments of FIGS. 21 to 25, in some embodiments first sole component 110 may be associated with third sole component 114 by affixing peripheral portion 2102 of first sole component 110 to a corresponding peripheral portion of lower surface 242 of third sole component 114. First sole component 110 may be associated with second sole component 112 by attaching selected portions of first sole component 110 to second sole component 112, i.e., by attaching distal ends of medially and laterally extending portions of first sole component 110 to second sole component 112. That is, as shown in FIG. 21 by dashed lines corresponding to slit 250 and associated medially and laterally extending portions of first sole component 110 projected onto top surface 221 of second sole component 112, attachment portions located at distal ends of the medially and laterally extending portions of first sole component 110 may be attached to upper surface 221 of second sole component 112. For example, as shown in FIGS. 27 to 30, in some embodiments attachment portion 2161 of laterally extending portion 2151 of first sole component 110 may be attached to upper surface 2721 of second sole component 112 at medial side 107, e.g., by adhesive 2140, and attachment portion 2162 of laterally extending portion 2152 of first sole component 110 may be attached to upper surface 2721 of second sole component 112 at lateral side 108, e.g., by adhesive 2141. It will be appreciated that, in this manner, medially and laterally extending portions of first sole component 110 may form lateral roll control structure associating (attaching) first sole component 110 and second sole component 112.

FIGS. 27 to 30, like FIGS. 11 to 14, thus illustrate embodiments of an article of footwear 100 that includes a sole component 110 having a slit configuration 250 defining a plurality of medially and laterally extending portions forming lateral roll control structure that has a curved configuration, e.g., a cylindrical- or barrel-shaped configuration. In embodiments of FIGS. 11 to 14 and FIGS. 27 to 30, the lateral roll control structure has a concave curved configuration (as viewed from upper 101). On the other hand, it will be appreciated that, in some embodiments, the lateral roll control structure may have a convex curved configuration (as viewed from upper 101). That is, in some embodiments of FIGS. 11 to 14, lower surface 1142 of third sole component 114 may have a convex surface contour, and upper surface 1121 of second sole component 112 may have a concave surface contour that corresponds with the convex surface contour of lower surface 1142 of third sole component 114. Similarly, in some embodiments of FIGS. 27 to 30, lower surface 2742 of third sole component 114 may have a convex surface contour, and upper surface 2721 of second sole component 112 may have a concave surface contour that corresponds with the convex surface contour of lower surface 2742 of third sole component 114. It will be appreciated that each of these configurations including lateral roll control structure having a curved configuration may be advantageous in providing a smooth rolling motion in a medial-lateral direction of sole structure 102 and article of footwear 100. Those skilled in the art will appreciate alternative configurations and surface contours for forming lateral roll control structure having a curved configuration suitable for a desired application based on this disclosure.

Lateral Roll Control Structure Features

The lateral roll control structure of a sole component may vary in different embodiments by varying a slit configuration of the sole component. FIGS. 1 to 30 above variously illustrate embodiments of articles of footwear and sole structures including a sole component that has a slit configuration providing lateral roll control structure. FIGS. 31 to 42 below illustrate in top plan view various embodiments of sole components that have different slit configurations providing lateral roll control structure. In some embodiments illustrated or described below, a slit forming lateral roll control structure may define generally medially and laterally extending portions that have regular geometric configurations. In some embodiments illustrated or described below, a slit forming lateral roll control structure may define medially and laterally extending portions that have non-regular geometric configurations. As illustrated or described in embodiments below, a slit forming lateral roll control structure may define medially and laterally extending portions that have a configuration with generally regular pitch or periodic features. As illustrated or described in embodiments below, a slit forming lateral roll control structure may define medially and laterally extending portions that have a configuration with non-regular pitch or periodic features. Embodiments discussed below variously may have advantages over other embodiments in certain circumstances, e.g., with regard to rigidity, flexibility, or other lateral roll control characteristics, with regard to efficiency of manufacturing processes and/or ease of manufacturing, with regard to manufacturing costs, and/or with regard to another performance characteristic(s) of a sole component, sole structure, and/or article of footwear.

Serpentine Slit Configuration Features

Figure 31:
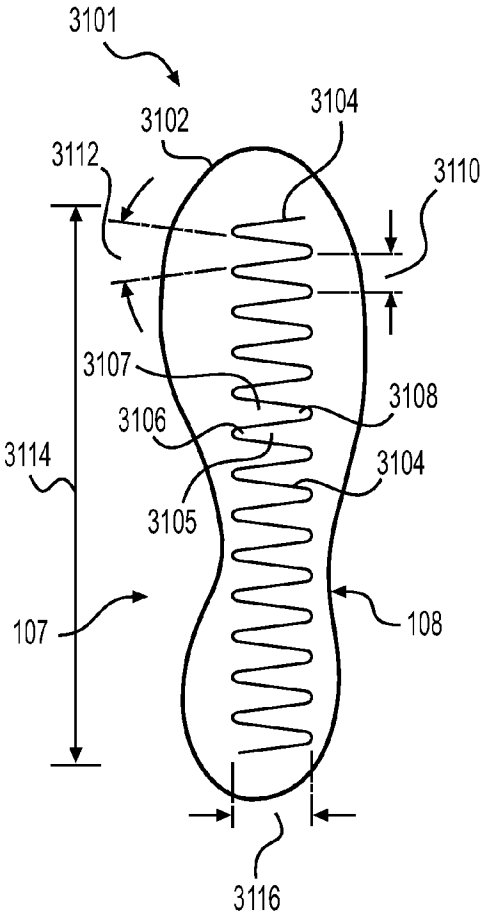
FIG. 31 is a schematic top plan view of an embodiment of a sole component having a serpentine slit configuration for providing lateral roll control structure.

FIG. 31 is a top plan view of an embodiment of a sole component 3101 for a sole structure having lateral roll control structure. In some embodiments sole component 3101 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3101 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3101 may be different.

As shown in FIG. 31, in some embodiments sole component 3101 may include a body 3102 and a slit 3104 having a serpentine configuration that forms in a central or interior region of body 3102 alternating medially and laterally extending portions that have a generally parabolic configuration. As shown in FIG. 31, in some embodiments slit 3104 may be a single continuous slit that includes alternating and continuous generally medial-to-lateral extending slit portions and generally lateral-to-medial extending slit portions that collectively progress in a longitudinal direction of sole component 3101. With this configuration, slit 3104 may form a plurality of alternating medially extending portions and lateral extending portions of sole component 3101. For example, as shown in FIG. 31, slit 3104 may form at least one medially extending portion 3105 and at least one laterally extending portion 3107. As shown in FIG. 31, each medially extending portion 3105 may have an attachment portion 3106 located at a distal end of medially extending portion 3105, and each laterally extending portion 3107 may have an attachment portion 3108 located at a distal end of laterally extending portion 3107. With this configuration, each medially extending portion 3105 may have a continuously decreasing width (measured in a longitudinal direction of sole component 3101) and a rounded distal end that forms an attachment portion 3106 at medial side 107 of sole component 3101. It will be appreciated that attachment portion 3106 may be configured for attachment to another element of a sole structure or upper of an article of footwear at a medial side of the sole structure and article of footwear, e.g., by adhesive bonding. Similarly, with this configuration each laterally extending portion 3107 may have a continuously decreasing width (measured in a longitudinal direction of sole component 3101) and a rounded distal end that forms an attachment portion 3108 at lateral side 108 of sole component 3101. It will be appreciated that attachment portion 3108 may be configured for attachment to another element of a sole structure or upper of an article of footwear at a lateral side of the sole structure and article of footwear, e.g., by adhesive bonding.

The number, pitch, and angle of medially extending portions 3105 and laterally extending portions 3107 may vary in different embodiments. As shown in FIG. 31, in some embodiments slit 3104 may include plural medially extending portions and plural laterally extending portions. In some embodiments, the number of medially extending portions and the number of laterally extending portions may be the same. In some embodiments, the number of medially extending portions and the number of laterally extending portions may be different, e.g., based on a geometry of a toe region or a geometry of a heel region of an article of footwear. In some embodiments, the number of medially extending portions or the number of laterally extending portions may be one. As shown in FIG. 31, in some embodiments medially extending portions 3105 and laterally extending portions 3107 may be arranged at a pitch (P) 3110 in a longitudinal direction of sole component 3101, with adjacent sides of each medially extending portion 3105 and laterally extending portion 3107 generally forming an angle 3112. The number of medially extending portions 3105, the number of laterally extending portions 3107, pitch 3110, and angle 3112 may vary depending on a number of factors including, but not limited to, a configuration (including at least length, width, and shape) of body 3102, a configuration (including at least longitudinal length 3114 and lateral width 3116) of slit 3104, a rigidity or flex characteristic of sole component 3101 (e.g., a rigidity or flex characteristic of a material of body 3102 and/or of any surface layer or treatment of sole component 3101), and other factors. Those skilled in the art will be able to select the number of medially extending portions 3105 and laterally extending portions 3107, pitch 3110, angle 3112, longitudinal length 3114, lateral width 3116, and rigidity or flex characteristic(s) of sole component 3101 suitable for achieving a desired lateral roll control characteristic of sole component 3101 for a sole structure and article of footwear based on this detailed description of embodiments.

Triangular or Zig-Zag Slit Configuration Features

Figure 32:
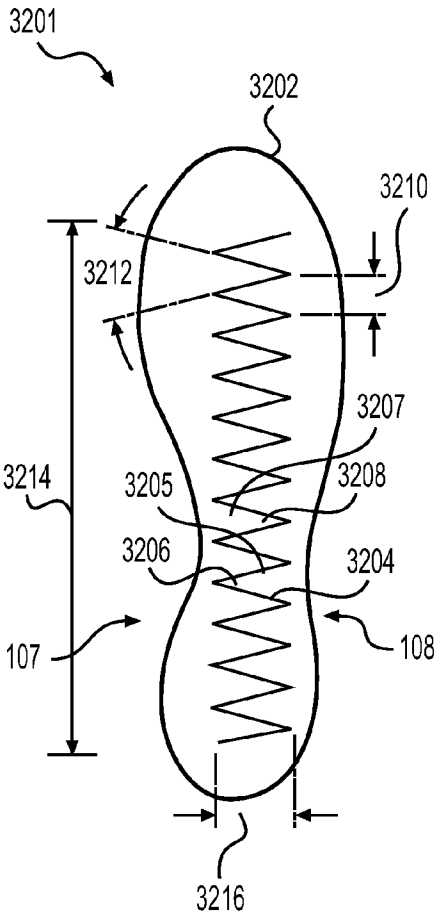
FIG. 32 is a schematic top plan view of an embodiment of a sole component having a triangular or zig-zag slit configuration for providing lateral roll control structure.

FIG. 32 is a top plan view of an embodiment of a sole component 3201 for a sole structure having lateral roll control structure. In some embodiments sole component 3201 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3201 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3201 may be different.

As shown in FIG. 32, in some embodiments sole component 3201 may include a body 3202 and a slit 3204 having zig-zag configuration that forms in a central or interior region of body 3202 alternating medially and laterally extending portions that have a generally triangular configuration. As shown in FIG. 32, in some embodiments slit 3204 may be a single continuous slit that includes alternating and continuous generally medial-to-lateral extending slit portions and generally lateral-to-medial extending slit portions that collectively progress in a longitudinal direction of sole component 3201. With this configuration, slit 3204 may form a plurality of alternating medially extending portions and laterally extending portions of sole component 3201. For example, as shown in FIG. 32, slit 3204 may form at least one medially extending portion 3205 and at least one laterally extending portion 3207. As shown in FIG. 32, each medially extending portion 3205 may have an attachment portion 3206 located at a distal end of medially extending portion 3205, and each laterally extending portion 3207 may have an attachment portion 3208 located at a distal end of laterally extending portion 3207. With this configuration, each medially extending portion 3205 may have a continuously decreasing width (measured in a longitudinal direction of sole component 3201) and a triangular-shaped distal end that forms an attachment portion 3206 at medial side 107 of sole component 3201. It will be appreciated that attachment portion 3206 may be configured for attachment to another element of a sole structure or upper of an article of footwear at a medial side of the sole structure and article of footwear, e.g., by adhesive bonding. Similarly, with this configuration, each laterally extending portion 3207 may have a continuously decreasing width (measured in a longitudinal direction of sole component 3201) and a triangular-shaped distal end that forms an attachment portion 3208 at lateral side 108 of sole component 3201. It will be appreciated that attachment portion 3208 may be configured for attachment to another element of a sole structure or upper of an article of footwear at a lateral side of the sole structure and article of footwear, e.g., by adhesive bonding.

The number, pitch, and angle of medially extending portions 3205 and laterally extending portions 3207 may vary in different embodiments. As shown in FIG. 32, in some embodiments slit 3204 may include plural medially extending portions and plural laterally extending portions. In some embodiments, the number of medially extending portions and the number of laterally extending portions may be the same. In some embodiments, the number of medially extending portions and the number of laterally extending portions may be different, e.g., based on a geometry of a toe region or a geometry of a heel region of an article of footwear. In some embodiments, the number of medially extending portions or the number of laterally extending portions may be one. As shown in FIG. 32, in some embodiments medially extending portions 3205 and laterally extending portions 3207 may be arranged at a pitch 3210 in a longitudinal direction of sole component 3201, with adjacent sides of each medially extending portion 3205 and laterally extending portion 3207 generally forming an angle 3212. The number of medially extending portions 3205, the number of laterally extending portions 3207, pitch 3210, and angle 3212 may vary depending on a number of factors including, but not limited to, a configuration (including at least length, width, and shape) of body 3202, a configuration (including at least longitudinal length 3214 and lateral width 3216) of slit 3204, a rigidity or flex characteristic of sole component 3201 (e.g., a rigidity or flex characteristic of a material of body 3202 and/or of any surface layer or treatment of sole component 3201), and other factors. Those skilled in the art will be able to select the number of medially extending portions 3205 and laterally extending portions 3207, pitch 3210, angle 3212, longitudinal length 3214, lateral width 3216, and rigidity or flex characteristic(s) of sole component 3201 suitable for achieving a desired lateral roll control characteristic of sole component 3201 for a sole structure and article of footwear based on this detailed description of embodiments.

Stepped Rectangular Slit Configuration Features

Figure 33:
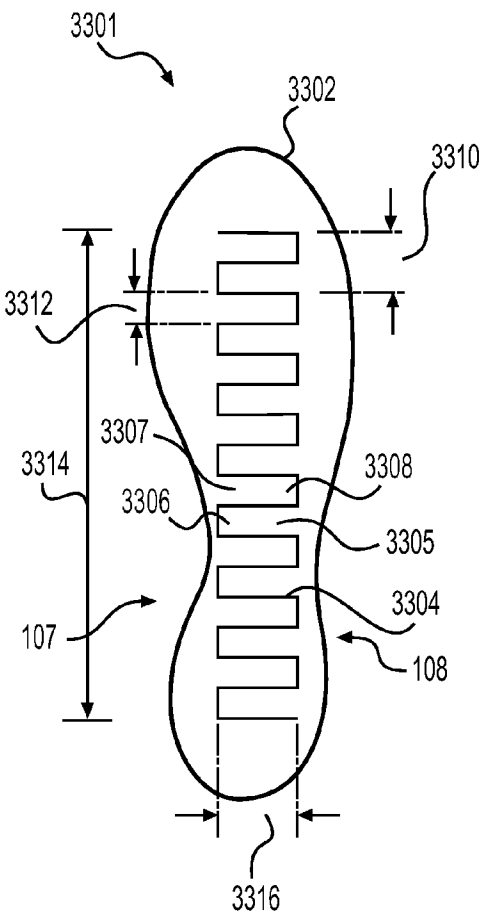
FIG. 33 is a schematic top plan view of an embodiment of a sole component having a rectangular stepped slit configuration for providing lateral roll control structure.

FIG. 33 is a top plan view of another embodiment of a sole component 3301 for a sole structure having lateral roll control structure. In some embodiments sole component 3301 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3301 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3301 may be different.

As shown in FIG. 33, in some embodiments sole component 3301 may include a body 3302 and a slit 3304 having a stepped configuration that forms in a central or interior region of body 3302 alternating medially and laterally extending portions that have a generally rectangular configuration. In some embodiments, the rectangular configuration may be generally square. As shown in FIG. 33, in some embodiments slit 3304 may be a single continuous slit that includes alternating and continuous generally medial-to-lateral extending slit portions and generally lateral-to-medial extending slit portions that collectively progress in a longitudinal direction of sole component 3301. With this configuration, slit 3304 may form a plurality of alternating medially extending portions and lateral extending portions of sole component 3301. For example, as shown in FIG. 33, slit 3304 may form at least one medially extending portion 3305 and at least one laterally extending portion 3307. As shown in FIG. 33, each medially extending portion 3305 may have an attachment portion 3306 located at a distal end of medially extending portion 3305, and each laterally extending portion 3307 may have an attachment portion 3308 located at a distal end of laterally extending portion 3307. With this configuration, each medially extending portion 3305 may have a substantially constant width (measured in a longitudinal direction of sole component 3301) and a rectangular or square shaped distal end that forms an attachment portion 3306 at medial side 107 of sole component 3301. It will be appreciated that attachment portion 3306 may be configured for attachment to another element of a sole structure or upper of an article of footwear at a medial side of the sole structure and article of footwear. Similarly, with this configuration each laterally extending portion 3307 may have a substantially constant width (measured in a longitudinal direction of sole component 3301) and a rectangular or square shaped distal end that forms an attachment portion 3308 at lateral side 108 of sole component 3301. It will be appreciated that attachment portion 3308 may be configured for attachment to another element of a sole structure or upper of an article of footwear at a lateral side of the sole structure and article of footwear.

The number, pitch, and width of medially extending portions 3305 and laterally extending portions 3307 may vary in different embodiments. As shown in FIG. 33, in some embodiments slit 3304 may include plural medially extending portions and plural laterally extending portions. In some embodiments, the number of medially extending portions and the number of laterally extending portions may be the same. In some embodiments, the number of medially extending portions and the number of laterally extending portions may be different (a number greater or lesser by one), e.g., based on a geometry of a toe region or a geometry of a heel region of an article of footwear. In some embodiments, the number of medially extending portions or the number of laterally extending portions may be one. As shown in FIG. 33, in some embodiments medially extending portions 3305 and laterally extending portions 3307 may be arranged at a pitch 3310 in a longitudinal direction of sole component 3301, with a width 3312 of each medially extending portion and laterally extending portion (measured in a longitudinal direction of sole component 3301) generally equal to one half (½) of pitch 3310. It will be appreciated that, in some embodiments, a width of each medially extending portion may be different from a width of each laterally extending portion. For example, a width of each medially extending portion may be one third (⅓) of pitch 3310, and a width of each laterally extending portion may be two thirds (⅔) of pitch 3310. The number of medially extending portions 3305, the number of laterally extending portions 3307, pitch 3310, and the width 3312 of each medially and laterally extending portion may vary depending on a number of factors including, but not limited to, a configuration (including at least length, width, and shape) of body 3302, a configuration (including at least longitudinal length 3314 and lateral width 3316) of slit 3304, a rigidity or flex characteristic of sole component 3301 (e.g., a rigidity or flex characteristic of a material of body 3302 and/or of any surface layer or treatment of sole component 3301), and other factors. Those skilled in the art will be able to select the number of medially extending portions 3305 and laterally extending portions 3307, pitch 3310, width 3312, longitudinal length 3314, lateral width 3316, and rigidity or flex characteristic(s) of sole component 3301 suitable for achieving a desired lateral roll control characteristic of sole component 3301 for a sole structure and article of footwear based on this detailed description of embodiments.

Stepped Trapezoidal Slit Configuration Features

Figure 34:
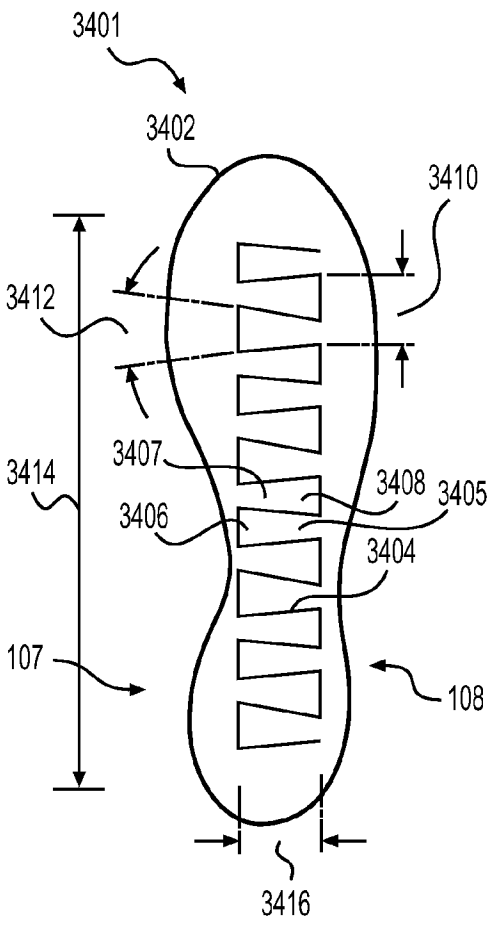
FIG. 34 is a schematic top plan view of an embodiment of a sole component having a trapezoidal stepped slit configuration for providing lateral roll control structure.

FIG. 34 is a top plan view of another embodiment of a sole component 3401 for a sole structure having lateral roll control structure. In some embodiments, sole component 3401 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3401 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3401 may be different.

As shown in FIG. 34, in some embodiments sole component 3401 may include a body 3402 and a slit 3404 having a stepped configuration that forms in a central or interior region of body 3402 alternating medially and laterally extending portions having a generally trapezoidal configuration. With this configuration, slit 3404 may form a plurality of alternating medially extending portions and lateral extending portions of sole component 3401. For example, as shown in FIG. 34, slit 3404 may form at least one medially extending portion 3405 and at least one laterally extending portion 3407. As shown in FIG. 34, each medially extending portion 3405 may have an attachment portion 3406 located at a distal end of medially extending portion 3405, and each laterally extending portion 3407 may have an attachment portion 3408 located at a distal end of laterally extending portion 3407. With this configuration, each medially extending portion 3405 may have a generally trapezoidal shape, with a width (measured in a longitudinal direction of sole component 3401) that continuously increases in a medial direction of sole component 3401, and a generally trapezoidal-shaped distal end that forms an attachment portion 3406 at medial side 107 of sole component 3401. It will be appreciated that attachment portion 3406 may be configured for attachment to another element of a sole structure or upper of an article of footwear at a medial side of the sole structure and article of footwear, e.g., by adhesive bonding. Similarly, with this configuration, each laterally extending portion 3407 may have a generally trapezoidal shaped configuration, with a width (measured in a longitudinal direction of sole component 3401) that continuously increases in a lateral direction of sole component 3401, and a generally trapezoidal-shaped distal end that forms an attachment portion 3408 at lateral side 108 of sole component 3301. It will be appreciated that attachment portion 3408 may be configured for attachment to another element of a sole structure or upper of an article of footwear at a lateral side of the sole structure and article of footwear, e.g., by adhesive bonding.

The number, pitch, and angle of medially extending portions 3405 and laterally extending portions 3407 may vary in different embodiments. As shown in FIG. 34, in some embodiments slit 3404 may include plural medially extending portions and plural laterally extending portions. In some embodiments, the number of medially extending portions and the number of laterally extending portions may be the same. In some embodiments, the number of medially extending portions and the number of laterally extending portions may be different, e.g., based on a geometry of a toe region or a geometry of a heel region of an article of footwear. In some embodiments, the number or medially extending portions or the number of laterally extending portions may be one. As shown in FIG. 34, in some embodiments medially extending portions 3405 and laterally extending portions 3407 may be arranged at a pitch 3410 in a longitudinal direction of sole component 3401, with adjacent sides of each medially extending portion 3405 and laterally extending portion 3407 generally forming an angle 3412. The number of medially extending portions 3405, the number of laterally extending portions 3407, pitch 3410, and angle 3412 may vary depending on a number of factors including, but not limited to, a configuration (including at least length, width, and shape) of body 3402, a configuration (including at least longitudinal length 3414 and lateral width 3416) of slit 3404, a rigidity or flex characteristic of sole component 3401 (e.g., a rigidity or flex characteristic of a material of body 3402 and/or any surface layer or treatment of sole component 3401), and other factors. Those skilled in the art will be able to select the number of medially extending portions 3405 and laterally extending portions 3407, pitch 3410, angle 3412, longitudinal length 3414, lateral width 3416, and rigidity or flex characteristic(s) of sole component 3401 suitable for achieving a desired lateral roll control characteristic of sole component 3401 for a sole structure and article of footwear based on this detailed description of embodiments.

Arched Center Line Slit Configuration Features

Figure 35:
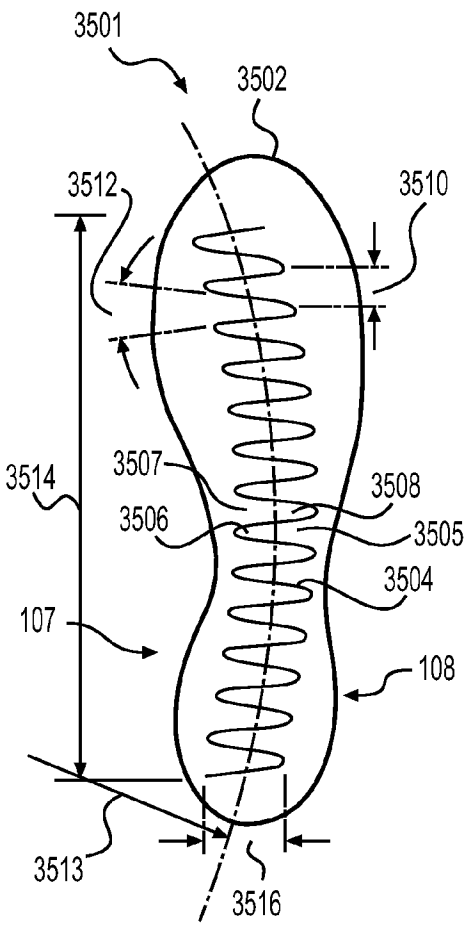
FIG. 35 is a schematic top plan view of an embodiment of a sole component having a serpentine slit configuration with a curved central line for providing lateral roll control structure.

FIG. 35 is a top plan view of another embodiment of a sole component 3501 for a sole structure having lateral roll control structure. In some embodiments sole component 3501 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3501 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3501 may be different.

As shown in FIG. 35, in some embodiments sole component 3501 may include a body 3502 and a slit 3504 having a generally serpentine configuration that forms in a central or interior region of body 3502 alternating medially and laterally extending portions that have a generally parabolic configuration and are arranged about a central line that generally defines an arc. As shown in FIG. 35, in some embodiments slit 3504 may be a single continuous slit that includes alternating and continuous generally medial-to-lateral extending slit portions and generally lateral-to-medial extending slit portions that collectively progress in a longitudinal direction of sole component 3501. With this configuration, slit 3504 may form a plurality of alternating medially extending portions and lateral extending portions of sole component 3501. For example, as shown in FIG. 35, slit 3504 may include at least one medially extending portion 3505 and at least one laterally extending portion 3507. As shown in FIG. 35, each medially extending portion

3505 may have an attachment portion 3506 located at a distal end of medially extending portion 3505, and each laterally extending portion 3507 may have an attachment portion 3508 located at a distal end of laterally extending portion 3507. With this configuration, each medially extending portion 3505 may have a continuously decreasing width (measured in a longitudinal direction of sole component 3501) and a rounded distal end that forms an attachment portion 3506 at medial side 107 of sole component 3501. It will be appreciated that attachment portion 3506 may be configured for attachment to another element of a sole structure or upper of an article of footwear at a medial side of the sole structure and article of footwear, e.g., by adhesive bonding. Similarly, with this configuration each laterally extending portion 3507 may have a continuously decreasing width (measured in a longitudinal direction of sole component 3501) and a rounded distal end that forms an attachment portion 3508 at lateral side 108 of sole component 3501. It will be appreciated that attachment portion 3508 may be configured for attachment to another element of a sole structure or upper of an article of footwear at a lateral side of the sole structure and article of footwear, e.g. by adhesive bonding.

The number, pitch, and angle of medially extending portions 3505 and laterally extending portions 3507 may vary in different embodiments. As shown in FIG. 35, in some embodiments slit 3504 may include plural medially extending portions and plural laterally extending portions. In some embodiments, the number of medially extending portions and the number of laterally extending portions may be the same. In some embodiments, the number of medially extending portions and the number of laterally extending portions may be different, e.g., based on a geometry of a toe region or a geometry of a heel region of an article of footwear. In some embodiments, the number of medially extending portions or the number of laterally extending portions may be one. As shown in FIG. 35, in some embodiments medially extending portions 3505 and laterally extending portions 3507 may be arranged at a pitch 3510 in a longitudinal direction of sole component 3501, with adjacent sides of each medially extending portion 3505 and laterally extending portion 3507 generally forming an angle 3512. In some embodiments, slit 3504 may have a configuration that is arched in a medial or lateral direction. For example, as shown in FIG. 35, in some embodiments slit 3504 may be arranged to have a central line having an arched configuration, e.g., an arc having an arc radius 3513, in a medial direction of sole component 3501. The number of medially extending portions 3505, the number of laterally extending portions 3507, pitch 3510, angle 3512, and arc radius 3513 may vary depending on a number of factors including, but not limited to, a configuration (including at least length, width, and shape) of body 3502, a configuration (including at least longitudinal length 3514 and lateral width 3516) of slit 3504, a rigidity or flex characteristic of sole component 3501 (e.g., a rigidity or flex characteristic of a material of body 3502 and/or any surface layer or treatment on sole component 3501), and other factors. Those skilled in the art will be able to select the number of medially extending portions 3505 and laterally extending portions 3507, pitch 3510, angle 3512, arc radius 3513, longitudinal length 3514, lateral width 3516, and rigidity or flex characteristic(s) of sole component 3501 suitable for achieving a desired lateral roll control characteristic of sole component 3501 for a sole structure and article of footwear based on this detailed description of embodiments.

Localized or Multiple Slit Portion Features

A sole component may have one or more slits or slit portions forming respective and/or collective lateral roll control structure. As shown in FIGS. 31 to 35, in some embodiments lateral roll control structure may be formed in a sole component by a single slit that extends along a length of the sole component, e.g., from a forefoot region to a heel region of the sole component. In some embodiments, a sole component may include a single slit that extends along only a portion of a longitudinal length of the sole component, forming lateral roll control structure in only that portion of the sole component, e.g., in only a single region of the sole component. In some embodiments, a sole component may include plural slits or slit portions located in different respective portions of the sole component, forming plural lateral roll control structure in respective portions of the sole component.

Figure 36:
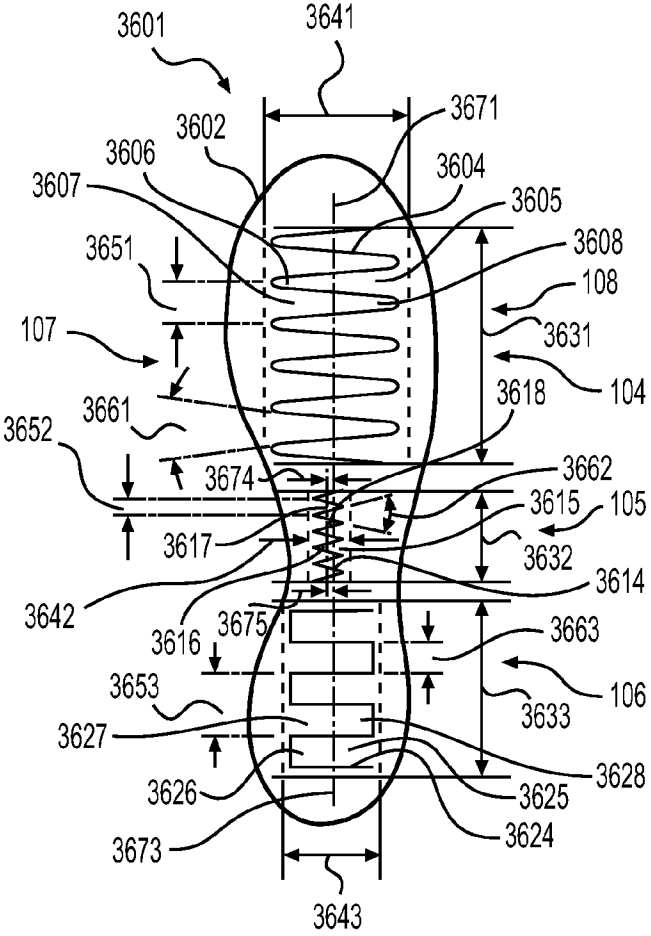
FIG. 36 is a schematic top plan view of an embodiment of a sole component having plural slit configurations for providing respective lateral roll control structures in plural regions of the sole component.

FIG. 36 is a top plan view of another embodiment of a sole component 3601 having lateral roll control structure in at least one portion of sole component 3601. In some embodiments, sole component 3601 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3601 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3601 may be different.

As shown in FIG. 36, in some embodiments sole component 3601 may include a body 3602 and at least one slit or slit portion located in a respective portion of body 3602. For example, referring to FIG. 36, in some embodiments sole component 3601 variously may include at least one of a first slit portion 3604 formed in forefoot region 104 of body 3602, a second slit portion 3614 formed in midfoot region 105 of body 3602, and/or a third slit portion 3624 formed in heel region 106 of body 3602. As shown in FIG. 36, in some embodiments sole component 3601 may include first slit portion 3604, second slit portion 3614, and third slit portion 3624. In some embodiments, sole component 3601 may include only two of first slit portion 3604, second slit portion 3614, and third slit portion 3624. In some embodiments, two slit portions may be formed in adjacent portions of body 3602 (e.g., first slit portion 3604 in forefoot region 104 and second slit portion 3614 formed in midfoot region 105; or second slit portion 3614 formed in midfoot region 105 and third slit portion 3624 formed in heel region 106). It will be appreciated that, in such case, the two adjacent slit portions may form separate slits or may be joined to form a single continuous slit having two different slit portions. In some embodiments, three slit portions may be formed in respective adjacent portions of sole component 3601. In some embodiments, sole component 3601 may include only one of first slit portion 3604, second slit portion 3614, and third slit portion 3624. Those skilled in the art will be able to select a number, location, and any association of one or more slits or slit portions suitable for a desired localized lateral roll control structure based on this detailed description of embodiments.

Two or more slit portions may be joined as a single continuous slit or slit portion. As shown in FIG. 36, in some embodiments first slit portion 3604, second slit portion 3614, and third slit portion 3624 may be separate, independent slit structures that may provide respective localized lateral roll control structure and lateral roll control characteristics for a sole structure and article of footwear. In some embodiments, these localized lateral roll control characteristics collectively may provide a desired overall lateral roll control characteristic for a sole structure and article of footwear. In some embodiments, two or more of first slit portion 3604, second slit portion 3614, and third slit portion 3624 may be joined as a continuous slit across one or more portions of body 3602, e.g., three serpentine slit portions may be joined as a single continuous serpentine slit that extends through forefoot region 104, midfoot region 105, and heel region 106 (see, e.g., FIGS. 31 and 35). It will be appreciated that a single continuous slit similarly may be formed by joining three slit portions having different slit configurations, as generally discussed below.

Different slit portions may have different configurations. In some embodiments, at least one slit portion of plural slit portions may have a different configuration, including at least one of a different size (e.g., length and/or width), shape (e.g., general geometry of the slit and associated geometry of medially extending portions and laterally extending portions formed by the slit), pitch of repeating steps or other elements of each slit portion (e.g., medially extending portions and laterally extending portions), and orientation of slit portion (e.g., relative to a longitudinal or lateral direction of the sole component). In some embodiments, two or more slit portions of plural slit portions may have different configurations. For example, as shown in FIG. 36, in some embodiments first slit portion 3604 may have a first configuration (e.g., a generally serpentine configuration), second slit portion 3614 may have a second configuration (e.g., a triangular or zig-zag configuration), and third slit portion 3624 may have a third configuration (e.g., a stepped rectangular or square configuration). As shown in FIG. 36, in some embodiments first slit portion 3604 may be formed in a first region of sole component 3601 (e.g., in forefoot region 104), and may form medially extending portions 3605, with attachment portions 3606 located at medial side 107 of sole component 3601, and laterally extending portions 3607, with attachments portions 3608 located at lateral side 108 of sole component 3601. Second slit portion 3614 may be formed in a second region of sole component 3601 (e.g., in midfoot region 105), and may form medially extending portions 3615, with attachment portions 3616 located at medial side 107 of sole component 3601, and laterally extending portions 3617, with attachments portions 3618 located at lateral side 108 of sole component 3601. And third slit portion 3624 may be formed in a third region of sole component 3601 (e.g., in heel region 106), and may form medially extending portions 3625, with attachment portions 3626 located at medial side 107 of sole component 3601, and laterally extending portions 3627, with attachments portions 3628 located at lateral side 108 of sole component 3601. As shown in FIG. 36, in some embodiments first slit portion 3604 may have a length 3631 (measured in a longitudinal direction of sole component 3601), a width 3641 (measured in a lateral direction of sole component 3601), a pitch 3651, an angle 3661, and a central line 3671. Similarly, second slit portion 3614 may have a length 3632, a width 3642, a pitch 3652, an angle 3662, and a central line 3672. And third slit portion 3624 similarly may have a length 3633, a width 2643, a pitch 3653, a step width 3663 (measured in a longitudinal direction of sole component 3601), and a central line 3673. In some embodiments, two or more of length 3631, length 3632, and length 3633 may be the same. As shown in FIG. 36, in some embodiments length 3631, length 3632, and length 3633 may be different. For example, as shown in FIG. 36, in some embodiments length 3633 is greater than or equal to length 3632, which is greater than or equal to length 3631. In some embodiments, two or more of width 3641, width 3642, and width 3643 may be the same. As shown in FIG. 36, in some embodiments width 3641, width 3642, and width 3643 may be different. For example, as shown in FIG. 36, in some embodiments width 3643 is greater than or equal to width 3641, which is greater than or equal to width 3642. In some embodiments, two or more of pitch 3651, pitch 3652, and pitch 3653 may be the same. As shown in FIG. 36, in some embodiments pitch 3651, pitch 3652, and pitch 3653 may be different. For example, as shown in FIG. 36, in some embodiments pitch 3653 is greater than or equal to pitch 3651, which is greater than or equal to pitch 3652. In some embodiments, angle 3661 and angle 3662 may be the same. As shown in FIG. 36, in some embodiments angle 3661 and angle 3662 may be different. For example, as shown in FIG. 36, in some embodiments angle 3662 is greater than or equal to angle 3661. In some embodiments, step width 3663 (measured in a longitudinal direction of sole component 3601) may vary, e.g., for different medially extending portions 3625 and laterally extending portions 3627 of third slit portion 3624 (as discussed above with respect to FIG. 33), or for different slit portions of sole component 3601 (e.g., in a case where one of first slit portion 3604 and second slit portion 3614 is configured with a generally stepped rectangular or square configuration similar to third slit portion 3624). In some embodiments, two or more of central line 3671, central line 3672, and central line 3673 may be the same, e.g., they may be in common alignment. As shown in FIG. 36, in some embodiments central line 3671, central line 3672, and/or central line 3673 may be different. For example, as shown in FIG. 36, in some embodiments central line 3672 may be offset from central line 3671 by a distance 3674 in a direction of medial side 107 of sole component 3601. On the other hand, in some embodiments central line 3672 may be offset from central line 3671 in a direction of lateral side 108 of sole component 3601. Similarly, in some embodiments central line 3673 may be offset from central line 3672. For example, as shown in FIG. 36, in some embodiments central line 3673 may be offset from central line 3672 by a distance 3675 in a direction of lateral side 108 of sole component 3601. On the other hand, in some embodiments central line 3673 may be offset from central line 3672 in a direction of medial side 107 of sole component 3601 (not shown). In some embodiments, one or more of central line 3671, central line 3672, and central line 3673 may have a curved or arched configuration (not shown, but see, e.g., FIG. 35 for a central line having an arched configuration). Those skilled in the art will be able to select various combinations of configurations and dimensional features of first slit portion 3604, second slit portion 3614, and/or third slit portion 3624 suitable for achieving a sole component, sole structure, and article of footwear having desired localized lateral roll control characteristics based on this detailed description of embodiments.

Plural Slit Configuration with Common Central Line Features

Figure 37:
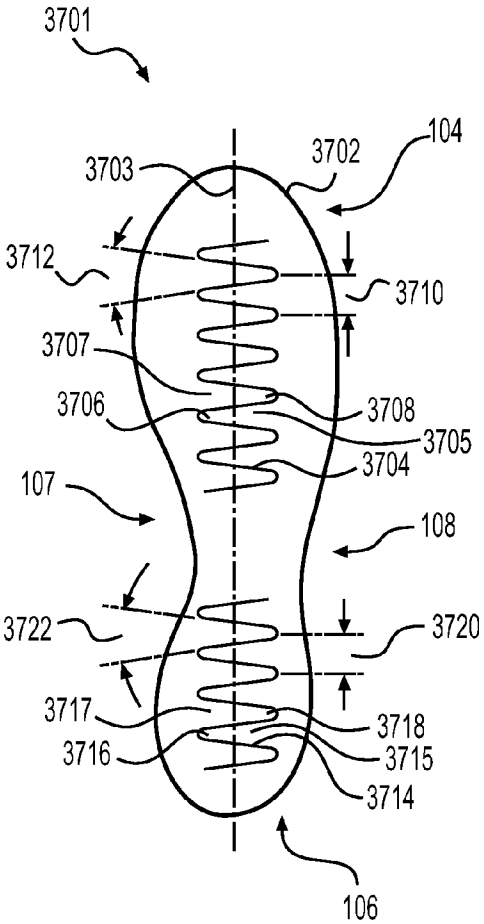
FIG. 37 is a schematic top plan view of another embodiment of a sole component having plural slit configurations for providing respective localized lateral roll control structure in plural regions of the sole component.

FIG. 37 is a top plan view of another embodiment of a sole component 3701 having lateral roll control structure including plural slits or slit portions having a common central line or orientation. In some embodiments, sole component 3701 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3701 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3701 may be different.

Different slits or slit portions may have common orientations. As shown in FIG. 37, in some embodiments sole component 3701 may include a body 3702, a first slit or slit portion 3704, e.g., located in forefoot region 104 of body 3702, and a second slit or slit portion 3714, e.g., located in heel region 106 of body 3702. In some embodiments, first slit portion 3704 may have a generally serpentine configuration that forms at least one medially extending portion 3705, having an attachment portion 3706 located at medial side 107 of medially extending portion 3705, and at least one laterally extending portion 3707, having an attachment portion 3708 located at lateral side 108 of laterally extending portion 3707. As shown in FIG. 37, in some embodiments first slit portion 3704 may have a pitch 3710 and an angle 3712. Similarly, second slit portion 3714 may have a generally serpentine configuration that forms at least one medially extending portion 3715, having an attachment portion 3716, and at least one laterally extending portion 3617, having an attachment portion 3718, and having a pitch 3720 and an angle 3722. In some embodiments, at least one of slit portion 3704 and slit portion 3714 may have a different configuration, such as a triangular zig-zag configuration (see, e.g., FIG. 32), a square stepped configuration (see, e.g., FIG. 33), a trapezoidal stepped configuration (see, e.g., FIG. 34), or another configuration. As shown in FIG. 37, in some embodiments first slit portion 3704 and second slit portion 3714 may have a common orientation, e.g., as shown by common central line 3703. As shown in FIG. 37, in some embodiments common central line 3703 generally may correspond to a central line of sole component 3701 (e.g., a central line of body 3702). It will be appreciated that this configuration, including common orientation of first slit portion 3704 and second slit portion 3714, may provide desired localized lateral roll control characteristics in each of forefoot region 104 and heel region 106 of sole component 3701, and a consistent overall lateral roll control characteristic along substantially an entire length of sole component 3701. Alternatively, in some embodiments a localized lateral roll control characteristic of first slit portion 3704 and a localized lateral roll control characteristic of second slit portion 3714 may be substantially independent.

Plural Slit Configuration with Angled Central Lines Features

Figure 38:
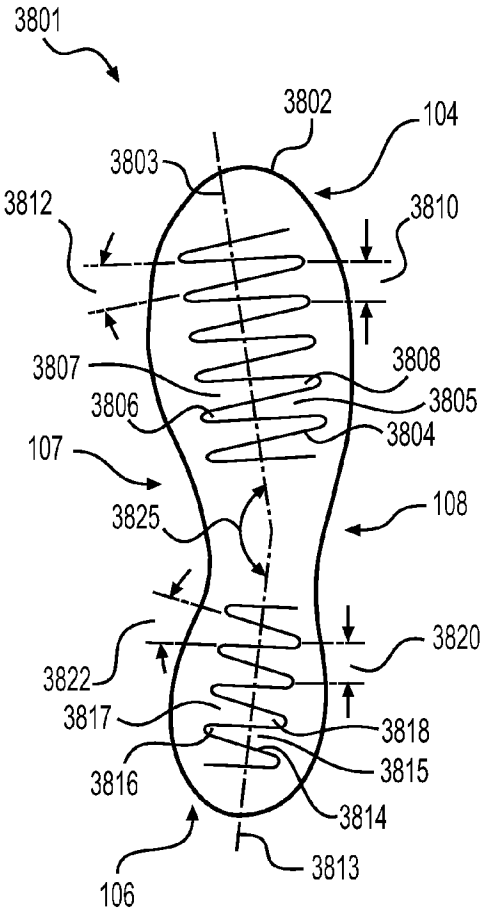
FIG. 38 is a schematic top plan view of another embodiment of a sole component having plural slit configurations for providing respective lateral roll control structure in plural regions of the sole component.

FIG. 38 is a top plan view of another embodiment of a sole component having lateral roll control structure including plural slit portions having different central lines arranged at different orientations. In some embodiments, sole component 3801 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3801 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3801 may be different.

Different slits or slit portions may have different orientations. As shown in FIG. 38, in some embodiments sole component 3801 may include a body 3802, a first slit portion 3804 located in forefoot region 104 of body 3802, and a second slit portion 3814 located in heel region 106 of body 3802. In some embodiments, first slit portion 3804 may have a generally serpentine configuration that forms at least one medially extending portion 3805, having an attachment portion 3806 located at medial side 107 of medially extending portion 3805, and at least one laterally extending portion 3807, having an attachment portion 3808 located at lateral side 108 of laterally extending portion 3807. As shown in FIG. 38, in some embodiments first slit portion 3804 may have a pitch 3810 and an angle 3812 between adjacent medially extending portions and laterally extending portions. Second slit portion 3814 may have a generally serpentine configuration that forms at least one medially extending portion 3815, having an attachment portion 3816 located at medial side 107 of medially extending portion 3815, and at least one laterally extending portion 3817, having an attachment portion 3818 located at lateral side 108 of laterally extending portion 3817. As shown in FIG. 38, in some embodiments second slit portion 3814 may have a pitch 3820 and an angle 3822 between adjacent medially extending portions and laterally extending portions. In some embodiments, at least one of first slit portion 3804 and second slit portion 3814 may have a different configuration, such as a triangular zig-zag configuration (see, e.g., FIG. 32), a square stepped configuration (see, e.g., FIG. 33), a trapezoidal stepped configuration (see, e.g., FIG. 34), or another configuration. As shown in FIG. 38, in some embodiments first slit portion 3804 may have an orientation that extends along a central line 3803 and second slit portion 3814 may have an orientation that extends along a central line 3813. As shown in FIG. 38, in some embodiments central line 3803 of first slit portion 3804 may form an angle 3825 with central line 3813 of second slit portion 3814. For example, in some embodiments central line 3803 generally may correspond to a central line of forefoot region 104 of sole component 3801, and central line 3813 generally may correspond to a central line of heel region 106 of sole component 3801. This configuration, including a relative angled orientation of first slit portion 3804 and second slit portion 3814, may provide desired localized lateral roll control characteristics in forefoot region 104 and heel region 106 of sole component 3801, and a desired overall lateral roll control characteristic for sole component 3801.

Variable Width Profile Slit Configuration Features

Different slits or slit portions may have variable width profiles. FIGS. 31 to 38 illustrate embodiments of sole components having lateral roll control structure including one or more slits or slit portions, with each slit portion respectively having a substantially constant or consistent overall width profile. In some embodiments, a slit or slit portion may have a variable width profile. That is, in some embodiments a slit or slit portion may have an overall width profile that has a variable width characteristic.

Figure 39:
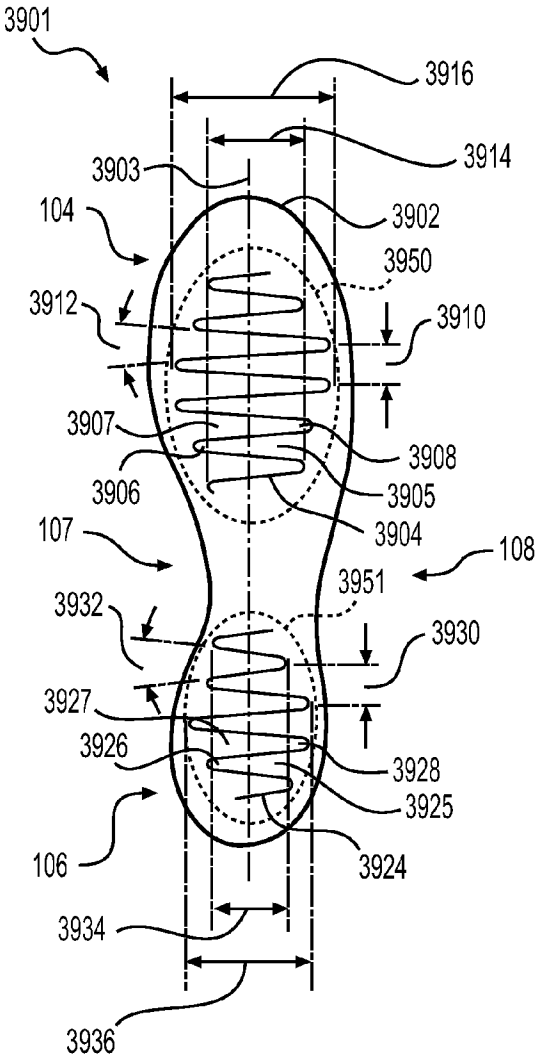
FIG. 39 is a schematic top plan view of another embodiment of a sole component having plural slit configurations for providing respective lateral roll control structure in plural regions of the sole component.

An overall width profile or characteristic of a slit or slit portion may vary in different embodiments. FIG. 39 is a top plan view of another embodiment of a sole component 3901 having lateral roll control structure including plural slit portions each having a variable width profile or characteristic. In some embodiments sole component 3901 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 3901 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 3901 may be different.

As shown in FIG. 39, in some embodiments sole component 3901 may include a body 3902, a first slit portion 3904 located in forefoot region 104 of body 3902, and a second slit portion 3924 located in heel region 106 of body 3902. In some embodiments, first slit portion 3904 may have a generally serpentine configuration that forms at least one medially extending portion 3905, having an attachment portion 3906 located at medial side 107 of medially extending portion 3905, and at least one laterally extending portion 3907, having an attachment portion 3908 located at lateral side 108 of laterally extending portion 3907. As shown in FIG. 39, in some embodiments first slit portion 3904 may have a pitch 3910 and an angle 3912 between adjacent medially extending portions and laterally extending portions. Similarly, second slit portion 3924 may have a generally serpentine configuration that forms at least one medially extending portion 3925, having an attachment portion 3926 located at medial side 107 of medially extending portion 3925, and at least one laterally extending portion 3927, having an attachment portion 3928 located at lateral side 108 of laterally extending portion 3927. As shown in FIG. 39, in some embodiments second slit portion 3924 may have a pitch 3930 and an angle 3932. In some embodiments, at least one of first slit portion 3904 and second slit portion 3924 may have a different configuration, such as a triangular zig-zag configuration (see, e.g., FIG. 32), a square stepped configuration (see, e.g., FIG. 33), a stepped trapezoidal configuration (see, e.g., FIG. 34), or another configuration.

An overall width profile of a slit or slit portion may vary in different embodiments. As shown in FIG. 39, in some embodiments an overall width profile of first slit portion 3904 may have a generally oval configuration (e.g., a generally oval shape, as represented by dashed line 3950). It will be appreciated that, in this configuration, successive medially extending portions and laterally extending portions formed by slit portion 3904 may have a stepped width configuration, e.g., from a minimum width 3914 adjacent to toe region 103 of sole component 3901 up to a maximum width 3916 and back down to a minimum width 3914 adjacent to midfoot region 105, that collectively form a generally oval width profile. Similarly, in some embodiments an overall width profile of second slit portion 3924 may have a generally oval configuration (e.g., a generally oval shape, as represented by dashed line 3951). It will be appreciated that, in this configuration, successive medially extending portions and laterally extending portions may have a stepped width configuration, e.g., from a minimum width 3934 adjacent to midfoot region 105 of sole component 3901 up to a maximum width 3936 and back down to a minimum width 3934 adjacent to heel region 106 of sole component 3901, that collectively form a generally oval width profile. As shown in FIG. 39, in some embodiments first slit portion 3904 and second slit portion 3924 may have a common central line 3903. This configuration, including common central line 3903, may provide desired localized lateral roll control characteristics in both forefoot region 104 and heel region 106 of sole component 3901, and a desired overall lateral roll control characteristic for sole component 3901. On the other hand, in some embodiments a central line of first slit portion 3904 may form an angle with a central line of second slit portion 3924 (see, e.g., FIG. 38). This configuration, including a relative angled orientation of first slit portion 3904 and second slit portion 3924, may provide desired localized lateral roll control characteristics in forefoot region 104 and heel region 106 of sole component 3901, and a desired overall lateral roll control characteristic for sole component 3901.

Lateral Roll Control Structure with Enlarged Attachment Portion Features

Figure 40:
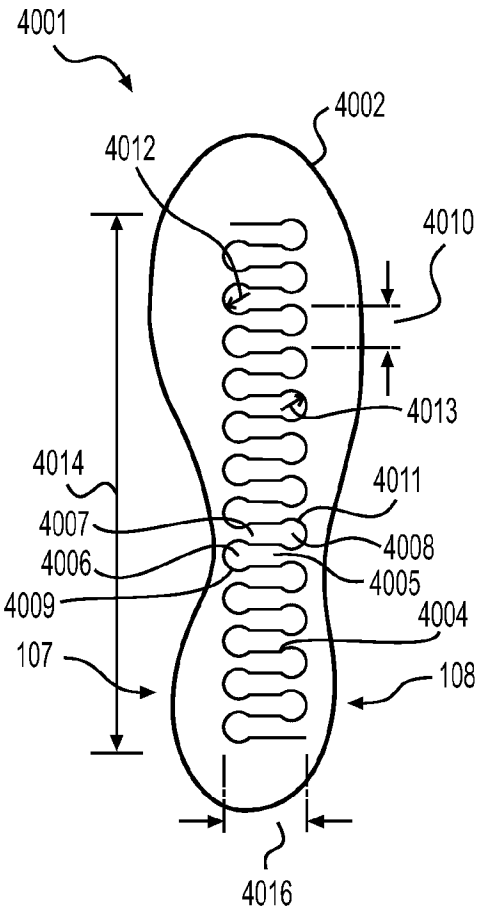
FIG. 40 is a schematic top plan view of another embodiment of a sole component having a slit configuration for providing lateral roll control structure.

FIG. 40 is a top plan view of another embodiment of a sole component 4001 having lateral roll control structure having enlarged attachment portions. In some embodiments sole component 4001 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 4001 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 4001 may be different.

A configuration of enlarged attachment portions of sole component 4001 may vary in different embodiments. As shown in FIG. 40, in some embodiments sole component 4001 generally may include a body 4002 and a slit 4004 having a generally stepped or repeating configuration formed in an interior region of body 4002. As shown in FIG. 40, in some embodiments slit 4004 may be a single continuous slit that includes alternating continuous generally medial-to-lateral extending and generally lateral-to-medial extending slit portions that collectively progress in a longitudinal direction of sole component 4001. With this configuration, slit 4004 may form a plurality of alternating medially extending portions and laterally extending portions. For example, as shown in FIG. 40, in some embodiments slit 4004 forms at least one medially extending portion 4005, having an attachment portion 4006 located at medial side 107 of medially extending portion 4005, and at least one laterally extending portion 4007, having an attachment portion 4008 located at lateral side 108 of laterally extending portion 4007.

A configuration of medially extending portions and laterally extending portions, including a configuration of respective attachment portions, may vary in different embodiments. As shown in FIG. 40, in some embodiments each medial extending portion and each laterally extending portion may have a body generally having a regular geometric shape with an enlarged attachment portion located at a distal end of the regular geometric shape. For example, as shown in FIG. 40, in some embodiments medially extending portion 4005 may have a generally rectangular body with an enlarged attachment portion 4006 having a generally circular or button shaped configuration of radius 4012. Similarly, in some embodiments each laterally extending portion may have a laterally extending portion 4007 with an enlarged attachment portion 4008 having a generally circular or button shaped configuration of radius 4013. It will be appreciated that a configuration of enlarged attachment portion 4006 and enlarged attachment portion 4008 may have different regular or non-regular shapes, e.g., circular, oval, square, rectangular, or other regular or non-regular geometric shapes. It will be appreciated that this configuration, including enlarged attachment portions formed at distal ends of medially extending portions and laterally extending portions of the lateral roll control structure of sole component 4001, may provide improved attachment characteristics of sole component 4001.

A size of enlarged attachment portions may vary in different embodiments. As shown in FIG. 40, in some embodiments medial extending portions 4005 and lateral extending portions 4007 may be arranged at a pitch 4010 in a longitudinal direction of sole component 4001. It will be appreciated that a size (e.g., a radius 4012 and/or a radius 4013) of attachment portions may vary depending on a number of factors including, but not limited to, a configuration (including at least length, width, and shape) of body 4002, a configuration (including at least longitudinal length (L) 4014 and lateral width (W) 4016) of slit 4004, a rigidity or flex characteristic of sole component 4001 (e.g., a rigidity or flex characteristic of body 4002 and/or any surface layer or treatment of sole component 4001), and other factors. Those skilled in the art will be able to select a number of medial extending portions, a number of lateral extending portions, pitch 4010, radius 4012, radius 4013, longitudinal length 4014, lateral width 4016, and a rigidity or flex characteristic of sole component 4001 suitable for achieving a desired lateral roll control characteristic of sole component 4001 for a sole structure and article of footwear based on this detailed description of embodiments.

Figure 41:
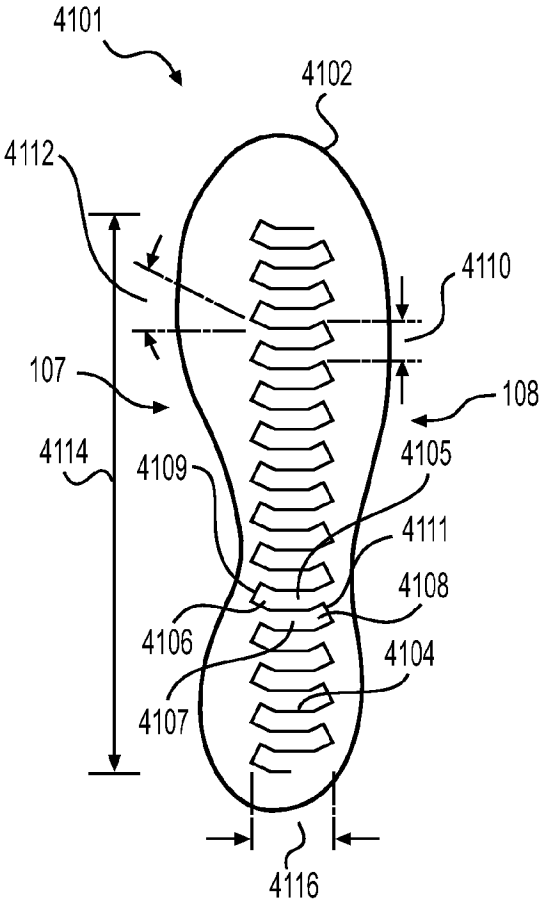
FIG. 41 is a schematic top plan view of another embodiment of a sole component having a slit configuration for providing lateral roll control structure.

Lateral Roll Control Structure with Attachment Portions Having Angled Tab Features FIG. 41 is a top plan view of another embodiment of a sole component 4101 having lateral roll control structure including attachment portions having angled tabs. In some embodiments, sole component 4101 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 4101 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 4101 may be different.

A configuration of sole component 4101 may vary in different embodiments. As shown in FIG. 41, in some embodiments sole component 4101 may include a body 4102 and a slit 4104 having a generally stepped or repeating configuration formed in an interior region of body 4102. As shown in FIG. 41, in some embodiments slit 4104 may be a single continuous slit that includes alternating contiguous generally medial-to-lateral extending and generally lateral-to-medial extending slit portions that collectively progress in a longitudinal direction of sole component 4101. As shown in FIG. 41, in some embodiments slit 4104 may form a plurality of alternating medially extending portions and laterally extending portions, including at least one medially extending portion and at least one laterally extending portion. As shown in FIG. 41, in some embodiments each medially extending portion and laterally extending portion may include an attachment portion with an angled tab. For example, as shown in FIG. 41, a medially extending portion 4105 may include an attachment portion 4106 at medial side 107 of medially extending portion 4105, with an angled tab 4109 located at a distal end of attachment portion 4106. Similarly, in some embodiments a laterally extending portion 4107 may include an attachment portion 4108 at lateral side 108 of laterally extending portion 4107, with an angled tab 4111 located at a distal end of attachment portion 4108.

An orientation of an angled tab may vary in different embodiments. For example, as shown in FIG. 41, in some embodiments angled tab 4109 and angled tab 4111 may be oriented or arranged at an angle 4112 relative to respective medially extending portions and laterally extending portions. It will be appreciated that this configuration, including angled tabs 4109 and angled tabs 4111 at distal ends of medial extending portions 4105 and lateral extending portions 4107 of the lateral roll control structure, may provide improved attachment characteristics of sole component 4101 (e.g., additional attachment interface area), directional rigidity (e.g., along a longitudinal direction of the angled tab(s)), and/or improved rotational torque or twist stability of a sole structure at tab locations of sole component 4101 (e.g., along a horizontal plane of sole component 4101). As shown in FIG. 41, in some embodiments slit 4104 may include plural medially extending portions and plural laterally extending portions arranged at a pitch 4110 in a longitudinal direction of sole component 4101. The number of medial extending portions, the number of lateral extending portions, pitch 4110, and angle 4112 may vary depending on a number of factors including, but not limited to, a configuration (including at least length, width, and shape) of body 4102, a configuration (including at least longitudinal length 4114 and lateral width 4116) of slit 4104, a rigidity or flex characteristic of sole component 4101 (e.g., a rigidity or flex characteristic of body 4102 and/or any surface layer or treatment of sole component 4101), and other factors. Those skilled in the art will be able to select the number of medial extending portions, the number of lateral extending portions, pitch 4110, angle 4112, longitudinal length 4114, lateral width 4116, and a rigidity or flex characteristic of sole component 4101 suitable for achieving a desired lateral roll control characteristic of sole component 4101 for a sole structure and article of footwear based on this detailed description of embodiments.

Figure 42:
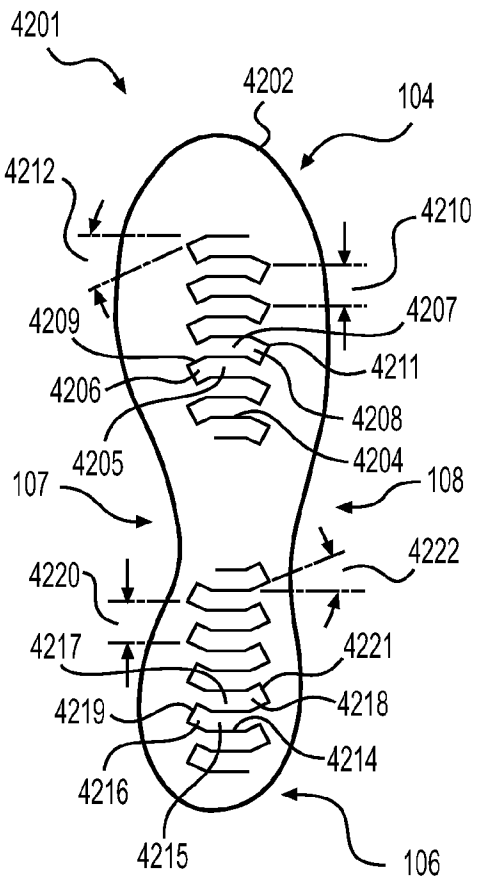
FIG. 42 is a schematic top plan view of another embodiment of a sole component having plural slit configurations for providing respective lateral roll control structures in plural regions of the sole component.

Lateral Roll Control Structure with Attachment Portions Having Opposing Angled Tab Features FIG. 42 is a top plan view of another embodiment of a sole component 4201 having lateral roll control structure, including plural slits or slit portions forming medially extending portions and laterally extending portions having attachment portions with opposing angled tabs. In some embodiments, sole component 4201 may correspond to first sole component 110 of sole structure 102 and article of footwear 100 in FIGS. 1 and 2 or first sole component 110 of sole structure 102 and article of footwear 100 in FIGS. 1 and 21. Accordingly, in some embodiments, the configuration, construction, and operational features of sole component 4201 may be substantially similar to features of first sole component 110 of sole structure 102 and article of footwear 100 in FIGS. 1 and 2 or first sole component 110 of sole structure 102 and article of footwear 100 in FIGS. 1 and 21. In some embodiments, one or more features of sole component 4201 may be different.

A configuration of an angled tab of an attachment portion of sole component 4201 may vary in different embodiments. As shown in FIG. 42, in some embodiments sole component 4201 may include a body 4202, a first slit portion 4204, e.g., located in forefoot region 104 of body 4202, and a second slit portion 4214, e.g., located in heel region 106 of body 4202. In some embodiments, first slit portion 4204 may have a generally stepped or repeating configuration that forms a plurality of medially extending portions and laterally extending portions, including at least one medial extending portion 4205 having an attachment portion 4206 located at medial side 107 of medially extending portion 4205, and at least one laterally extending portion 4207 with an attachment portion 4208 located at lateral side 108 of laterally extending portion 4207. As shown in FIG. 42, in some embodiments first slit portion 4204 may form a plurality of medially extending portions with a pitch 4210 and having a tab 4209 arranged at an angle 4212 and similarly may form a plurality of laterally extending portions 4207 with a pitch 4210 and having a tab 4211 arranged at an angle 4212. As shown in FIG. 42, in some embodiments second slit portion 4214 similarly may have a generally stepped or repeating configuration that forms a plurality of medially extending portions and laterally extending portions, including at least one medially extending portion 4215 having an attachment portion 4216 located at medial side 107 of medially extending portion 4215, and at least one laterally extending portion 4217 having an attachment portion 4218 located at lateral side 108 of laterally extending portion 4217. As shown in FIG. 42, in some embodiments second slit portion 4214 may form a plurality of medially extending portions with a pitch 4220 and having a tab 4219 arranged at an angle 4222, and similarly may form a plurality of laterally extending portions 4217 with a pitch 4220 and having a tab 4221 arranged at an angle 4222.

An orientation of tabs on attachment portions of opposing slit portions may vary in different embodiments. In some embodiments, tab 4209 and tab 4211 of first slit portion 4204 and tab 4219 and tab 4221 of second slit portion 4214 may have a common orientation, e.g., with tab 4209, tab 4211, tab 4219, and tab 4221 all angled toward a common longitudinal direction of sole component 4201 (see, e.g., common longitudinal direction of tab 4109 and tab 4111 in FIG. 41). On the other hand, as shown in FIG. 42, in some embodiments first slit portion 4204 and second slit portion 4214 may be configured with a mirror image orientation, e.g., with tab 4209 and tab 4211 of first slit portion 4204 being arranged with a first common longitudinal direction (e.g., angled toward heel region 06) and tab 4219 and tab 4221 of second slit portion 4214 being arranged with a second common longitudinal direction that is opposite the first longitudinal direction (e.g., angled toward forefoot region 104). It will be appreciated that this configuration, including mirror image orientation of tab 4209 and tab 4211 of first slit portion 4204 and tab 4219 and tab 4221 of second slit portion 4114, may provide a desired attachment characteristic and localized lateral roll control characteristics in forefoot region 104 and heel region 106 of sole component 4201, provide a desired overall lateral roll control characteristic for sole component 4201, and provide desired rotational torque or twist stability on a generally horizontal plane of sole component 4201.

Figure 43:
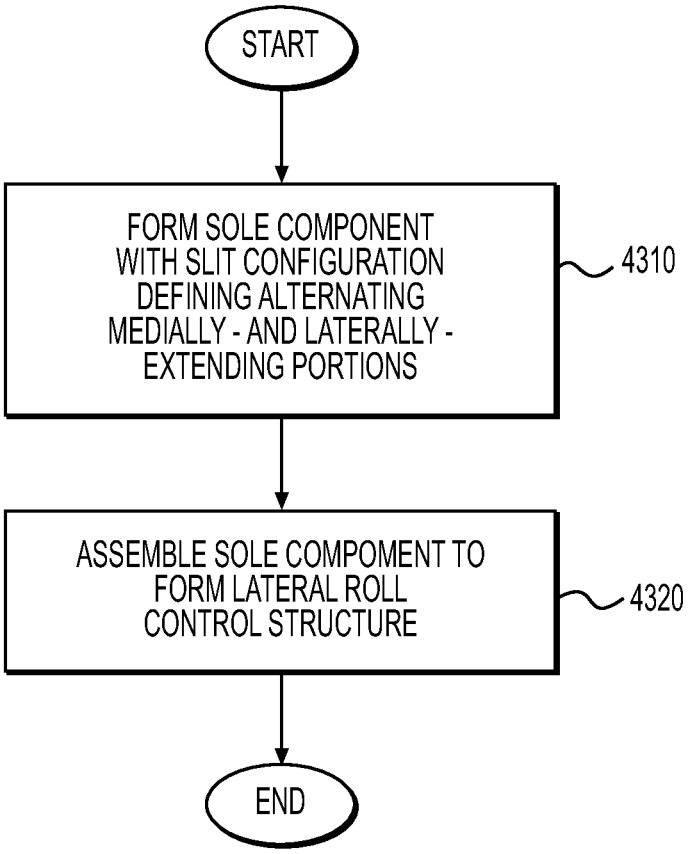
FIG. 43 is a flow chart illustrating processes for making a sole component for a sole structure or article of footwear having lateral roll control structure.

FIG. 43 is a flow chart illustrating processes for making a sole component, sole structure, and article of footwear having lateral roll control structure. Process 4310 generally includes forming a sole component with a slit configuration defining lateral roll control structure of the sole component. Process 4320 generally includes associating a sole component having a slit configuration and associated lateral roll control structure with another component to form a sole structure having lateral roll control structure or an article of footwear having lateral roll control structure. In some cases, process 4310 and process 4320 may be performed separately or independent of one another.

Process 4310 generally may include forming a sole component with a slit configuration that extends from a first surface of the sole component (e.g., the upper or lower surface) to an opposite surface of the sole component and that progresses along a longitudinal direction of the sole component to define a plurality of alternating medially and laterally extending portions in a central or interior region of the sole component. Process 4310 optionally may include forming a sole component blank prior to forming a slit configuration in the sole component. Process 4310 may include forming a slit in any generally repeating configuration, such a serpentine configuration, a zig-zag configuration, a stepped configuration, or other generally repeating configuration, as discussed above with reference to FIGS. 1 to 42. Process 4310 may include forming a slit by any known or later developed forming method. Known forming methods include, but are not limited to, a cutting process or a molding process. Exemplary cutting processes include using a mechanical cutting tool, such as a sharp edge blade or heated blade, or using another cutting tool, such as a laser cutting tool, a directed fluid stream cutting tool, or other cutting tool. Those skilled in the art will be able to select a cutting process and cutting tool suitable for a desired embodiment of a sole component having a slit configuration.

Process 4320 generally may include attaching distal ends of medially and laterally extending portions located in the central or interior region of the sole component with an opposing surface of an adjacent external component, such as another sole component or an upper of an article of footwear. In the former case, process 4320 may form a sole structure including lateral roll control structure, which sole structure further may in turn be associated with an upper to form an article of footwear. In the latter case, process 4320 may directly form an article of footwear. Process 4320 may include associating the sole component having a slit configuration with another component by any known or later developed process. Known processes for associating a sole component with another component include stitching, adhesive bonding, and thermal bonding processes. Those skilled in the art will be able to select a process for associating a sole component having a slit configuration with another component suitable for a desired embodiment of a sole structure and article of footwear.

Sole structures according to embodiments described herein may provide desired improvements in one or more performance characteristics of athletic footwear or other articles of footwear. Embodiments described herein may facilitate efficient manufacture of sole structures and articles of footwear. A sole structure including a sole component with a generally periodic repeating slit forming lateral roll control structure may be combined with other components, elements, or features to provide a comfortable fit, to provide a desired rigidity characteristic and response to impact and ground reaction forces, and to provide a range of customization in a sole structure and article of footwear. Benefits explained above with respect to different components, elements and features of a sole structure may be provided by the components, elements, and features individually, and further may be facilitated by combining certain of the components, elements, and features together.

While various embodiments have been described, the description is intended to be exemplary, rather than limiting, and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. An article of footwear, comprising:

a sole structure comprising a sole component, the sole component having a first surface, a second surface opposite the first surface, and a continuous slit that is located in an interior region of the sole component, the continuous slit extending between the first surface and the second surface of the sole component and progressing in a longitudinal direction of the sole component, the continuous slit forming:

at least one laterally extending portion of the sole component that extends from a medial side of the sole component to a lateral side of the sole component, wherein a distal end of the at least one laterally extending portion is attached to an opposing surface of an external component of the article of footwear located adjacent to the sole component, and wherein a remaining portion of the at least one laterally extending portion is free of attachment to the opposing surface of the external component of the article of footwear located adjacent to the sole component, and at least one medially extending portion of the sole component that extends from a lateral side of the sole component to a medial side of the sole component, wherein a distal end of the at least one medially extending portion of the sole component is attached to the opposing surface of the external component of the article of footwear, and wherein a remaining portion of the at least one medially extending portion is free of attachment to the opposing surface of the external component of the article of footwear, and wherein the at least one laterally extending portion and the at least one medially extending portion alternate in the longitudinal direction of the sole component.

2. The article of footwear according to claim 1, wherein the continuous slit has a generally periodic repeating configuration.

3. The article of footwear according to claim 1, wherein a configuration of the at least one laterally extending portion of the sole component includes a first geometric shape and a configuration of the at least one medially extending portion of the sole component includes a second geometric shape that is complementary to the first geometric shape.

4. The article of footwear according to claim 3, wherein the first geometric shape is a regular geometric shape.

5. The article of footwear according to claim 4, wherein the first geometric shape is one of an elliptical shape, a rectangular shape, a trapezoidal shape, and a triangular shape.

6. The article of footwear according to claim 3, wherein a configuration of the at least one laterally extending portion of the sole component includes a first non-regular geometric shape, and a configuration of the at least one medially extending portion of the sole component includes a second non-regular geometric shape that is complementary to the first non-regular geometric shape.

7. The article of footwear according to claim 3, wherein the first geometric shape and the second geometric shape are interfitting geometric shapes, such that adjacent laterally extending portions and medially extending portions of the sole component are interfitting.

8. The article of footwear according to claim 1, wherein the at least one laterally extending portion of the sole component includes a first attachment portion located at the distal end of the at least one laterally extending portion, and the at least one medially extending portion of the sole component includes a second attachment portion located at the distal end of the at least one medially extending portion.

9. The article of footwear according to claim 8, wherein a width of the first attachment portion in a longitudinal direction of the sole component is greater than a width of the at least one laterally extending portion at a location adjacent to the first attachment portion, and wherein a width of the second attachment portion in a longitudinal direction of the sole component is greater than a width of the at least one medially extending portion at a location adjacent to the second attachment portion.

10. The article of footwear according to claim 1, wherein the distal end of the at least one laterally extending portion includes a tab arranged at a first angle relative to a medial-lateral direction of the sole component, and the distal end of the at least one medially extending portion includes a tab arranged at a second angle relative to the medial-lateral direction of the sole component.

11. The article of footwear according to claim 1, wherein at least one of the first surface and the second surface of the sole component includes a surface layer formed of a material different from a material of a body of the sole component, the surface layer modifying a flex characteristic of the sole component.

12. The article of footwear according to claim 11, wherein the body is formed of a first material and the surface layer is formed of a second material different than the first material, the second material modifying a flex characteristic of the at least one laterally extending portion of the sole component and a flex characteristic of the at least one medially extending portion of the sole component.

13. The article of footwear according claim 1, wherein the external component is a second sole component of the sole structure, and the opposing surface of the second sole component has an arched configuration in a medial-lateral direction of the sole structure.

14. The article of footwear according to claim 13, further comprising a third sole component disposed on a side of the sole component having the slit that is opposite the second sole component, a peripheral portion of the third sole component being attached to a peripheral portion of the sole component having the slit.

15. The article of footwear according to claim 14, wherein the third sole component is an outer sole component.

16. The article of footwear according to claim 14, wherein the opposing surface of the second sole component has a first arched configuration, and a surface of the third sole component attached to the sole component having the slit has a second arched configuration that is complementary to the first arched configuration of the opposing surface of the second sole component.

17. The article of footwear according to claim 14, wherein the third sole component is a midsole component.

18. The article of footwear according to claim 1, further comprising an upper associated with the sole structure.

19. An article of footwear comprising:

an upper; and a sole structure associated with the upper, the sole structure having a medial side and a lateral side, the sole structure including a first sole component and a second sole component, the first sole component having a first surface, a second surface opposite the first surface, and a continuous slit located in an interior region of the first sole component, the continuous slit extending between the first surface and the second surface of the first sole component and progressing in a longitudinal direction of the first sole component, the continuous slit forming at least one laterally extending portion of the first sole component that extends from a medial side of the first sole component to the lateral side of the first sole component, wherein a distal end of the at least one laterally extending portion of the first sole component is attached to an opposing surface of the second sole component at the lateral side of the second sole component, and wherein a remaining portion of the at least one laterally extending portion is free of attachment to the opposing surface of the second sole component, and at least one medially extending portion of the first sole component that extends from a lateral side of the first sole component to a medial side of the first sole component, wherein a distal end of the at least one medially extending portion of the first sole component is attached to the opposing surface of the second sole component at the medial side of the second sole component, and wherein a remaining portion of the at least one laterally extending portion is free of attachment to the opposing surface of the second sole component, wherein the at least one laterally extending portion and the at least one medially extending portion of the first sole component alternate in a longitudinal direction of the first sole component.

* * * * *